US006990900B2

(12) United States Patent
Anderson

(10) Patent No.: US 6,990,900 B2
(45) Date of Patent: Jan. 31, 2006

(54) METHOD AND APPARATUS FOR STRETCHING AND MOUNTING A SCREEN PRINTING SCREEN

(76) Inventor: John T. Anderson, 1432 Park Blvd., Pittsburgh, PA (US) 15216-2011

( * ) Notice: Subject to any disclaimer, the term of this patent is extended or adjusted under 35 U.S.C. 154(b) by 0 days.

(21) Appl. No.: 10/686,714

(22) Filed: Oct. 17, 2003

(65) Prior Publication Data

US 2005/0081726 A1 Apr. 21, 2005

(51) Int. Cl.
*B41F 15/36* (2006.01)
*B41F 15/34* (2006.01)

(52) U.S. Cl. ..... 101/128.1; 101/127; 101/127.1; 101/129

(58) Field of Classification Search ..... 101/127, 101/127.1, 128.1; 38/102.2
See application file for complete search history.

(56) References Cited

U.S. PATENT DOCUMENTS

| | | | | |
|---|---|---|---|---|
| 2,608,750 A | | 9/1952 | Cluzel | 29/448 |
| 2,759,217 A | | 8/1956 | Peterson | 38/102.4 |
| 3,315,301 A | | 4/1967 | Dibblee et al. | 26/1 |
| 3,361,612 A | | 1/1968 | Rowbottam | 156/495 |
| 4,186,660 A | | 2/1980 | Key | 101/128.1 |
| 4,430,815 A | | 2/1984 | Wulc | 38/102.91 |
| 4,978,414 A | | 12/1990 | Ohtani et al. | 156/494 |
| 5,063,842 A | | 11/1991 | Clarke | 101/127.1 |
| 5,096,524 A | | 3/1992 | Ohtani et al. | 156/160 |
| 5,113,611 A | * | 5/1992 | Rosson | 36/102.7 |
| 5,136,797 A | | 8/1992 | Hildebrandt | 38/102.91 |
| 5,148,745 A | * | 9/1992 | Hamu | 101/127.1 |
| 5,152,219 A | * | 10/1992 | Adachi et al. | 101/123 |
| 5,271,171 A | | 12/1993 | Smith | 38/102.5 |
| 5,297,487 A | * | 3/1994 | Simmons | 101/127 |
| 5,306,376 A | * | 4/1994 | James | 156/291 |
| 5,522,148 A | | 6/1996 | Newman | 33/620 |
| 5,581,918 A | | 12/1996 | Schilling et al. | 38/102.1 |
| 5,598,776 A | | 2/1997 | Casl | 101/127.1 |
| 5,606,911 A | * | 3/1997 | Cane | 101/127 |
| 5,937,751 A | | 8/1999 | Newman, Jr. | 101/127.1 |
| 5,941,171 A | * | 8/1999 | Fromm | 101/127.1 |
| 6,070,526 A | | 6/2000 | Larson | 101/129 |
| 6,073,554 A | * | 6/2000 | Cutcher, Sr. | 101/127 |
| 6,435,085 B1 | | 8/2002 | York | 101/127.1 |
| 6,561,089 B1 | * | 5/2003 | Newman, Jr. | 101/127.1 |
| 2003/0056665 A1 | * | 3/2003 | Tanaka | 101/127.1 |
| 2003/0061953 A1 | | 4/2003 | Bruckl et al. | 101/228 |

(Continued)

FOREIGN PATENT DOCUMENTS

DE 3533269 A1 3/1987

(Continued)

*Primary Examiner*—Daniel J. Colilla
(74) *Attorney, Agent, or Firm*—Richard C. Litman

(57) ABSTRACT

A method and apparatus for stretching and mounting a screen printing screen or mesh that separates the tensioning of the screen/mesh into two independent directions with the screen/mesh attached to two separate independent frames. The outer frame has two ends perpendicular to a print direction for attaching to ends of a screen mesh. The outer frame is placed outside of the inner frame, and supports the screen/mesh tensioned in the print direction of movement, with a high level of tension. The inner frame has two sides parallel to a print direction for attaching to the sides of the screen/mesh. The sides of the inner frame can apply tension, when applicable, to the screen/mesh, at a significantly lower tension level in the non-print direction, can act as, or provide a fixing point for barriers to stop the leakage or loss of the print medium or ink from the screen.

33 Claims, 49 Drawing Sheets

U.S. PATENT DOCUMENTS

2005/0034614 A1 * 2/2005 Kasuya ..... 101/127.1

FOREIGN PATENT DOCUMENTS

| | | | | |
|---|---|---|---|---|
| DE | 3601167 | A1 | | 12/1990 |
| DE | 4018454 | | * | 12/1991 |
| DE | 4 437 503 | A1 | | 5/1995 |
| EP | 0 650 832 | A1 | | 5/1995 |
| GB | 2171053 | A | | 8/1986 |
| GB | 2195129 | A | | 3/1988 |
| GB | 2249052 | | * | 4/1992 |
| GB | 2 272 863 | A | | 6/1994 |
| JP | 2003-094602 | | * | 4/2003 |

* cited by examiner

*Fig. 1* (*Prior Art*)

METHOD AND APPARATUS FOR STRETCHING AND MOUNTING A SCREEN PRINTING SCREEN

BACKGROUND OF THE INVENTION

1. Field of the Invention

The present invention generally relates to a method and apparatus for use within a screen printing type operation. In particular, the invention relates to a method and apparatus for tensioning and mounting a screen in separate directions on a dual frame system to be used in screen printing.

2. Description of the Related Art

Screen printing utilizes a tensioned screen or mesh mounted on a frame having a stenciled image thereon. Ink is applied through the screen in the areas where the stencil has not blocked the openings between the threads of the mesh. The screen/mesh is typically fixed onto a rectangular (sometimes square) frame. Screen/mesh printing is highly variable in nature, with one of the main causes being the tension variation across a screen/mesh simultaneously stretched in two directions, either immediately, or due to variable tension loss over time. The variation in tensioning forces also affects the regular nature of the woven screen/mesh structure, causing variation in screen/mesh opening sizes, and ink/fluid transfer rates. To address this systems are available for multi-stage screen/mesh stretching, to retension the screen/mesh after use, in an attempt to increase stability and consistency over time and use. However, these systems increase the cost of producing a stable and consistent screen printed product, and each time the screen/mesh is used it risks damage and loss. Screen/mesh is typically supplied on rolls for multiple applications and, to a very limited extent, pre-coated with stencil materials. The rolls are often large, difficult to handle, and liable to impact damage. Stretching systems for screen printing are highly variable in the range of mechanisms and techniques used.

A conventional screen/mesh stretching and mounting process is illustrated in FIGS. 1–4. A screen/mesh is initially clamped 10 and stretched 12 in two directions. A single frame is then moved 14 to contact the screen/mesh. The single frame is then fixed to the screen/mesh permanently or via retensionable side mechanisms 16. Excess screen/mesh is then trimmed and the screen/mesh is then ready for imaging and use 18. FIG. 2 illustrates effects 20 of two directional forces in a conventional screen/mesh stretching process. FIG. 3 illustrates effects 22 of two directional stretching in a conventional screen/mesh stretching process. FIG. 4 illustrates the usable area against waste area 24 of a screen/mesh in a conventional two directional stretching process.

Once the screen/mesh is attached to the single frame resistive forces to deflection are applied under a squeegee action in the plain of the screen/mesh. This is particularly true the nearer to the frame the squeegee travels. This results in variation in the squeegee deflection and screen/mesh contact across the width of the print image and perpendicular to the print direction. To address this squeegee action deflection forces are increased to ensure contact at the ends of the print area, which results in excess squeegee pressure and deflection at the center of the print image, causing increased squeegee wear, possible screen/mesh damage, and/or variation of ink and/or fluid transfer across the print width.

Once printing is complete, unless the screen/mesh is to be reused for the same print job, the stretched screen/mesh will be reclaimed by removal of the stencil material using harsh chemicals and/or high pressure water jets. This is a time consuming and costly process, only justified by the high screen/mesh preparation cost, and improved screen/mesh stability over time with the conventional single frame screen/mesh printing process. The screen/mesh reclamation is also potentially harmful to the environment, due to the need to use chemicals, water, and energy to remove the stencil, along with significant disposal issues for the remaining chemicals, stencil components, inks/fluids, and water remaining at the end of the process.

Therefore, a need exists for a method and apparatus for stretching and mounting a screen printing screen that assures reliable printing qualities, while offering the potential of a simplified production system by achieving disposable screen printing with woven screen/mesh materials.

The related art is represented by the following references of interest.

U.S. Patent Application Publication No. 2002/0061953 A1, published on Apr. 3, 2003 for Thomas R. Bruckl et al., describes a device for drawing a printing material web into a rotary printing press. The Bruckl et al. application does not suggest a method and apparatus for stretching and mounting a screen printing screen according to the claimed invention.

U.S. Pat. No. 2,608,750, issued on Sep. 2, 1952 to Albert C. Cluzel, describes an apparatus for and a method of making printing screens. The Cluzel patent does not suggest a method and apparatus for stretching and mounting a screen printing screen according to the claimed invention.

U.S. Pat. No. 2,759,217, issued on Aug. 21, 1956 to Albin K. Peterson, describes a stretching apparatus for forming thick sheets into thinner sheets. The Peterson patent does not suggest a method and apparatus for stretching and mounting a screen printing screen according to the claimed invention.

U.S. Pat. No. 3,315,301, issued on Apr. 25, 1967 to Harold J. Dibblee et al., describes an apparatus for universally stretching and forming sheet material. The Dibblee et al. patent does not suggest a method and apparatus for stretching and mounting a screen printing screen according to the claimed invention.

U.S. Pat. No. 3,361,612, issued on Jan. 2, 1968 to Francis W. Rowbottam, describes an apparatus for installing screening from a roll onto framing having marginal edges provided with a fusible material. The Rowbottam patent does not suggest a method and apparatus for stretching and mounting a screen printing screen according to the claimed invention.

U.S. Pat. No. 4,186,660, issued on Feb. 5, 1980 to John W. Key, describes a screen printing frame with plastic side bars bondable to fabric by surface softening. The Key patent does not suggest a method and apparatus for stretching and mounting a screen printing screen according to the claimed invention.

U.S. Pat. No. 4,430,815, issued on Feb. 14, 1984 to Stanley S. Wulc, describes a screen printing apparatus which includes a frame to which will be attached to the edge portions of a screen fabric. The Wulc patent does not suggest a method and apparatus for stretching and mounting a screen printing screen according to the claimed invention.

U.S. Pat. No. 4,978,414, issued on Dec. 18, 1990, U.S. Pat. No. 5,096,524, issued on Mar. 17, 1992, Great Britain Patent Application Publication No. GB 2 171 053 A, published on Aug. 20, 1986, and Germany Patent Application Publication No. DE 3 601 167 A1, published on Dec. 18, 1990, for Yasuaki Ohtani et al., describe an automatic silk stretching apparatus for stretching silk on a silk screen printing frame. The Ohtani et al. '414 and '524 patents, the Great Britain '053 application, and the Germany '167 application do not suggest a method and apparatus for stretching and mounting a screen printing screen according to the claimed invention.

U.S. Pat. No. 5,063,842, issued on Nov. 12, 1991 to Joseph Clarke, describes a screen tensioning and framing device. The Clarke patent does not suggest a method and apparatus for stretching and mounting a screen printing screen according to the claimed invention.

U.S. Pat. No. 5,136,797, issued on Aug. 11, 1992 to Greg A. Hildebrandt, describes a frame having shiftable bars with flexible ends for securing fabric using adhesive. The Hildebrandt patent does not suggest a method and apparatus for stretching and mounting a screen printing screen according to the claimed invention.

U.S. Pat. No. 5,271,171, issued on Dec. 21, 1993 to David C. Smith, describes a stretching frame for a fabric material that provides for spring mounting of the four frame sides. The Smith patent does not suggest a method and apparatus for stretching and mounting a screen printing screen according to the claimed invention.

U.S. Pat. No. 5,522,148, issued on Jun. 4, 1996 to Donald E. Newman, describes a registration/adapter apparatus for aligning a printing screen with an image platform. The Newman patent does not suggest a method and apparatus for stretching and mounting a screen printing screen according to the claimed invention.

U.S. Pat. No. 5,581,918, issued on Dec. 10, 1996 to Christian Schilling et al., Germany Patent Application Publication No. DE 4 437 503 A1, published on May 4, 1995, and European Patent Application No. EP 0 650 832 A1, published on May 3, 1995, describe an apparatus for stretching out a rectangular material in a printing frame with tensioning devices which are arranged at the sides thereof. The Schilling et al. patent, the Germany '503 application, and the European '832 application do not suggest a method and apparatus for stretching and mounting a screen printing screen according to the claimed invention.

U.S. Pat. No. 5,598,776, issued on Feb. 4, 1997 to Slobodan Casl, describes a screen printing apparatus which is tensionable. The Casl patent does not suggest a method and apparatus for stretching and mounting a screen printing screen.

U.S. Pat. No. 5,937,751, issued on Aug. 17, 1999 to Eugene F. Newman, Jr., describes a screen printing frame and bordered fabric stretching devices for quickly stretching and for retensioning a screen. The Newman, Jr. '751 patent does not suggest a method and apparatus for stretching and mounting a screen printing screen according to the claimed invention.

U.S. Pat. No. 6,070,526, issued on Jun. 6, 2000 to James D. Larson, describes a tensioning system for use in a retensionable frame used in silk screening wherein the fabric is precut and bordered with splines such that the appropriate tension is predetermined. The Larson patent does not suggest a method and apparatus for stretching and mounting a screen printing screen according to the claimed invention.

U.S. Pat. No. 6,435,085 B1, issued on Aug. 20, 2002 to James A. York, describes a print screen frame used in the textile screen print industry. The York patent does not suggest a method and apparatus for stretching and mounting a screen printing screen according to the claimed invention.

U.S. Pat. No. 6,561,089 B1, issued on May 13, 2003 to Eugene F. Newman, Jr., describes a screen assembly with border strips already adhered to fabric in precisely measured locations along each edge of the screen fabric. The Newman, Jr. '089 patent does not suggest a method and apparatus for stretching and mounting a screen printing screen according to the claimed invention.

Germany Patent Application Publication No. DE 3 533 269 A1, published on Mar. 26, 1987, describes a screen printing frame having a rectangular frame opening bounded by four frame sections for technical and graphic printing. The Germany '269 application does not suggest a method and apparatus for stretching and mounting a screen printing screen according to the claimed invention.

Great Britain Patent Application Publication No. GB 2 195 129 A, published on Mar. 30, 1988, describes a screen stretching and securing frame. The Great Britain '129 application does not suggest a method and apparatus for stretching and mounting a screen printing screen according to the claimed invention.

Great Britain Patent Application Publication No. GB 2 272 863 A, published on Jun. 1, 1994, describes a screen printing apparatus that includes a screen frame which supports a screen of natural or artificial fabric or metal mesh, a squeegee to force ink through unsealed portions of the screen, and a tunnel supplied with heated air for drying workpieces fed on a transporting belt. The Great Britain '863 application does not suggest a method and apparatus for stretching and mounting a screen printing screen according to the claimed invention.

None of the above inventions and patents, taken either singly or in combination, is seen to describe the instant invention as claimed. Thus a method and apparatus for stretching and mounting a screen printing screen solving the aforementioned problems is desired.

SUMMARY OF THE INVENTION

The present invention is a method and apparatus for stretching and mounting a screen printing screen. The apparatus generally includes a dual frame system for separating and supporting the tensioning forces on a screen printing screen/mesh in two directions. Significant tension forces are applied in a print direction, while perpendicular forces are lower and less significant. The inner frame enables placement of an ink/fluid barrier(s) for ink/fluid retention on the screen/mesh for controlled transfer during the printing action.

The system provides a method of achieving controlled and consistent screen properties for new or reused screen/mesh materials. The system is applicable for use with conventional woven screen/mesh materials in a disposable, as well as reusable, screen printing system. The separation of the tension forces also simplifies press setup and operation, by reducing the two directional tensioning forces, and resistance on the screen deflection to a minimum.

Accordingly, it is a principal aspect of the invention to provide a method for stretching and mounting a screen printing screen that provides an outer frame with two ends generally perpendicular to a print direction, provides an inner frame with two print direction sides generally parallel to the print direction, provides a screen/mesh with two print direction sides and two ends, the print direction sides being generally parallel to the print direction and the ends being generally perpendicular to the print direction, clamps an end of the screen/mesh, applies significant tension forces to the screen/mesh in the print direction to produce a stretched screen/mesh, moves the outer frame to contact the stretched screen/mesh, attaches the stretched screen/mesh to the ends of the outer frame, trims excess screen/mesh along the print direction, moves the inner frame to contact the screen/mesh, attaches the screen/mesh to the print direction sides of the inner frame, and provides imaging/printing on the screen/mesh.

It is another aspect of the invention to provide an apparatus for stretching and mounting a screen printing screen, the apparatus including an inner frame with two print direction sides for attaching to print direction sides of a screen/mesh, the sides of the inner frame being positionable generally parallel to a print direction; and an outer frame with two ends for attaching to ends of a screen mesh, the ends of the outer frame being positionable generally perpendicular to the print direction, the outer frame being placeable outside the inner frame, wherein the inner and outer frames do not connect, support, or constrain each other to provide tension, and enable application of significant tension forces to the screen/mesh in the print direction.

It is an aspect of the invention to provide improved elements and arrangements thereof in a method and apparatus for stretching and mounting a screen printing screen for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
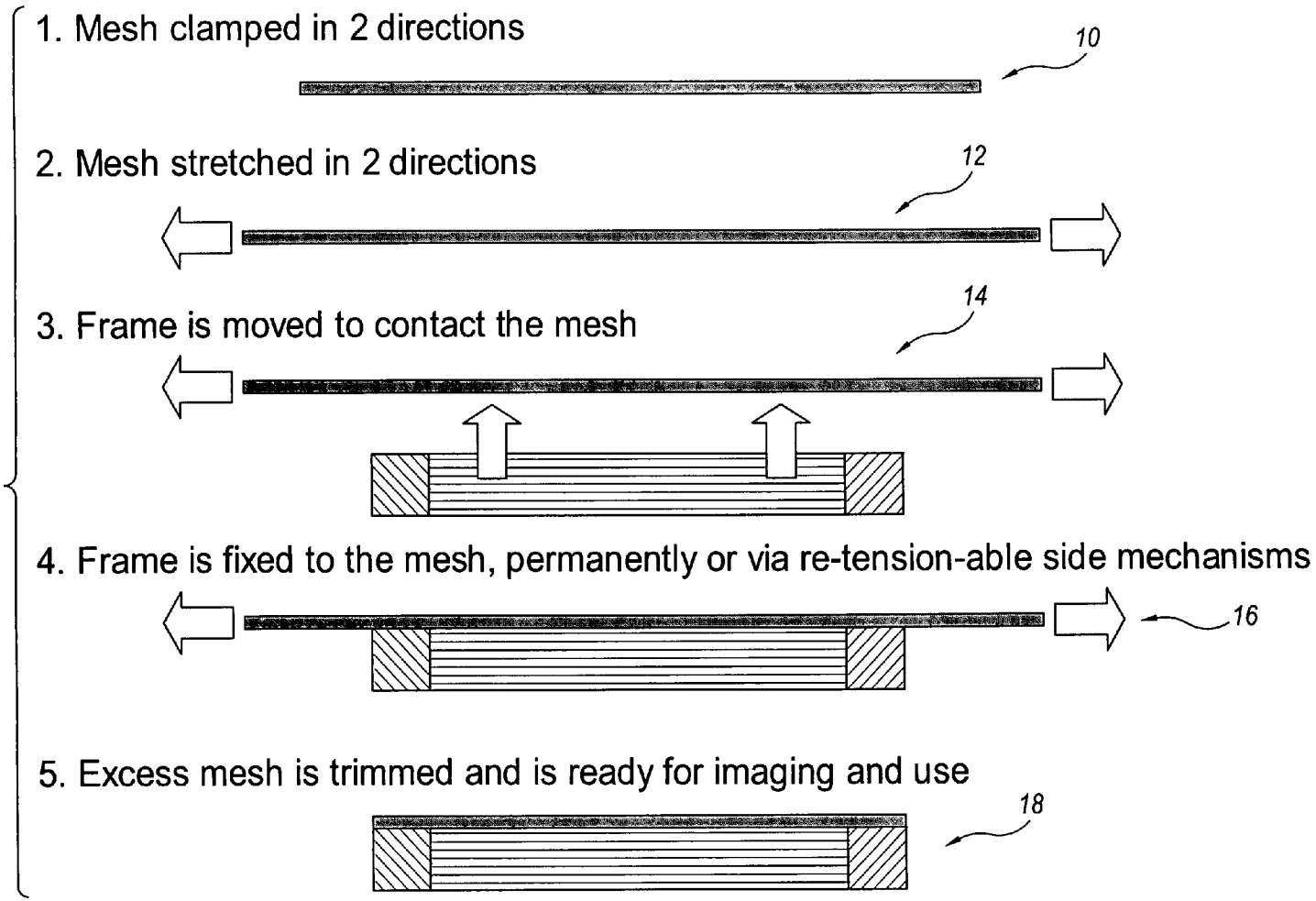
FIG. 1 shows steps involved in a conventional screen/mesh printing stretching process.
Figure 2:
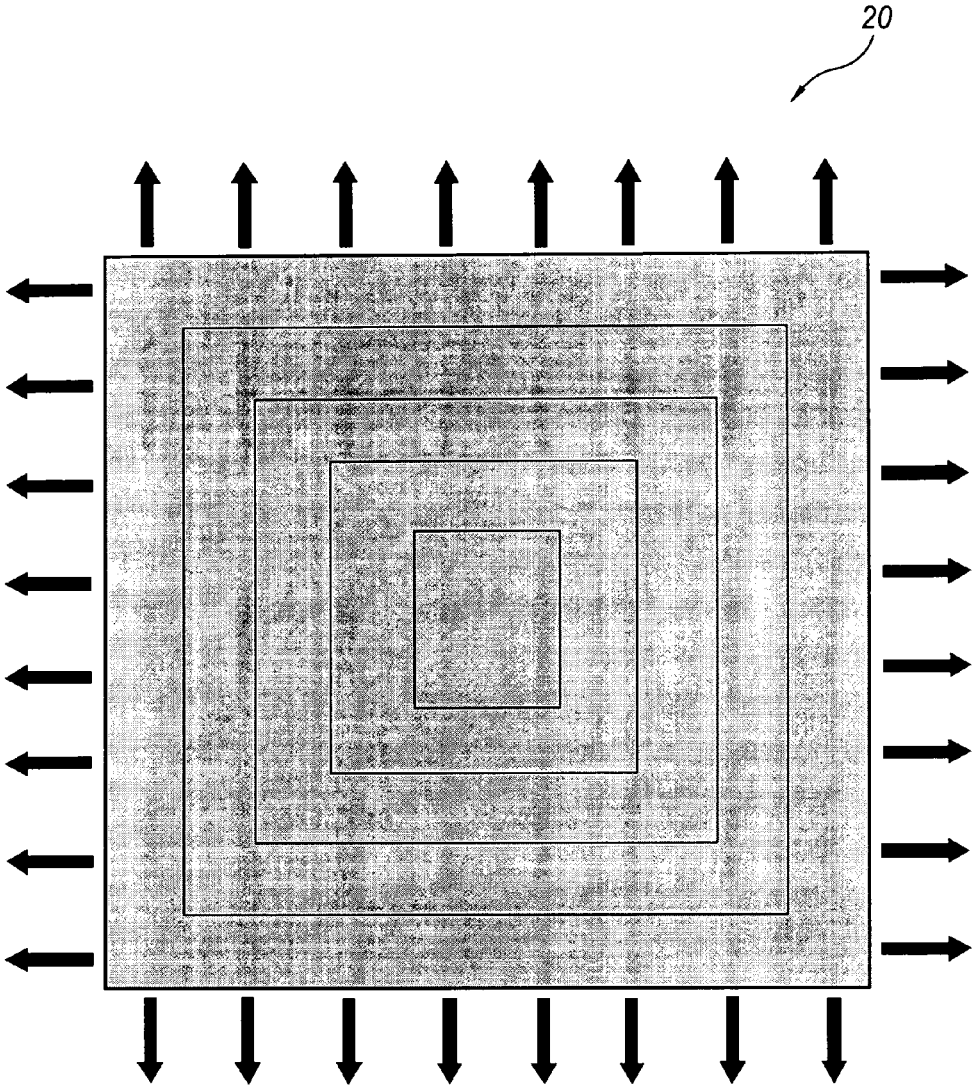
Fig. 2 (Prior Art)
FIG. 2 illustrates the effects of two directional forces in a conventional screen/mesh stretching process.
Figure 3:
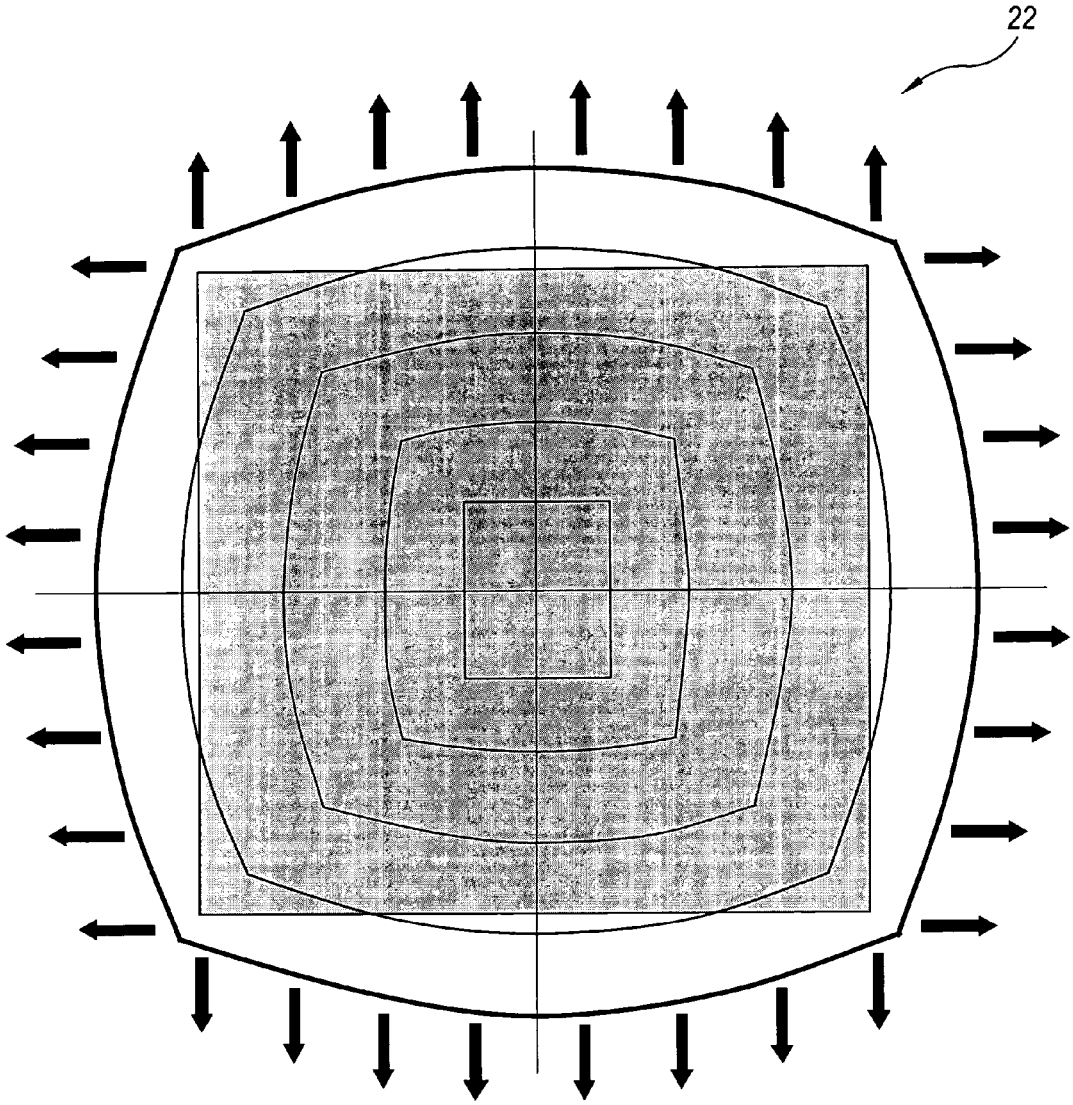
Fig. 3 (Prior Art)
FIG. 3 illustrates the effect of two directional stretching in a conventional screen/mesh stretching process.
Figure 4:
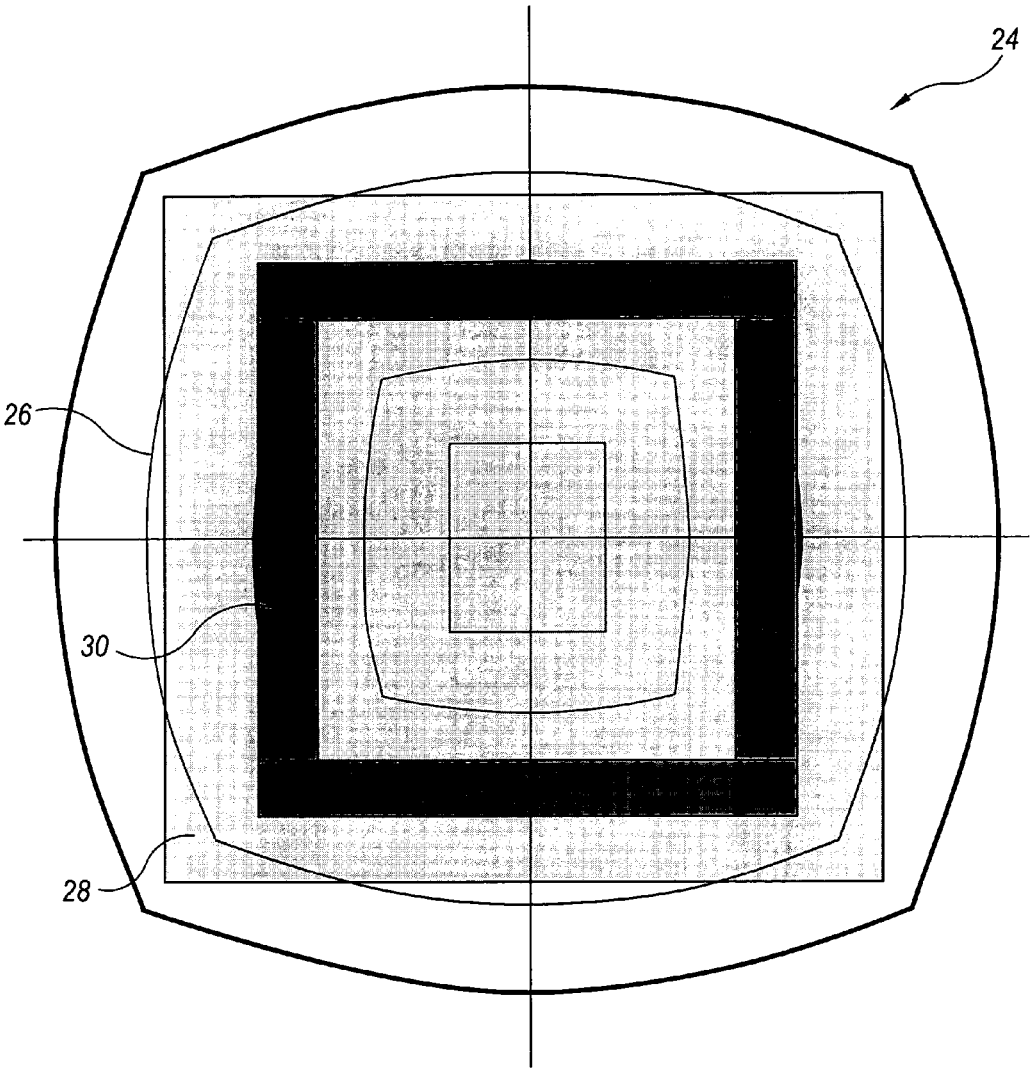
Fig. 4 (Prior Art)
FIG. 4 illustrates the useable area against waste area of a screen/mesh in a conventional two directional stretching process.

The present invention is a method and apparatus for stretching and mounting a screen printing screen. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Screen printing according to the present invention separates tension forces into a major and a minor set and greatly reduces the variation of tension forces during the stretching process, allowing highly consistent screens to be produced each and every time. The method of stretching and mounting a screen printing screen is achieved in two single and separate stretching process stages which accelerate the screen printing process, reduces the potential variables, and eliminates the variation due to the two directional stretching processes combined with the screen use. The use of existing fixed or retensioning frames as the outer frame allows its implementation, as an option in all existing, as well as new screen printing companies. The attachment of an inner frame to the side edges of a screen/mesh increases stability and support for image quality, while also providing a means to attach single or multi-part barriers to contain the ink/fluid within the printing area of the screen/mesh, allowing the inventive screen printing process to be used within existing presses and printing companies.

A method for stretching and mounting a screen printing screen according to the invention provides an outer frame with two ends generally perpendicular to a print direction, provides an inner frame with two print direction sides generally parallel to the print direction, and provides a screen/mesh with two print direction sides and two ends, the print direction sides being generally parallel to the print direction and the ends being generally perpendicular to the print direction. An end of the screen/mesh is clamped. Significant tension forces are applied to the clamped screen/mesh in the print direction to produce a stretched screen/mesh. The outer frame is moved to contact the stretched screen/mesh, and the stretched screen/mesh is attached to the ends of the outer frame. The inner frame is moved to contact the screen/mesh, and the screen/mesh is attached to the print direction sides of the inner frame. Imaging/printing is provided on the screen/mesh.

An apparatus for stretching and mounting a screen printing screen according to the invention includes an inner frame an inner frame with two print direction sides for attaching to print direction sides of a screen/mesh, the sides of the inner frame being positionable generally parallel to a print direction, and an outer frame with two ends for attaching to ends of a screen mesh, the ends of the outer frame being positionable generally perpendicular to the print direction, the outer frame being placeable outside the inner frame. The inner and outer frames do not connect, support, or constrain each other to provide tension, and enable application of significant tension forces to the screen/mesh in the print direction.

Figure 5:
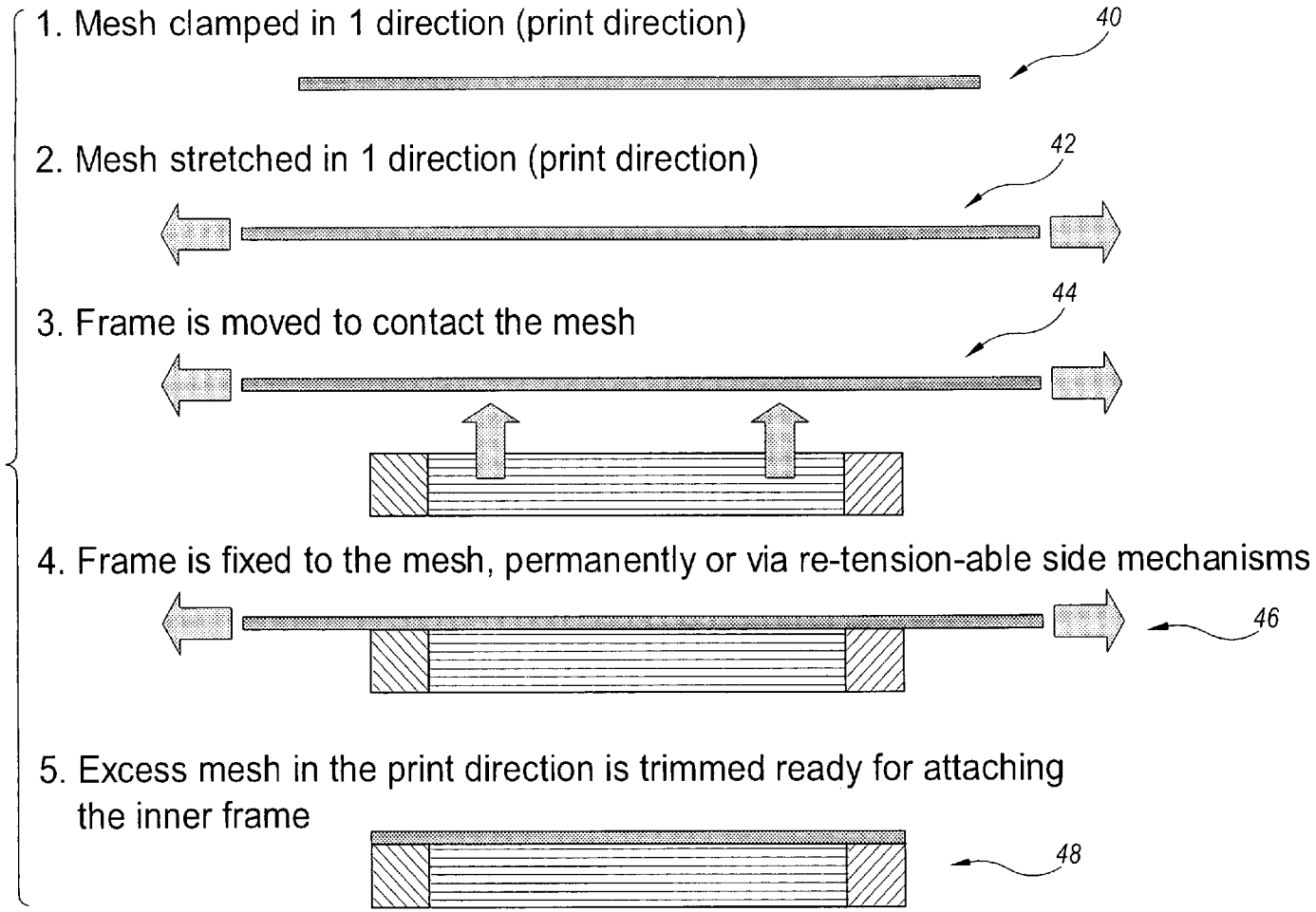
FIG. 5 illustrates steps involved in a screen/mesh stretching process according to the present invention.
Figure 6:
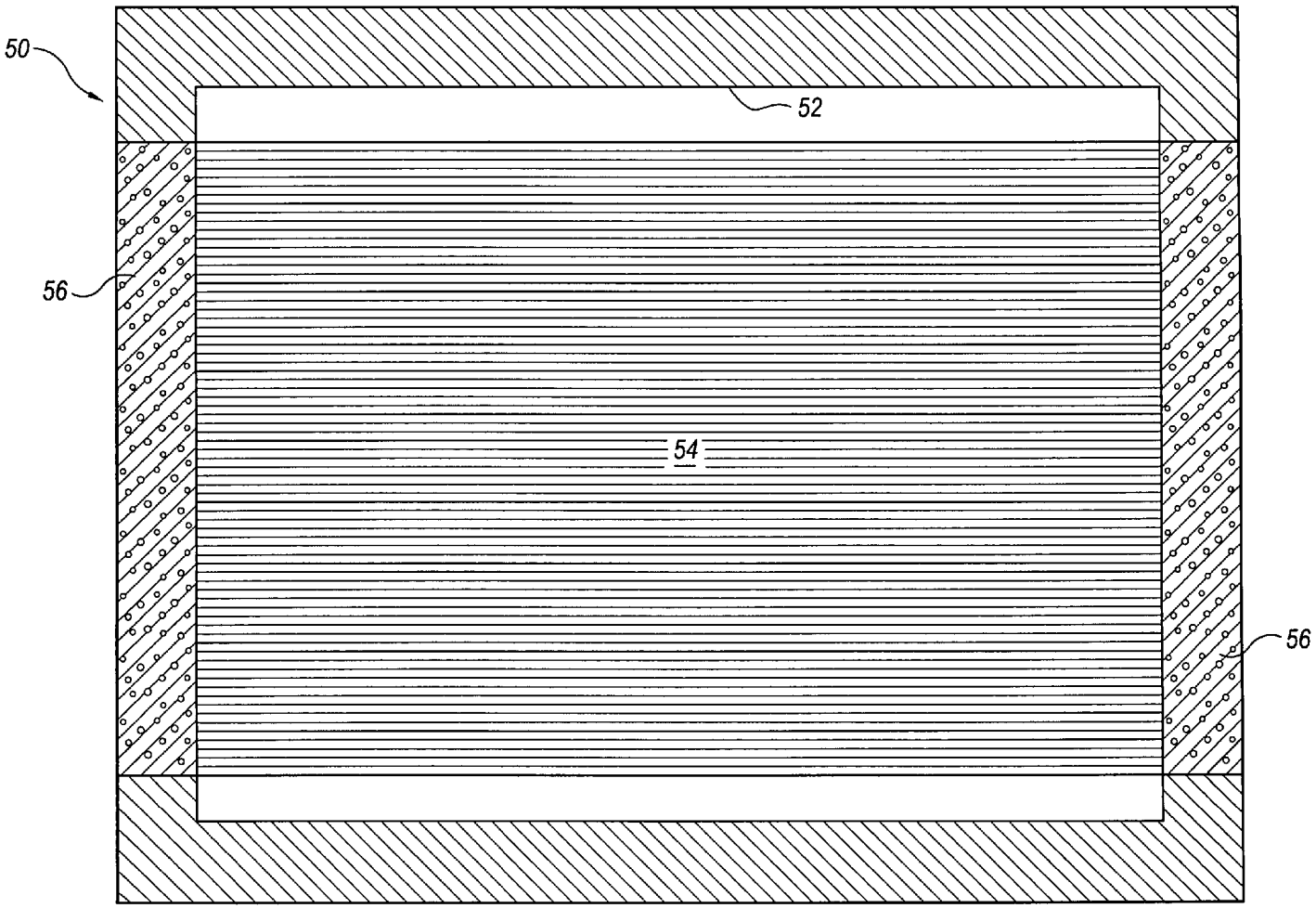
FIG. 6 shows a screen/mesh mounted on an outer frame following print direction stretching according to the present invention.

FIG. 5 shows steps involved in a screen/mesh stretching process according to the invention. While the screen/mesh material is preferably made and/or woven of polyester, the screen/mesh material may alternatively be made and/or woven of silk, nylon, etc. The screen/mesh has two print direction sides and two ends, the print direction sides being generally parallel to the print direction and the ends being generally perpendicular to the print direction. An end of the screen/mesh is clamped 40. The screen/mesh is then stretched in the print direction 42. An outer frame is then moved to contact the screen/mesh 44. The outer frame has two ends generally perpendicular to the print direction. The ends of the outer frame are fixed to the screen/mesh permanently or via retensionable side mechanisms 46. Excess screen/mesh along the print direction is then trimmed and the screen/mesh is then ready for attaching to print direction sides of an inner frame 48. FIG. 6 shows an image 50 illustrating a screen/mesh 54 mounted on the outer frame 52 following the print direction stretching steps shown in FIG. 5. The ends of the screen/mesh 56 are fixed to the ends of the outer frame 52.

Figure 7A:
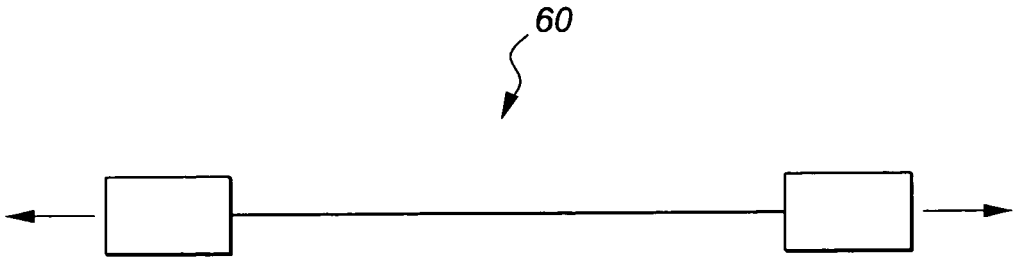
FIGS. 7A, 7B, 7C, 7D, 7E, and 7F illustrate alternative print direction stretching techniques according to the present invention.
Figure 7B:
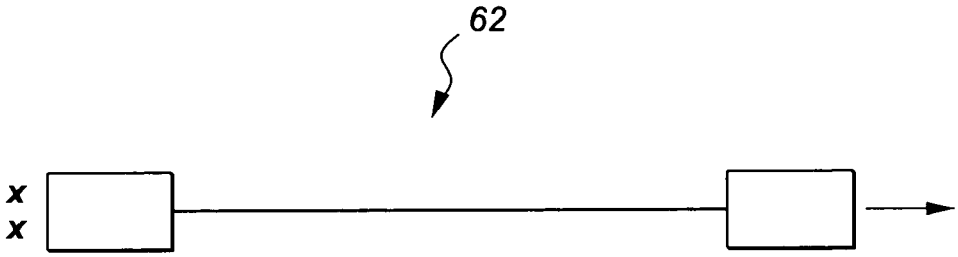
Figure 7C:
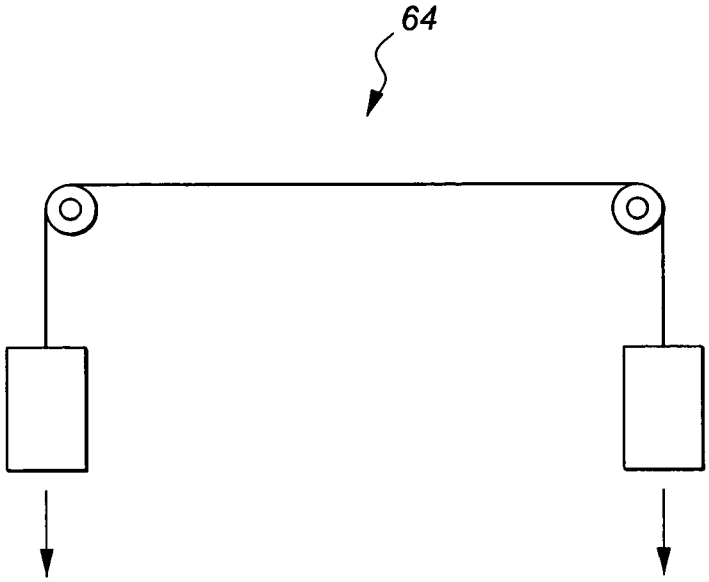
Figure 7D:
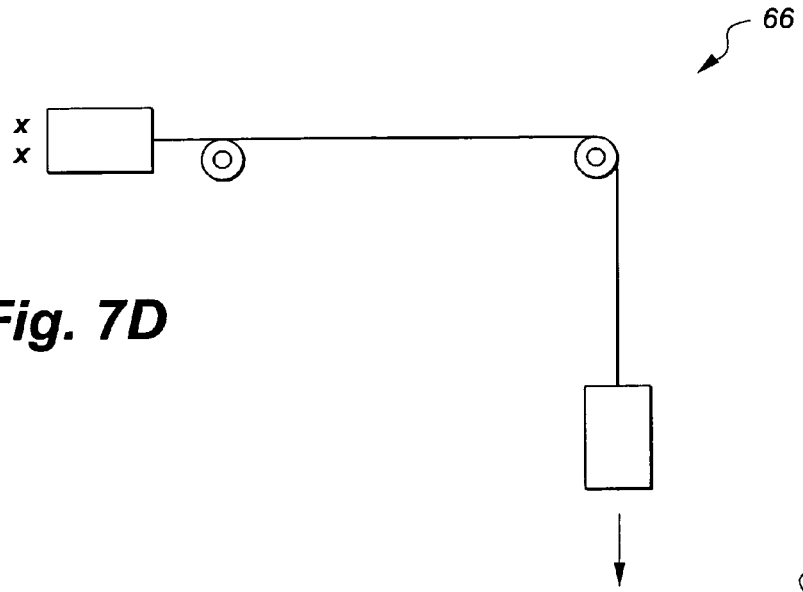
Figure 7E:
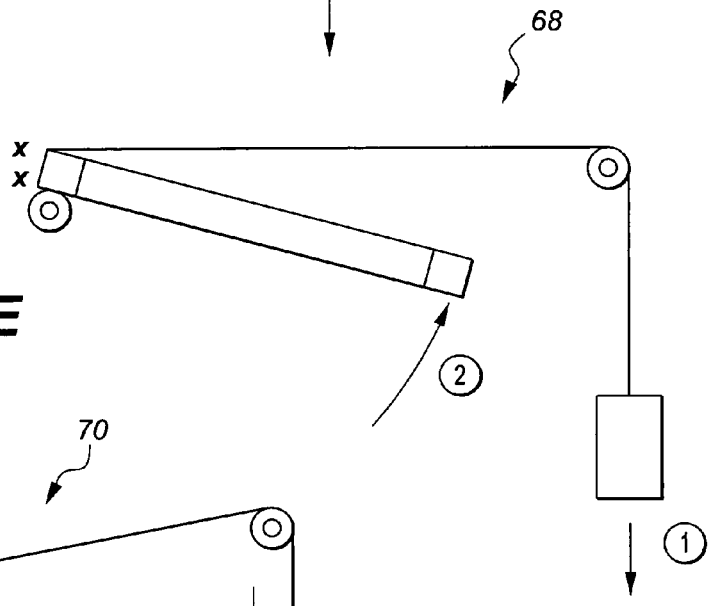
Figure 7F:
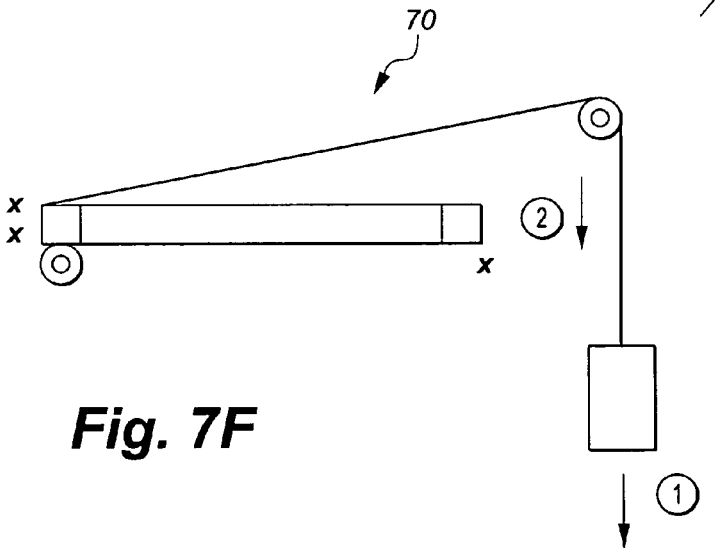

FIG. 7A shows a simple pulling system 60 with equal and opposite pulling forces applied to a screen/mesh to apply tension to the screen/mesh along the print direction. FIG. 7B shows a simple pulling system 62 where one end of a screen/mesh is fixed and the other end is pulled to apply tension to the screen/mesh along the print direction. FIG. 7C shows a gravity pulling system 64 where two equal gravity loads are applied to the ends of a screen/mesh and to facilitate easy print direction movement of a screen/mesh. FIG. 7D shows a gravity pulling system 66 where one end of a screen/mesh is fixed and a single load is applied to the other end of the screen mesh. FIG. 7E shows a system 68 which relies on the use of self adhesive tape to fix the screen/mesh to the frame before tensioning. The screen/mesh is attached to the frame at one end, and then the frame is rotated into position to allow attachment of the tensioned screen/mesh. FIG. 7F shows a system 70 similar to the system 68 except the support roller is lowered to bring the tensioned screen/mesh into contact with the frame.

Figure 8A:
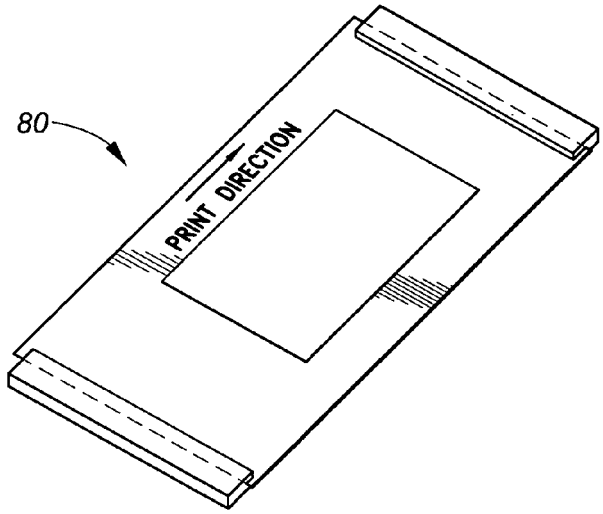
FIGS. 8A, 8B, and 8C illustrate print direction tensioning techniques according to the present invention.
Figure 8C:
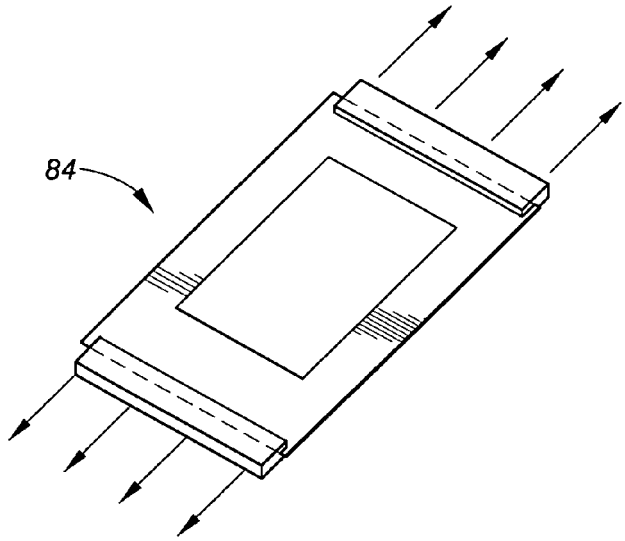
Figure 8B:
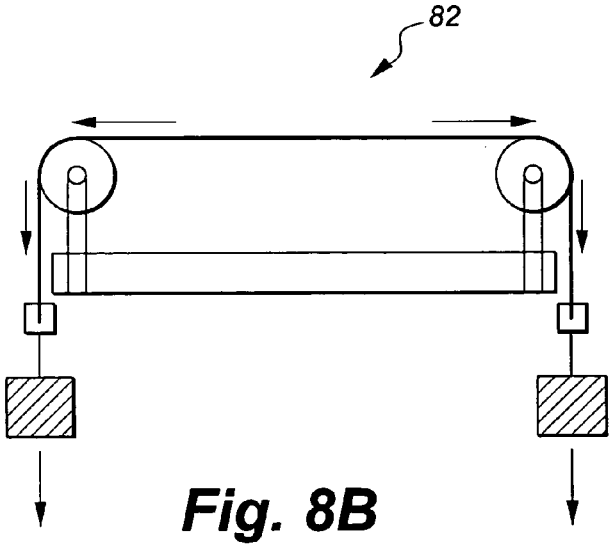
Figure 9A:
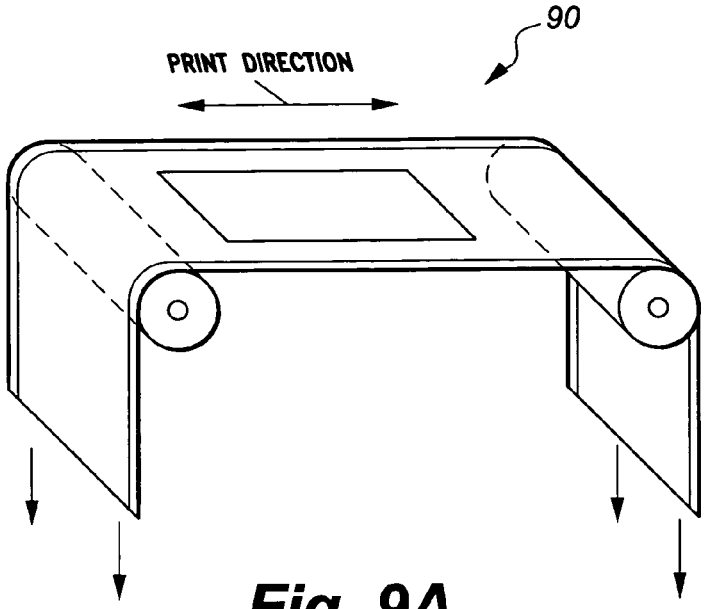
FIGS. 9A, 9B, 9C, and 9D are stretching steps according to the present invention.
Figure 9B:
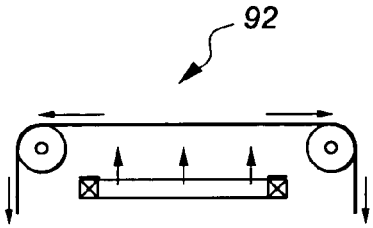
Figure 9C:
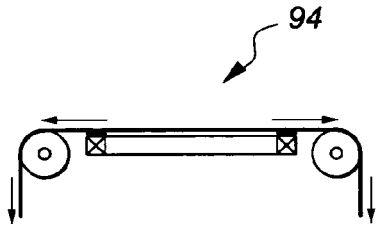
Figure 9D:
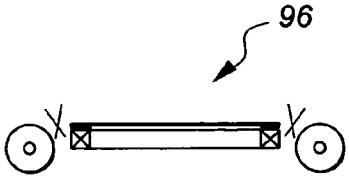

FIGS. 8A, 8B, and 8C show print direction tensioning techniques of the present invention. The screen/mesh is initially precut to the correct width of an outer frame and the ends of the screen/mesh are clamped 80. The screen/mesh may be stretched by using equal loads applied to both ends 82, or stretching each end outwards 84. FIG. 9A shows tension forces being applied to the ends of a screen/mesh 90. FIG. 9B shows a frame being moved into contact with a strained screen/mesh 92. FIG. 9C shows tension forces being applied to the screen/mesh while the frame is attached to the screen/mesh 94. FIG. 9D shows the screen/mesh after being trimmed once the tension forces are removed from the ends of the screen/mesh 96.

Figure 10:
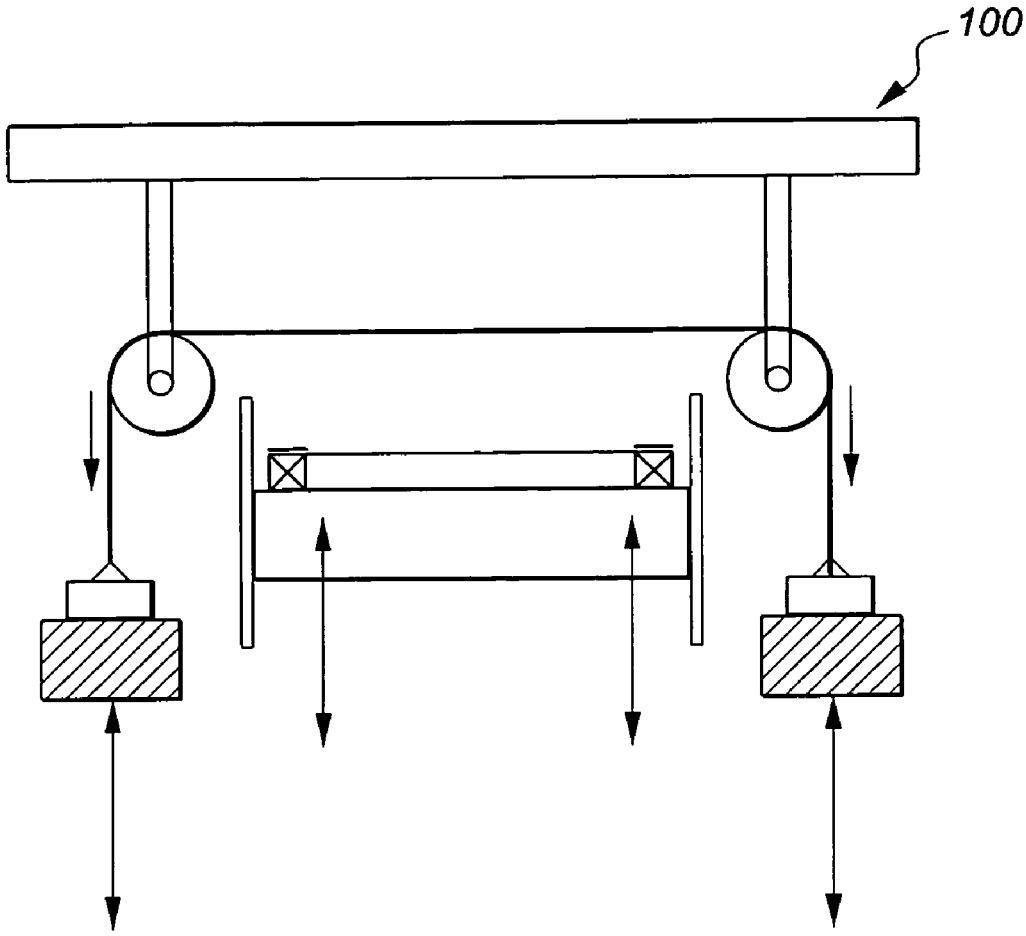
FIG. 10 is a frame system using adhesive tape according to the present invention.
Figure 11A:
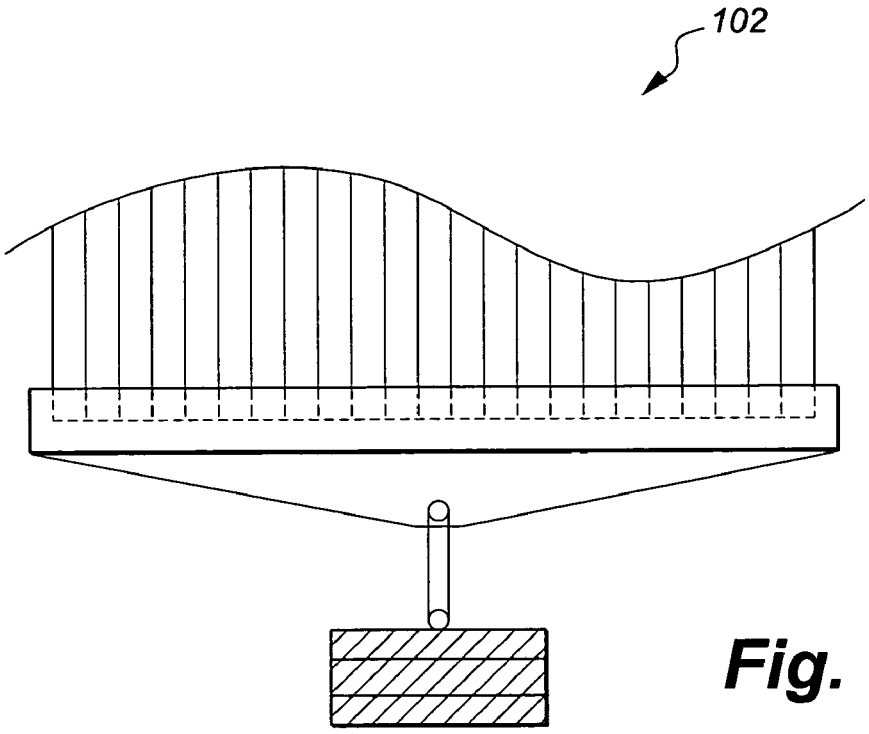
FIGS. 11A and 11B illustrate a rotatable fixed weight according to the present invention.
Figure 11B:
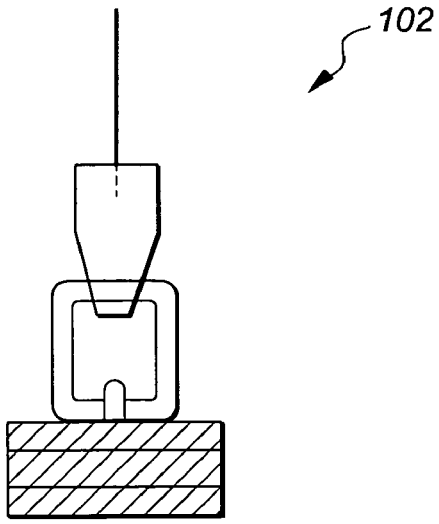

FIG. 10 shows an adhesive system 100 where the frame support is attached to a screen/mesh via adhesive. Initially, fixed masses are applied to the ends of the screen/mesh and cause a controlled tension force to be applied to the screen/mesh. The frame support is then raised to bring adhesive on the top of the frame into contact with the screen/mesh. Mass supports are then raised for each of the fixed masses to remove the tension forces applied to the screen/mesh. The excess screen/mesh is then cut/trimmed from the screen/mesh outside of the frame. The frame is then removed with the screen/mesh tensioned in the print direction. FIGS. 11A and 11B illustrate via 102 how the fixed weights may be attached with rotatable clamps to ensure free motion of the weights in all directions when they are attached and apply tension forces to the screen/mesh.

Figure 12A:
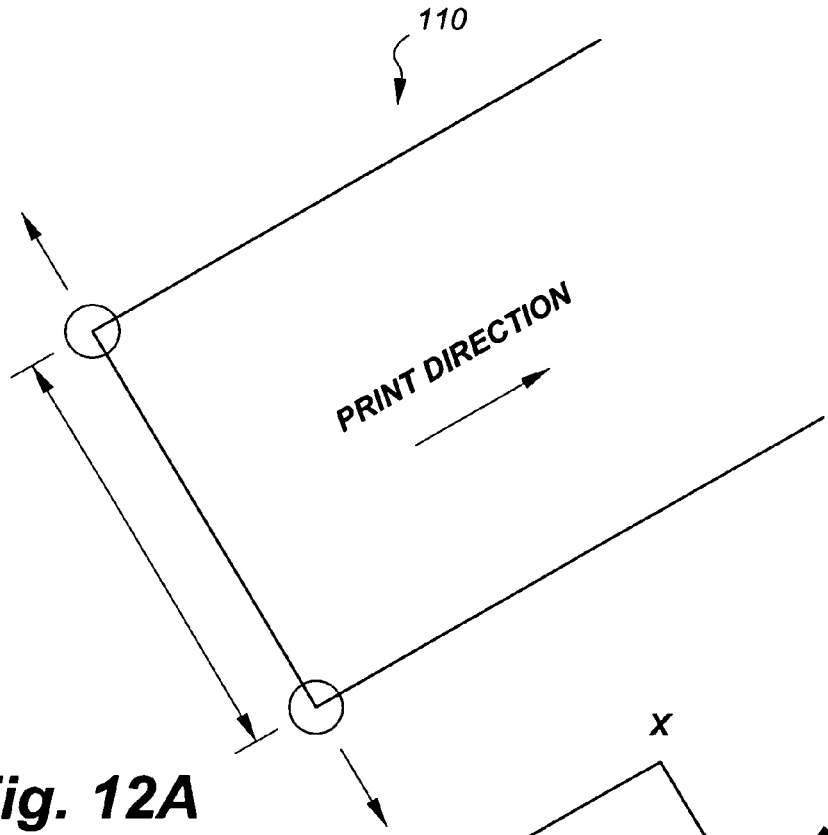
FIGS. 12A, 12B, and 12C are lateral pre-stretching techniques according to the present invention.
Figure 12B:
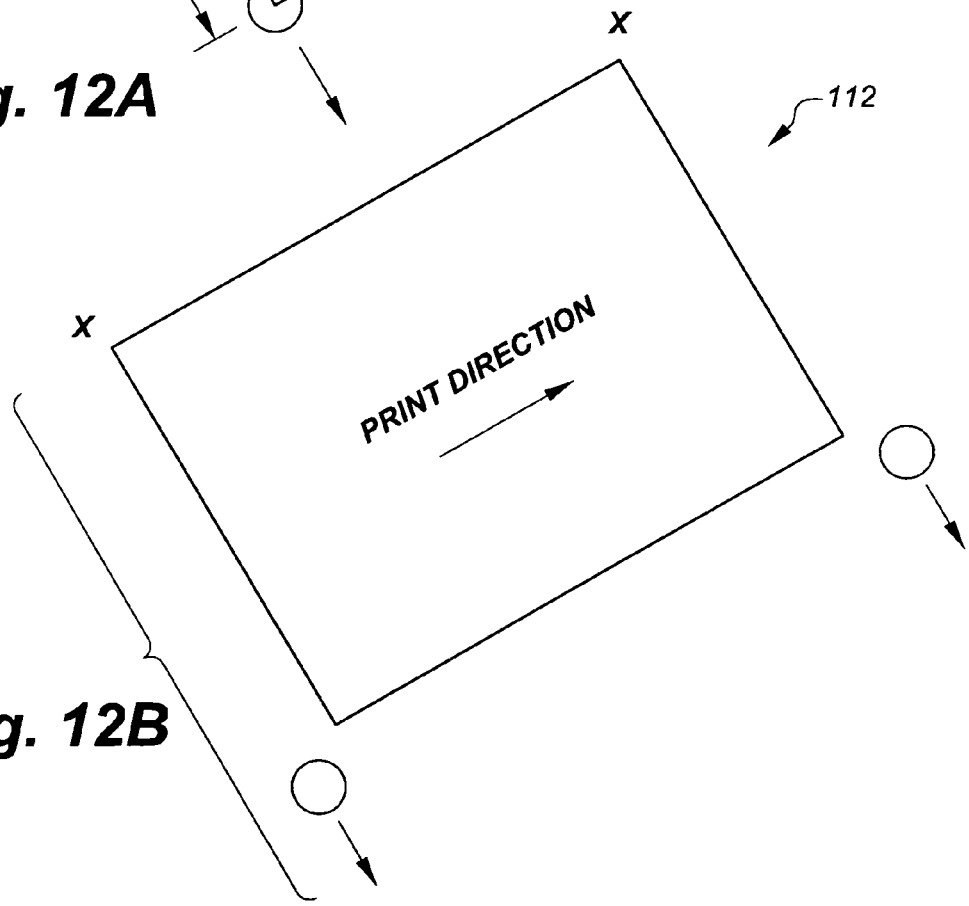
Figure 12C:
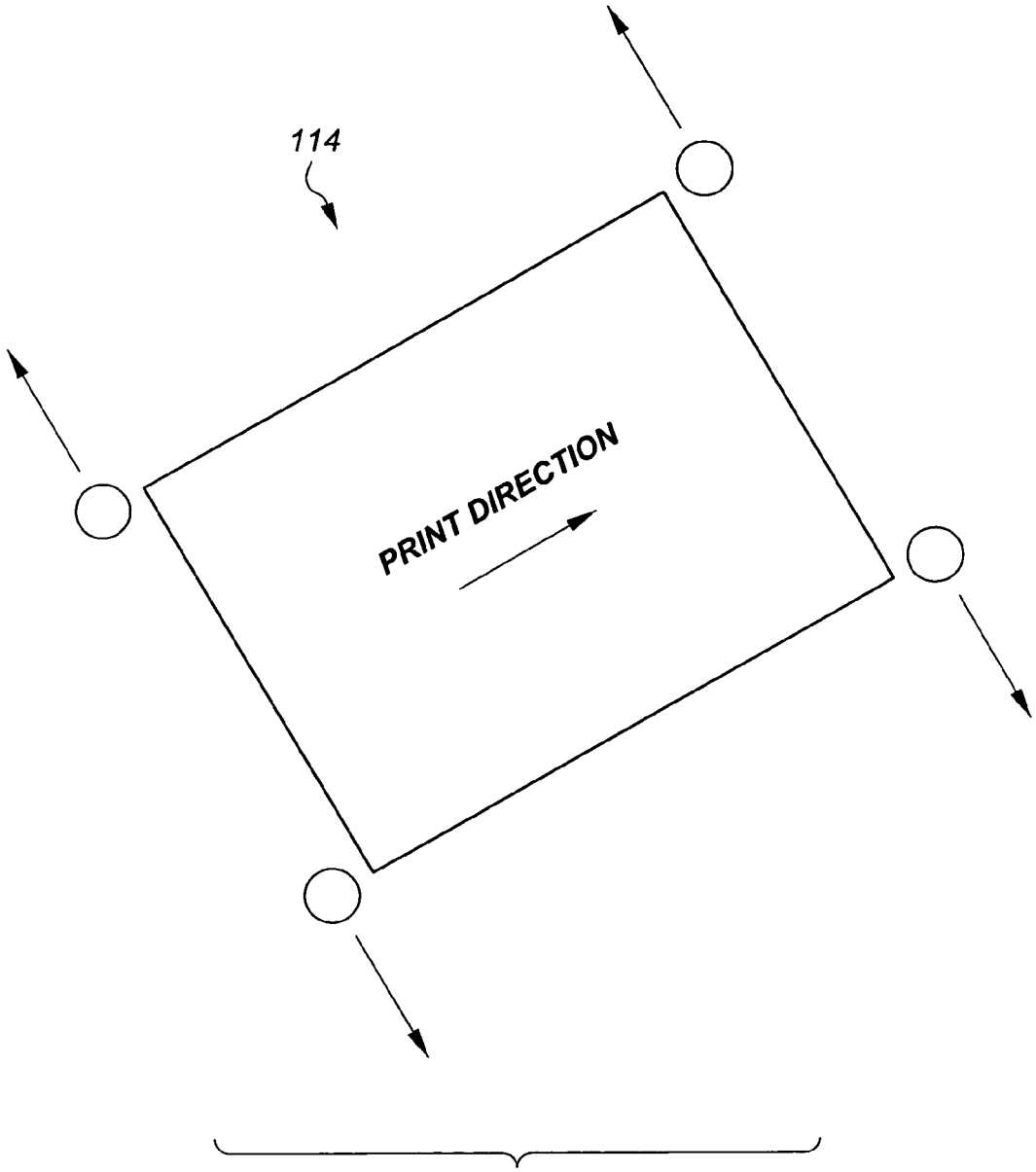

Referring to FIGS. 12A–12C, screen/mesh lateral pre-stretching for print direction tensioning begins by clamping an area of the screen/mesh and applying a low level lateral tension to the screen/mesh 110. Once low level lateral tension is applied, the screen/mesh is clamped for print direction tensioning. Once clamped the lateral tension has little effect and can be released. Alternatively, two side corners of the screen/mesh may be fixed and tension may be applied in one direction 112. Alternatively, tension may be applied equally to both sides of the screen/mesh 114.

Figure 13:
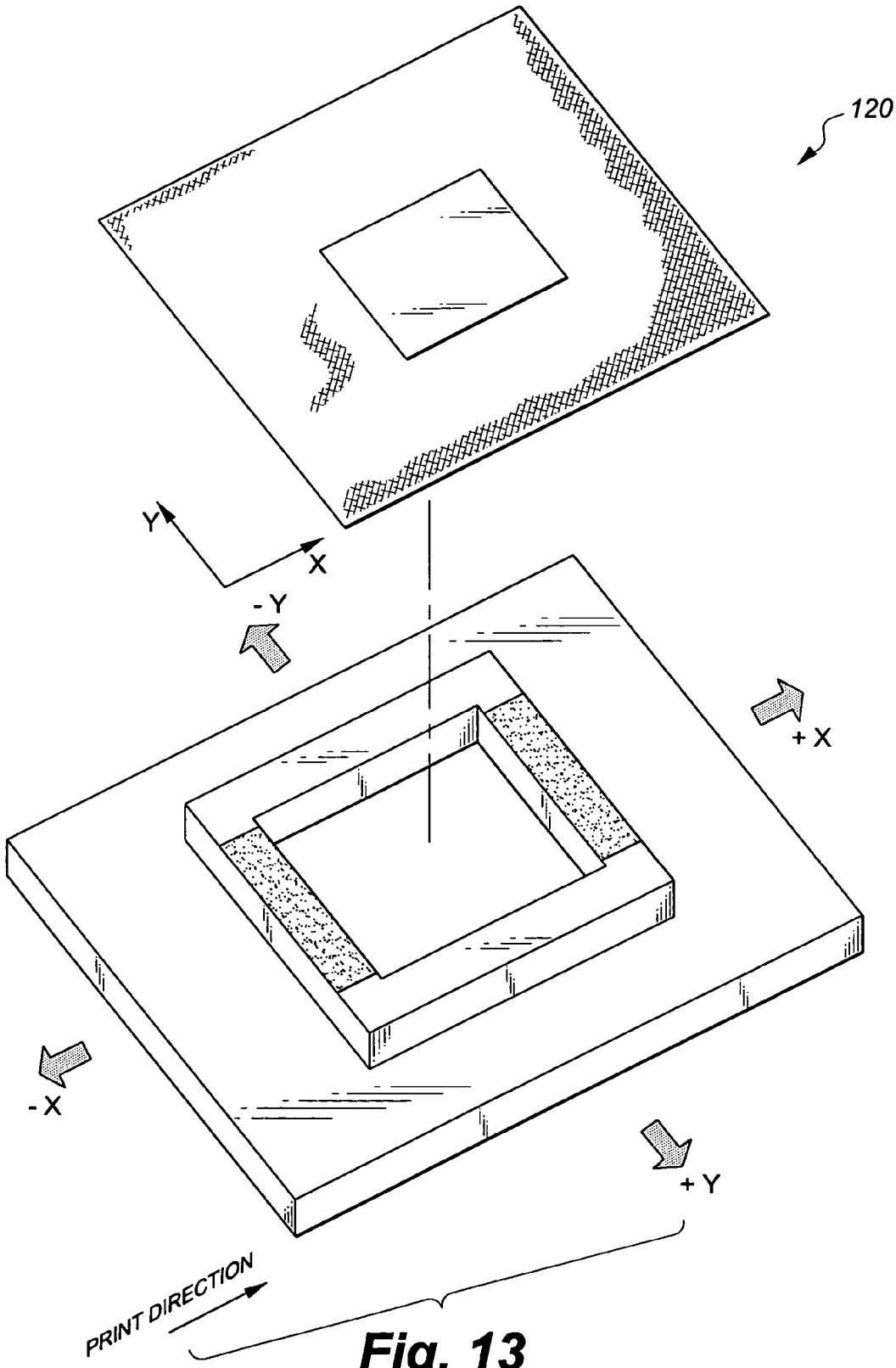
FIG. 13 is a frame adjustable in x and y directions according to the present invention.

Outer frame positioning for individual screen/mesh samples is shown in FIG. 13. For introduction of individual screen/mesh samples, particularly with pre-coated stencil areas, the position of the screen/mesh to the frame is critical to print consistency. The print direction stretching controls the correct positioning of the screen/mesh. Existing systems do not require the frame to move in the print or lateral directions for screen/mesh positioning. The apparatus according to the present invention may include an x-y adjustable table below the frame to allow repositioning of the frame relative to the stretched screen/mesh 120. The x-y table may be manually, mechanically, and/or automatically activated. With an x-y table the frame may be moved relative to the screen/mesh in x and y directions. Once the frame is positioned it may be raised into contact with the screen/mesh.

Figure 14A:
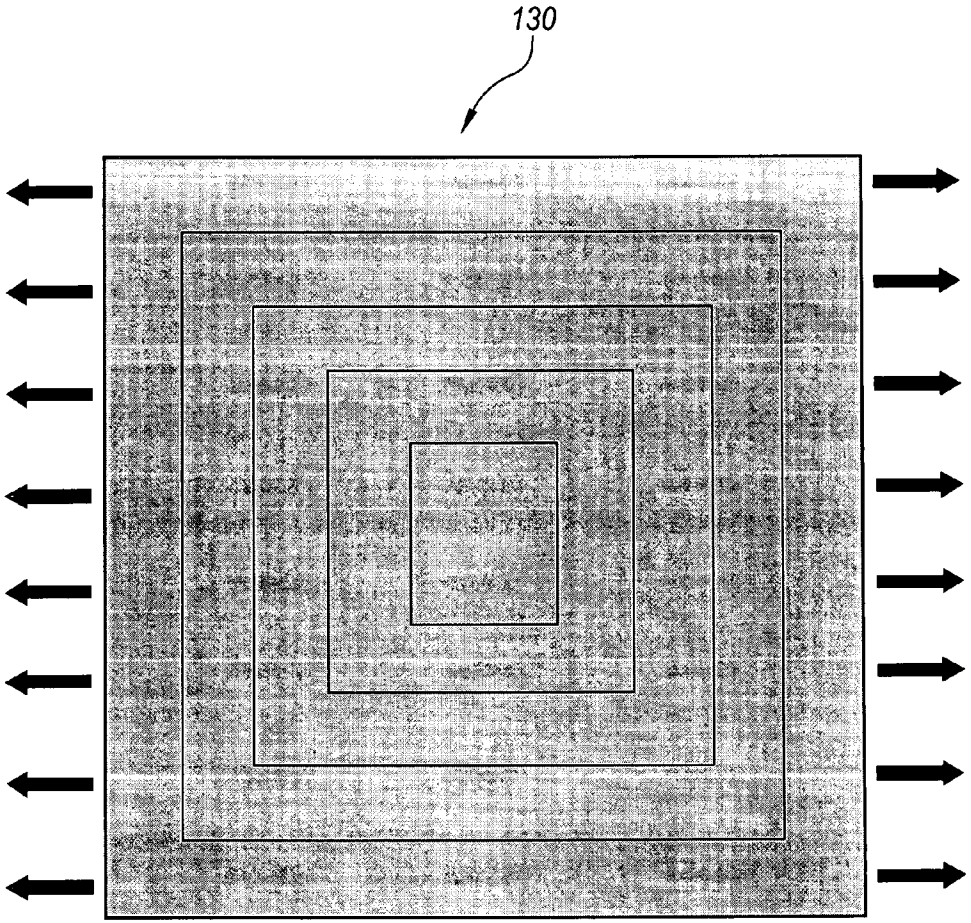
FIG. 14A illustrates a screen/mesh and print direction forces to be applied before print direction stretching according to the present invention.
Figure 14B:
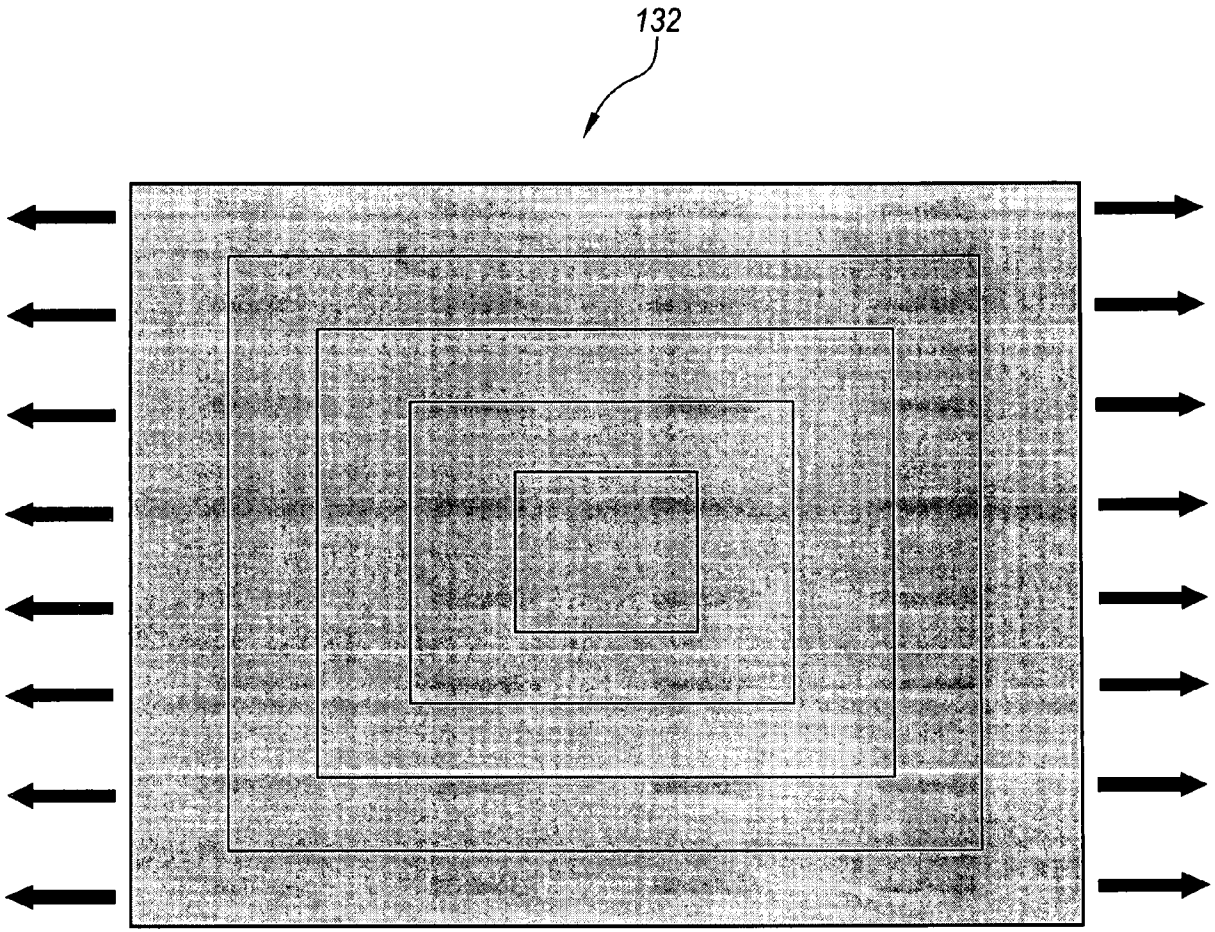
FIG. 14B illustrates a screen/mesh and print direction forces present after print direction stretching according to the present invention.

Print direction forces to be applied on a screen/mesh 130 before print direction stretching are shown in FIG. 14A, and print direction forces present after print direction stretching on a screen/mesh 132 are shown in FIG. 14B.

Figure 15A:
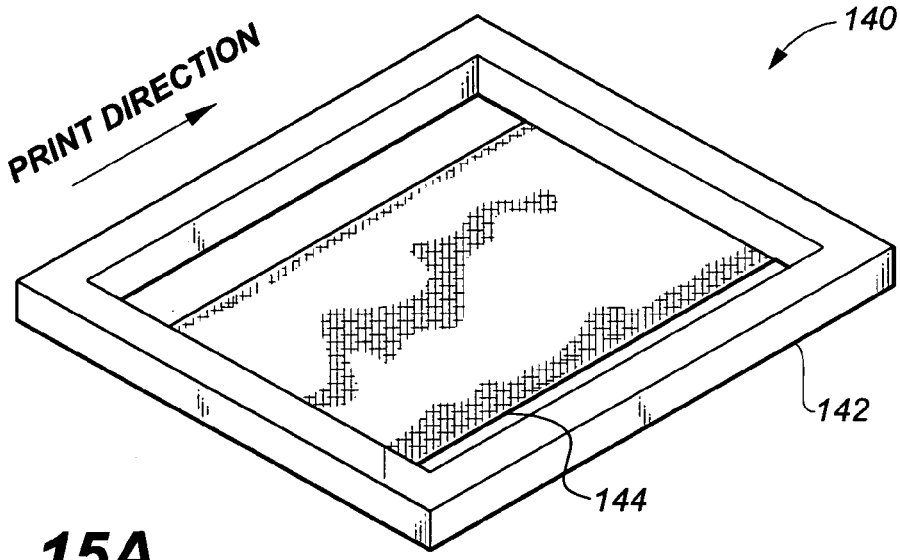
FIG. 15A is a screen/mesh tensioned and fixed to an outer frame in the print direction according to the present invention.
Figure 15B:
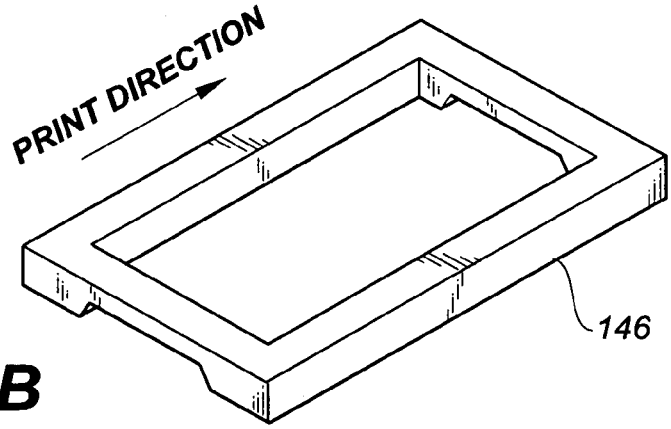
FIG. 15B is a fixed inner frame according to the present invention.
Figure 15C:
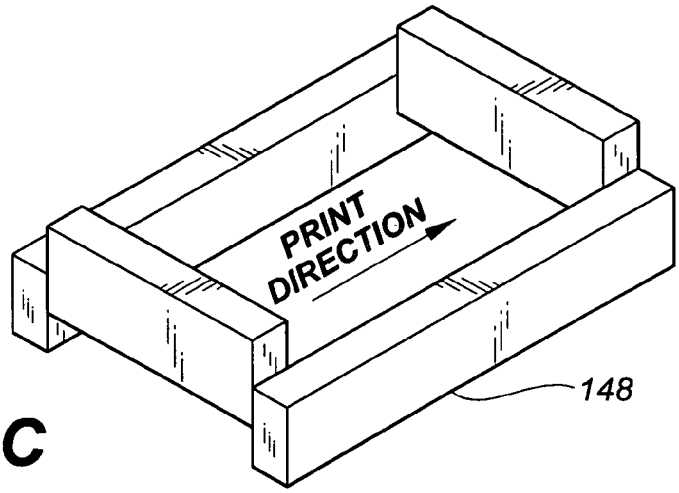
FIG. 15C is a four piece inner frame according to the present invention.

Various options for the dual frame system of the present invention are shown in FIGS. 15A–15C. In each case ends of the screen/mesh 144 are initially tensioned and fixed to a frame along the print direction. This is carefully done to eliminate any wrinkles in the screen/mesh and ensure a flat even surface. An image 140 of ends of a tensioned screen/mesh 144 fixed to an outer frame 142 is shown in FIG. 15A. The fixed inner frame of the dual frame system may be attached to apply no additional lateral tension but to support the print area, and supply the ink barriers. As shown in FIG. 15B, the ends of the inner frame 146 may include a raised level to minimize print direction contact. As shown in FIG. 15C, a simple push fit four piece inner frame assembly 148 may be used for applying a set lateral displacement to apply fixed lateral tension forces. The side pieces are then fixed to the screen/mesh and are locked in position until they are removed from the screen/mesh. The end pieces may be fixed in top position, then pushed down into a locked position forcing the side pieces out a fixed distance.

Figure 16A:
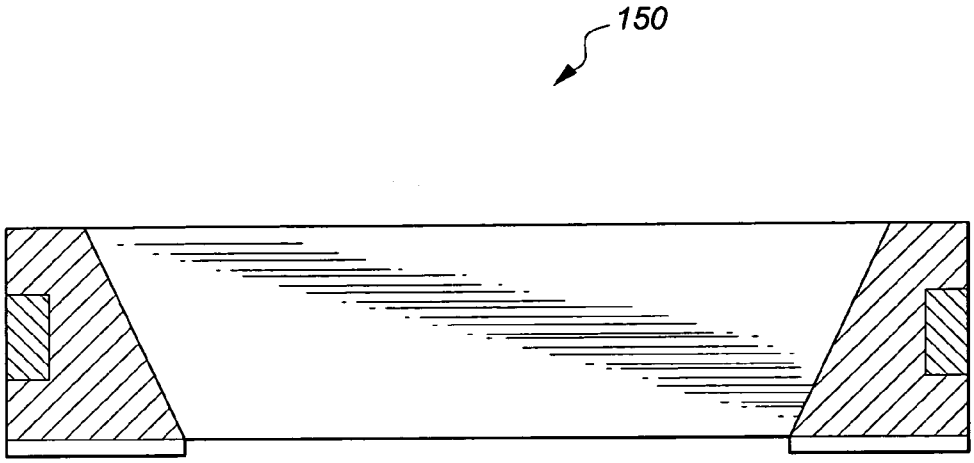
FIGS. 16A and 16B are side views of ink/fluid barriers according to the present invention.
Figure 16B:
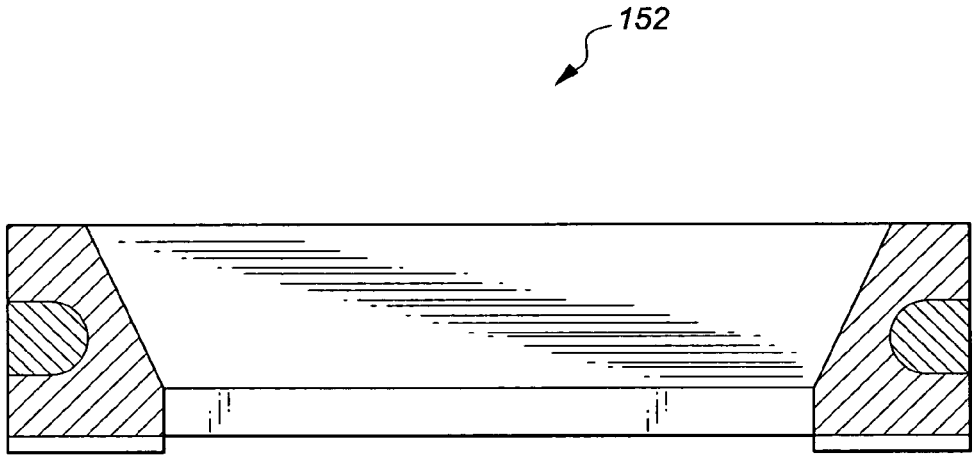
Figure 17:
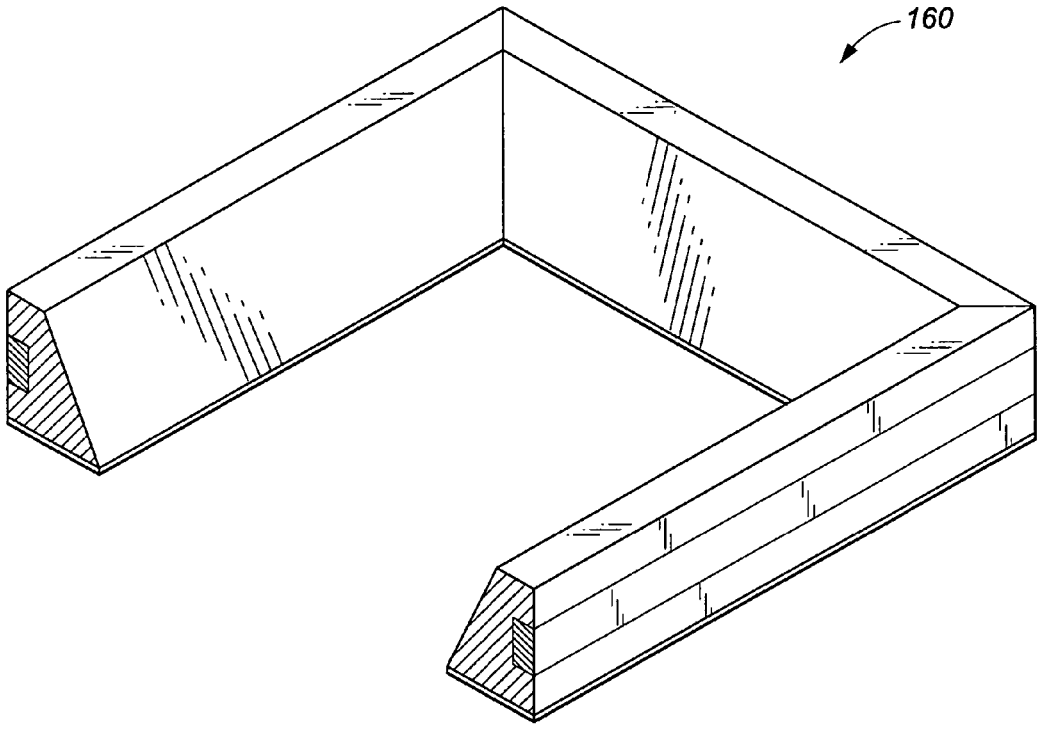
FIG. 17 is a perspective view of ink/fluid barriers according to the present invention.
Figure 18:
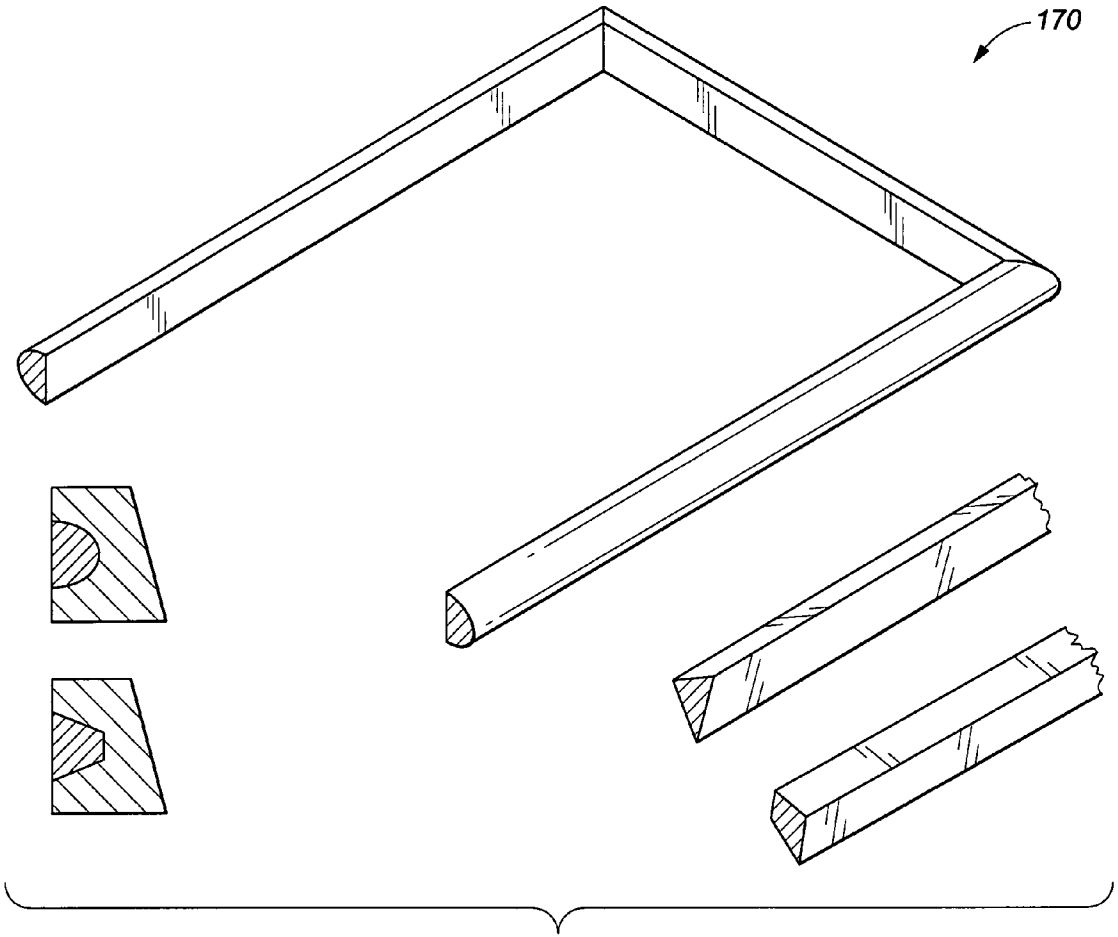
FIG. 18 illustrates ink/fluid barriers according to the present invention.
Figure 19:
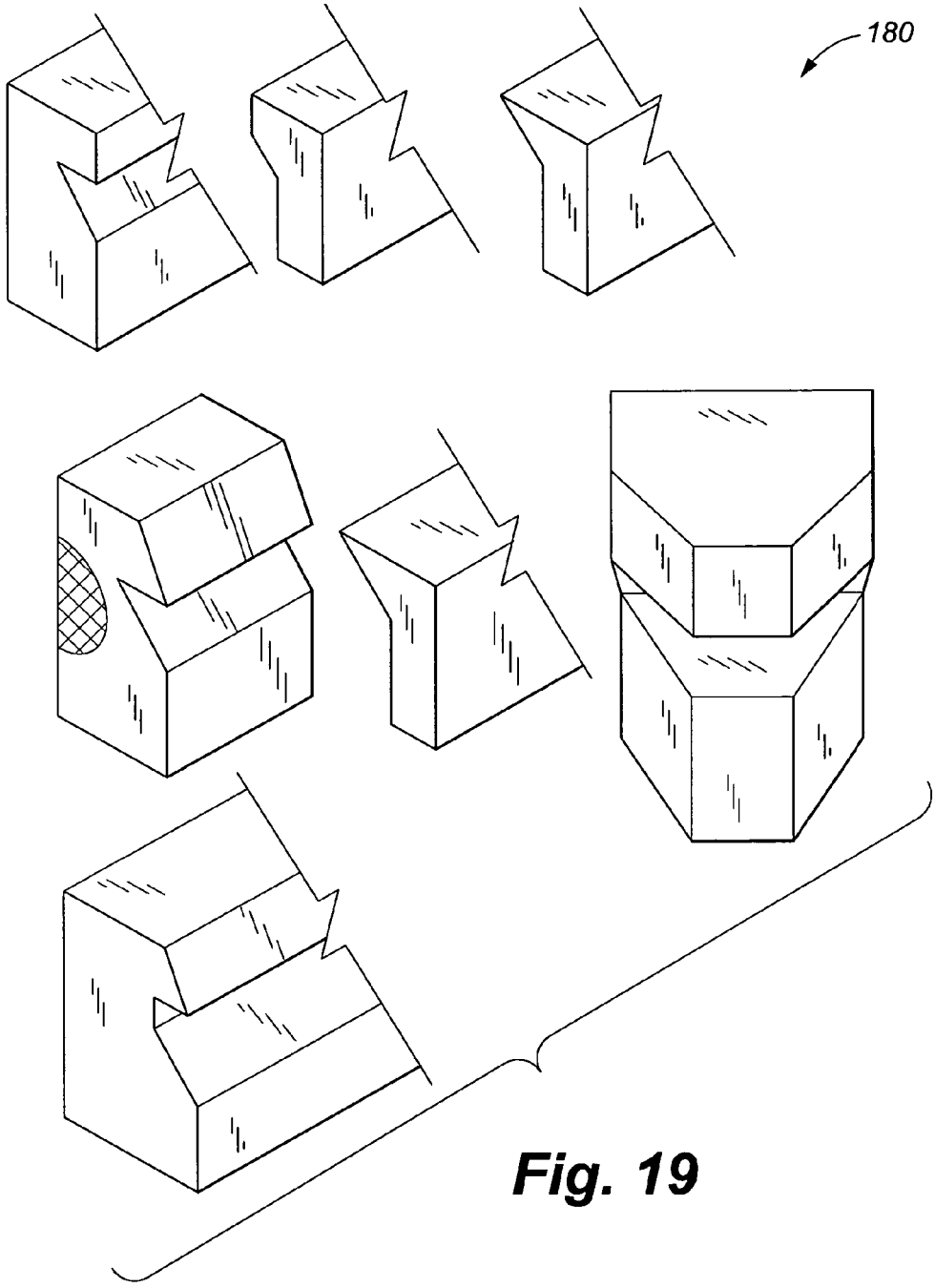
FIG. 19 illustrates interlocking connector pieces for a multi-piece frame system according to the present invention.
Figure 20A:
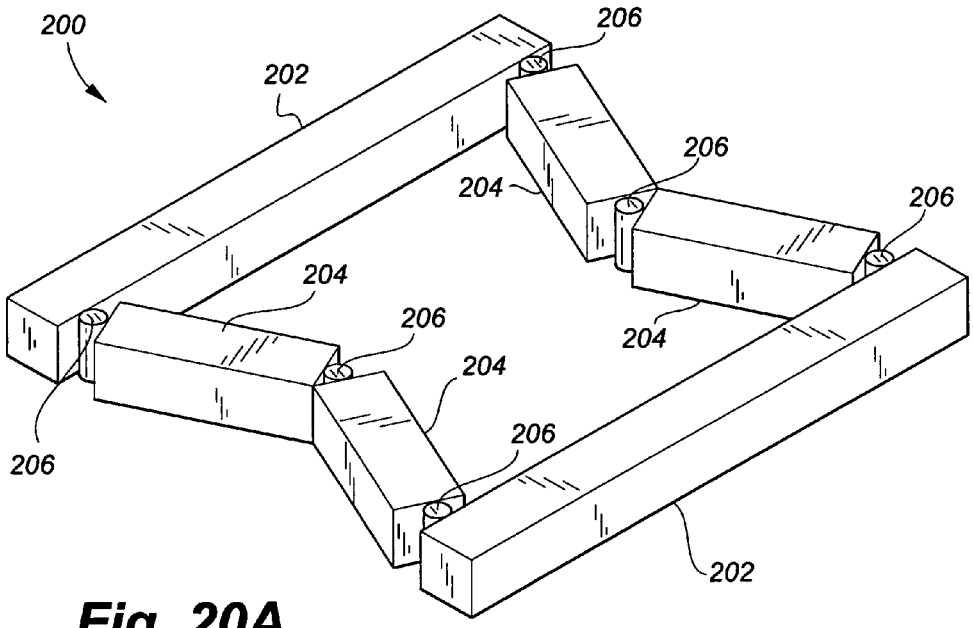
FIGS. 20A and 20B are a multi-piece system according to the present invention.
Figure 20B:
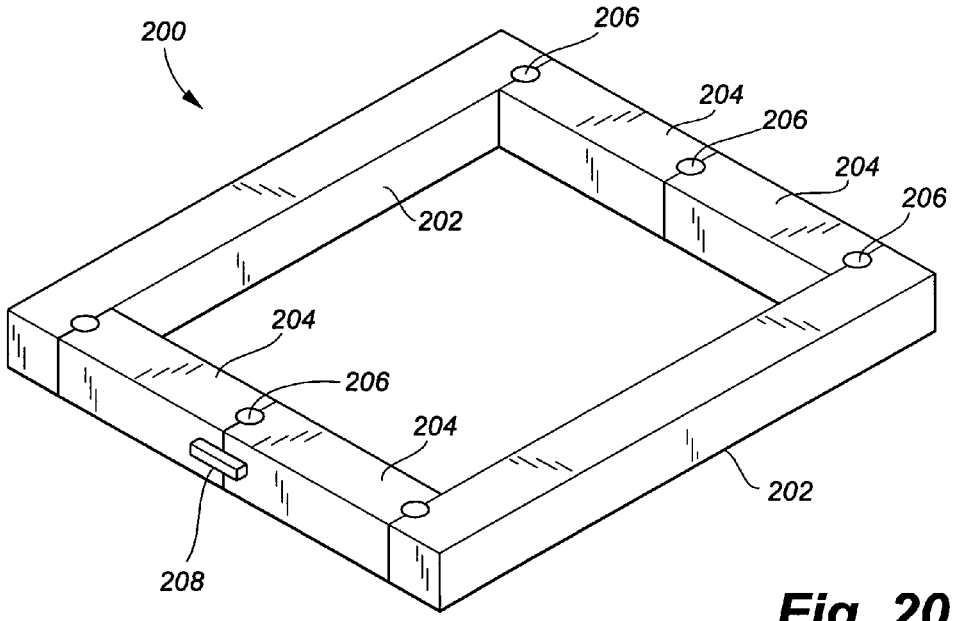

FIGS. 16A and 16B are respective side views 150 and 152 of ink/fluid barriers according to the present invention. FIG. 17 is a perspective view 160 of ink/fluid barriers according to the present invention. FIG. 18 illustrates ink/fluid barriers 170 according to the present invention. FIG. 19 illustrates interlocking connector pieces 180 for a multi-piece frame system according to the present invention.

Referring to FIGS. 20A–30, another dual frame system option is a multi-piece frame with additional ink barriers. This arrangement is the most flexible dual frame system because it allows multiple frame sizes by using interchangeable side and end pieces. Different lateral tension settings may be applied by changing the difference in the length of the lateral supports compared to the end pieces. Interchangeable ink barriers allow the frame to be set to suit the press and the desires of the user. The multi-piece frame may include multiple side pieces, multiple corner pieces, and multiple end pieces. The pieces of the multi-piece frame may be configured in an interlocking format for a fixed frame. Interlocking enables a variety of frame sizes and formats to be easily produced. The multi-piece frame maximizes flexibility of frame dimensions and minimizes costs for frame production through standard sized component joints.

Multi-piece frame 200 has end frames 204 hinged to apply tension forces. The side frames pieces 202 are attached to a screen/mesh and the end frame pieces 204 are expanded via their hinges 206 to apply tension laterally before being locked with a locking device 208.

Figure 28:
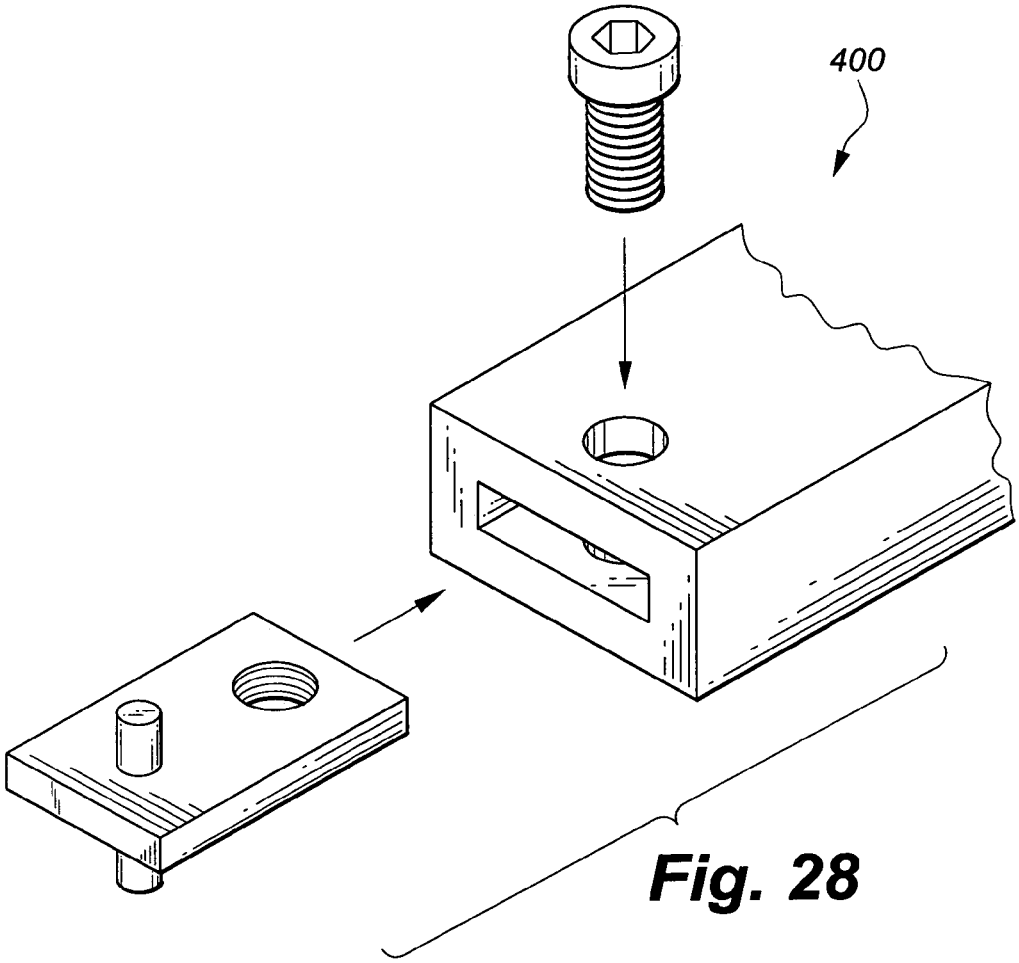
FIG. 28 is a top perspective view of a lock piece according to the present invention.
Figure 29:
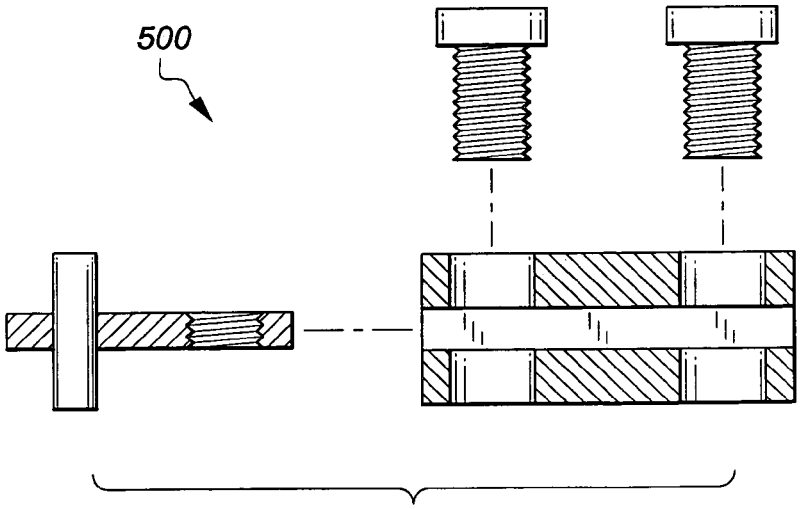
FIG. 29 is a cross sectional side view of a lock piece according to the present invention.
Figure 30:
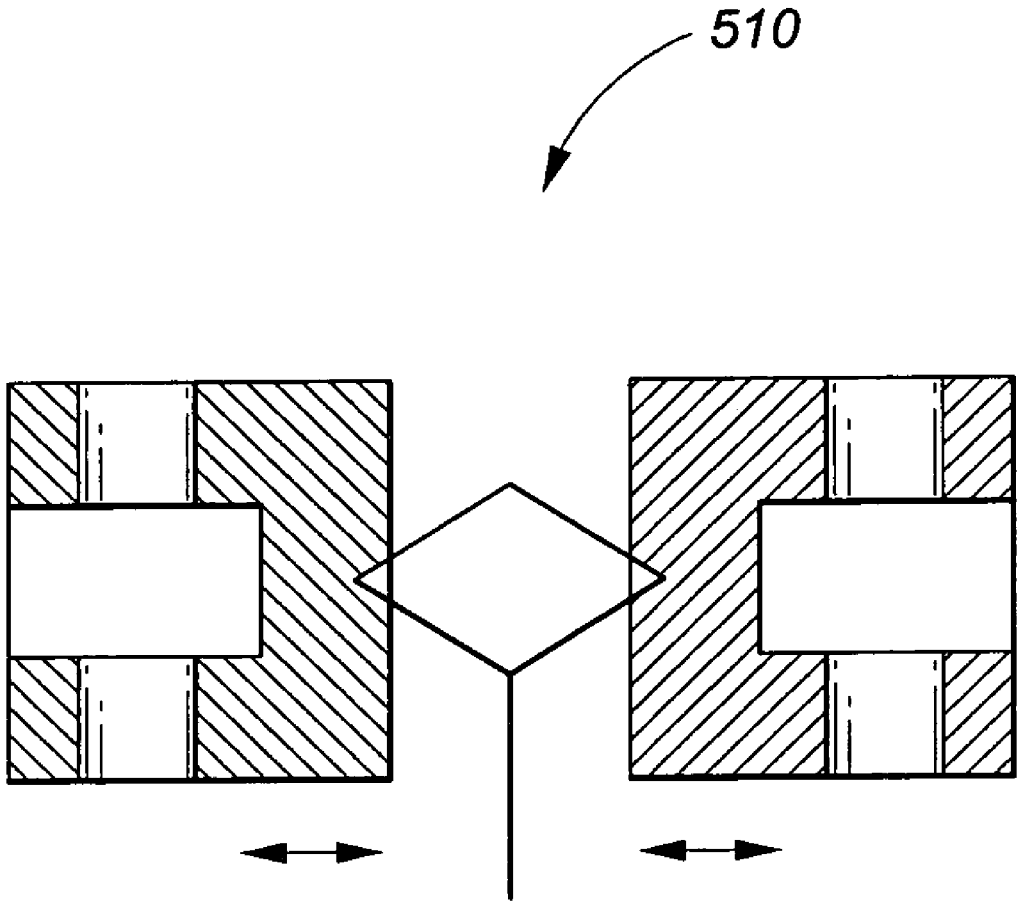
FIG. 30 is a cross sectional side view of a mechanism allowing the forcing apart of pieces of an interlocking frame according to the present invention.

Several options are available for interlocking frame side pieces (see FIGS. 19–30). The frame side pieces may be profiled to include ink barriers. They may be multi-piece to allow different frame sizes, and locks may be integral to the side pieces or be separate inserts. A mechanism 510 enabling the side pieces of the multi-part frame to be forced apart in fixed displacements for controlled lateral tension is shown in FIG. 30.

Figure 21:
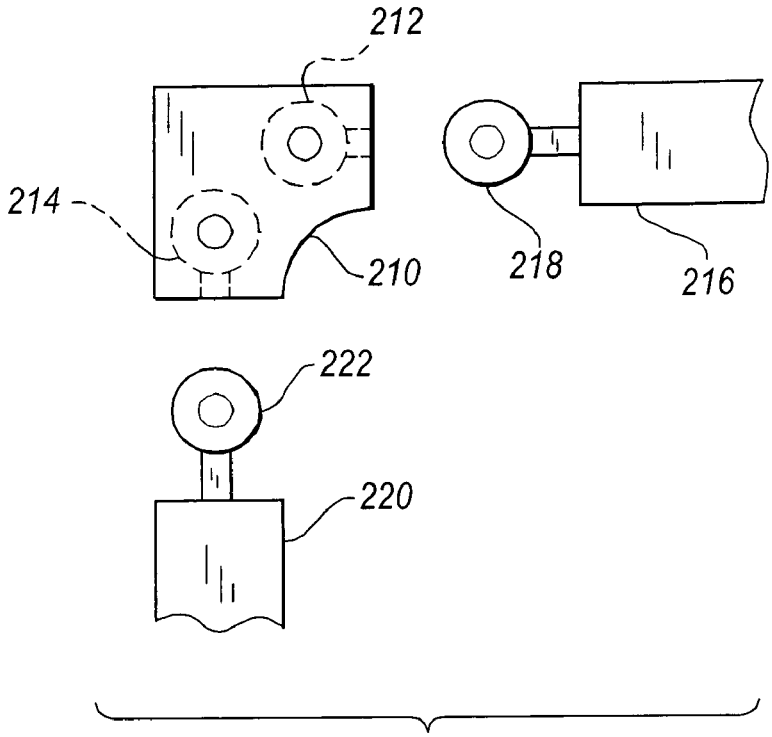
FIG. 21 illustrates an end piece, a corner piece, and a side piece of an interlocking fixed frame according to the present invention.
Figure 22:
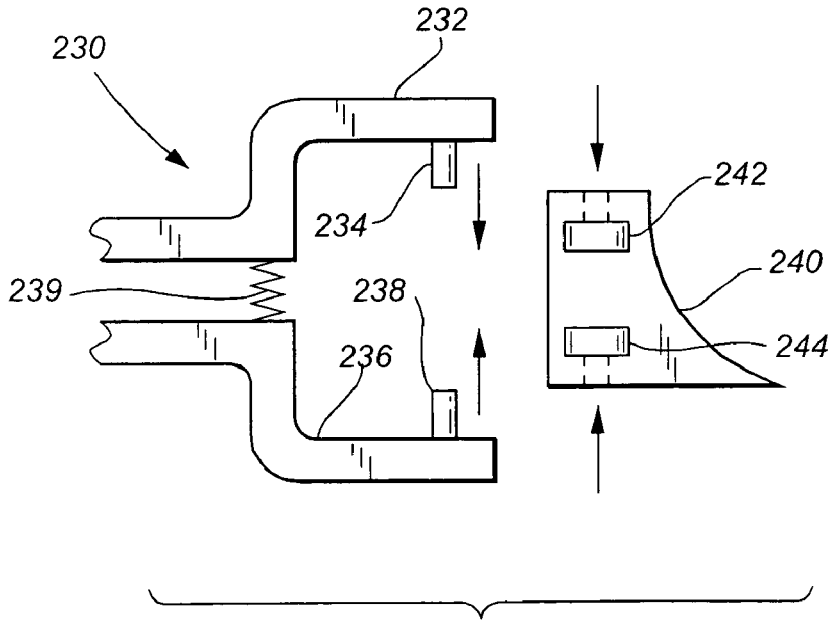
FIG. 22 is a tool with two prongs that allows simultaneous removal of two lugs from a corner piece of an interlocking fixed frame according to the present invention.
Figure 23A:
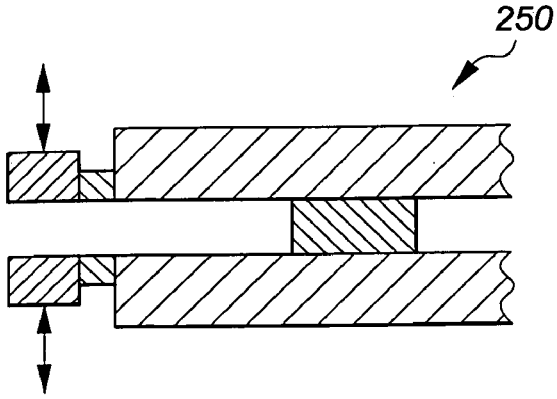
FIG. 23A is a cross sectional view of a side piece of an interlocking frame according to the present invention.
Figure 23B:
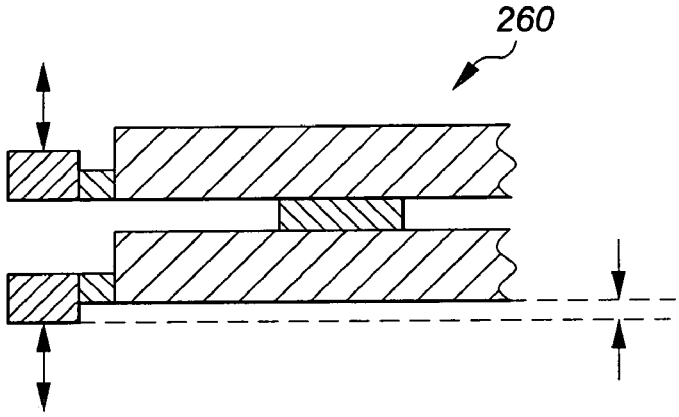
FIG. 23B is a cross sectional view of an end piece of an interlocking frame according to the present invention.
Figure 24:
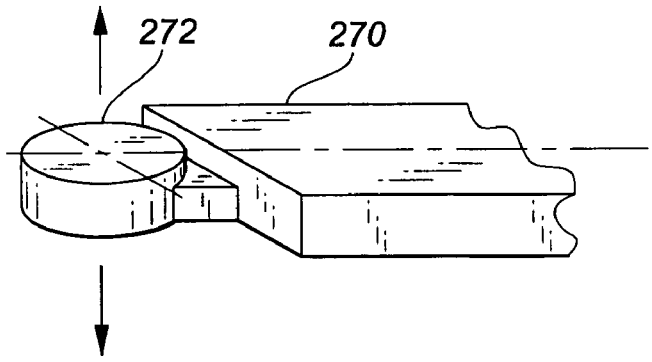
FIG. 24 is a perspective view of a side piece of an interlocking frame according to the present invention.
Figure 25A:
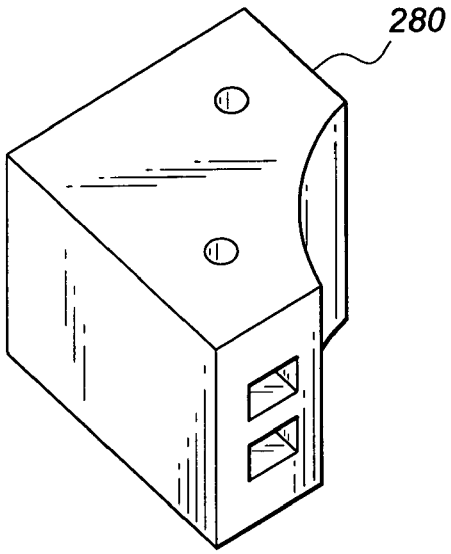
FIG. 25A is a perspective view of a corner piece of an interlocking frame according to the present invention.
Figure 25B:
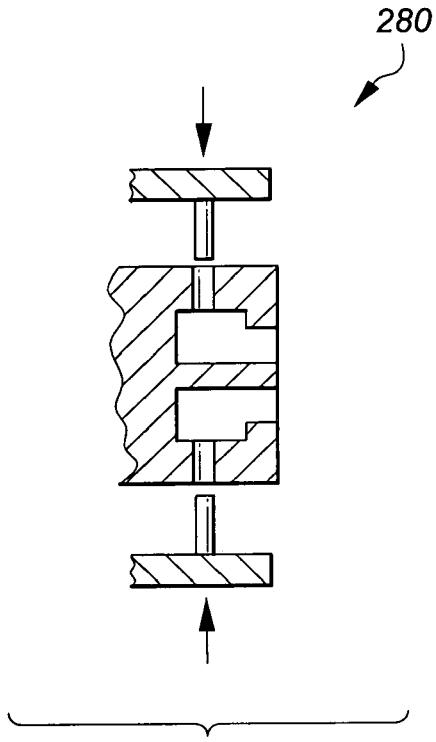
FIG. 25B is cross sectional view of a corner piece of an interlocking frame according to the present invention.
Figure 25C:
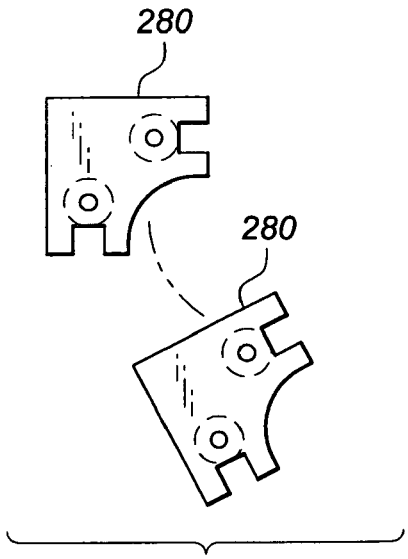
FIG. 25C is a top view of a flexible corner piece of an interlocking frame according to the present invention.
Figure 26A:
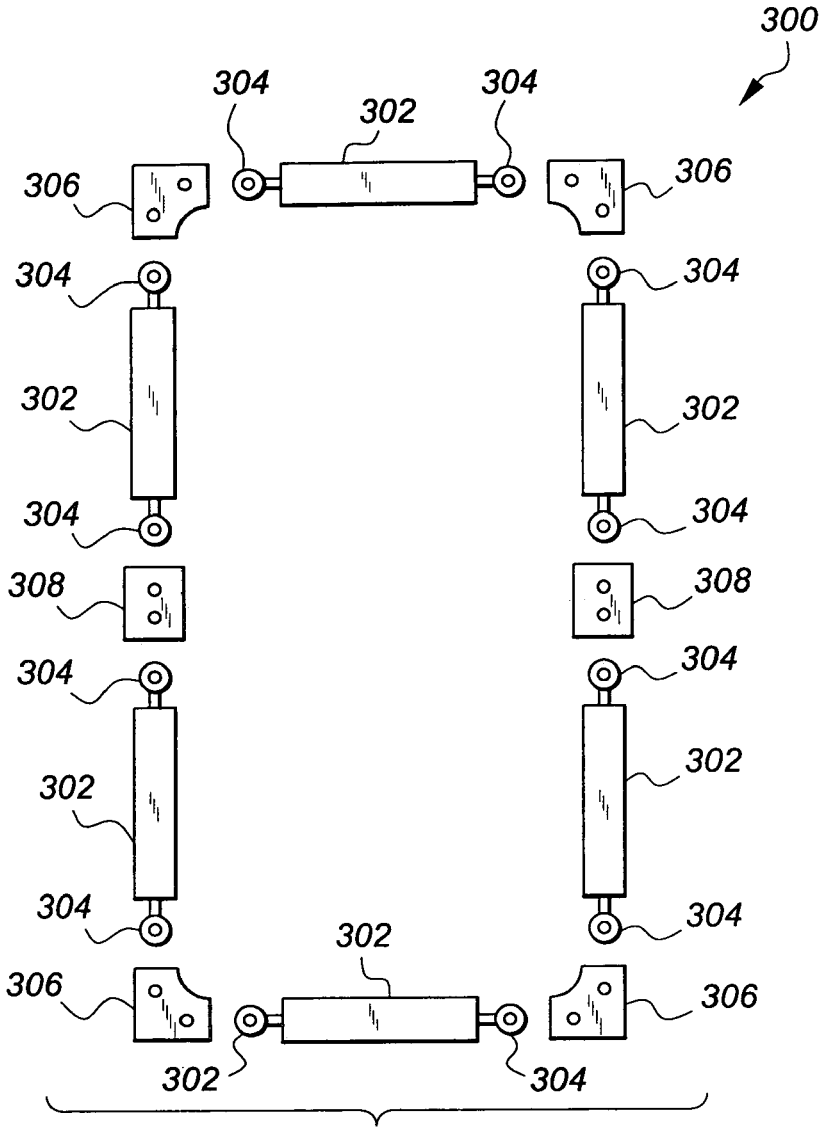
FIG. 26A is a top view of pieces of an interlocking frame according to the present invention.
Figure 26B:
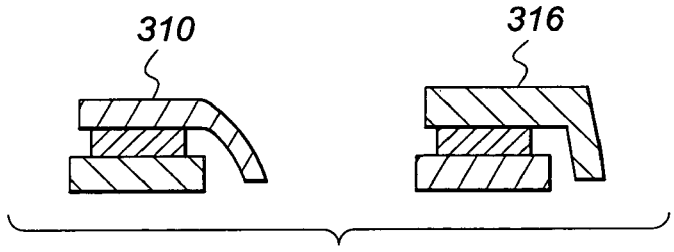
FIG. 26B are cross sectional side views of ink barriers according to the present invention.
Figure 26C:
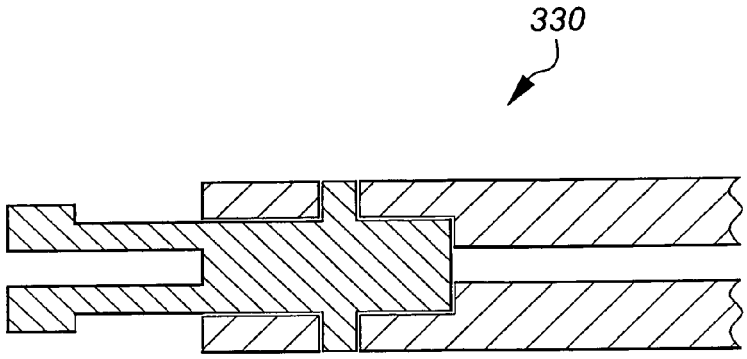
FIG. 26C is a cross sectional side view of an end piece with an interconnecting piece according to the present invention.
Figure 26D:
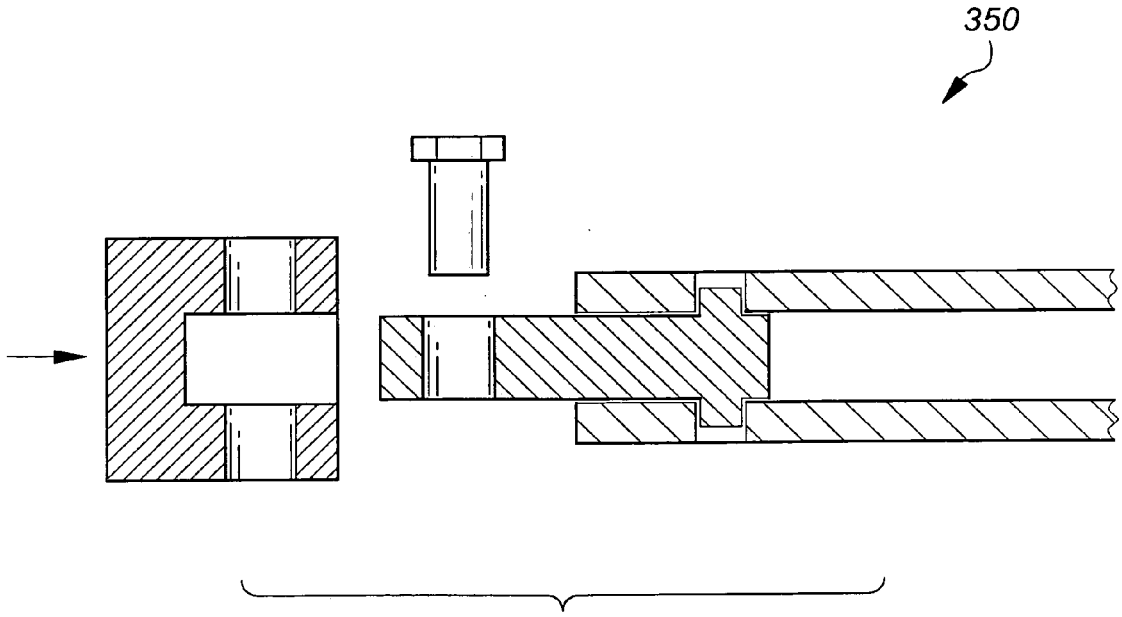
FIG. 26D is a cross sectional side view of an end piece with an interconnecting piece according to the present invention.
Figure 27A:
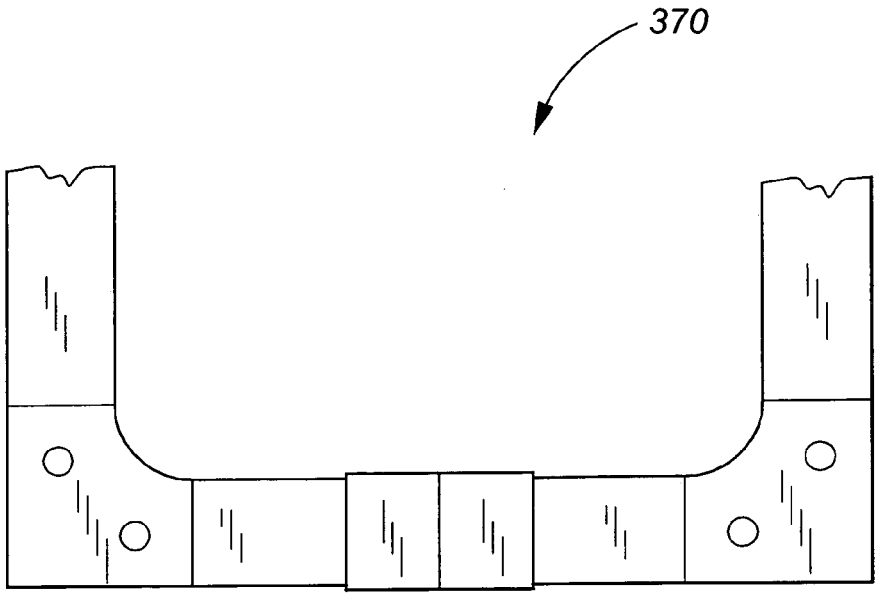
FIG. 27A is a top view of end frame pieces before displacement of the end frame pieces according to the present invention.
Figure 27B:
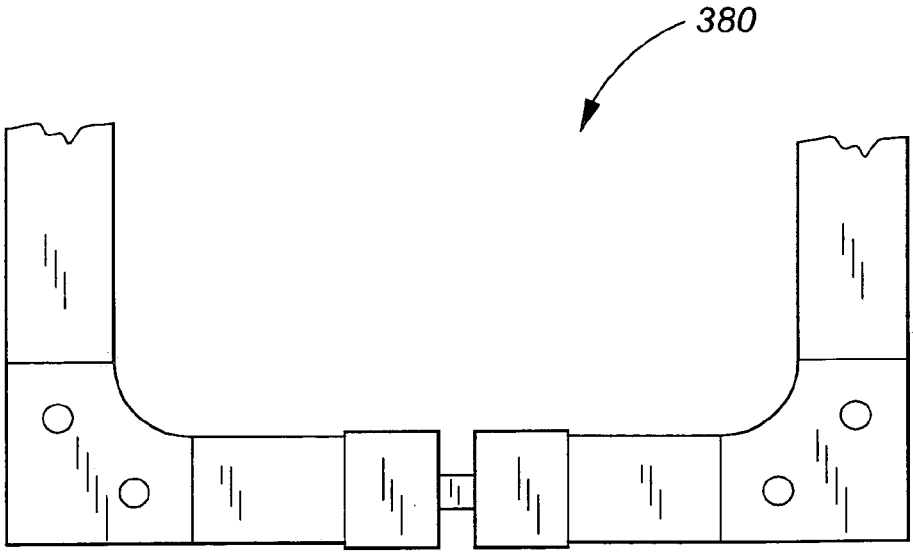
FIG. 27B is a top view of end frame pieces after displacement of the end frame pieces according to the present invention.

A corner piece 210, a side piece 216, and an end piece 220 of an interlocking fixed inner frame according to the present invention are shown in FIG. 21. The corner piece 210 has a recess 212 configured to receive an interconnecting element 218 of the side piece 216. The corner piece 210 also has a recess 214 configured to receive an interconnecting element 222 of the end piece 220. A tool 230 is shown in FIG. 22 that has two prongs 234, 238 on respective arms 232 and 236 interconnected by a spring 239. The two prongs 234 and 238 enable the simultaneous removal of two lugs 242, 244 from a corner piece 240 of an interlocking fixed frame. FIG. 23A shows a cross sectional view of a side piece 250 of an interlocking frame. FIG. 23B shows a cross sectional view of an end piece 260 of an interlocking inner frame. FIG. 24 shows an end of a side piece 270 including an interlocking member 272. FIG. 25A shows a corner piece 280 of an interlocking frame. FIG. 25B shows a cross sectional view of the corner piece 280. FIG. 25C shows how the corner piece 280 may be configured in the form of a flexible corner piece. FIG. 26A shows a multi-piece inner frame with side and end pieces 302, interlocking members 304, corner pieces 306, and straight locking pieces 308. Views of ink barriers 310, 316 are shown in FIG. 26B. FIG. 26C shows a cross sectional side view 330 of a side piece with an interconnecting piece. FIG. 26D shows a cross sectional side view 350 of an end piece with an interconnecting piece. FIG. 27A shows a top view 370 of end frame pieces before displacement of the end frame pieces. FIG. 27B shows a top view 380 of end frame pieces after displacement of the end frame pieces. FIG. 28 shows a top perspective view 400 of a lock piece according to the present invention. FIG. 29 shows a cross sectional side view 500 of a lock piece. FIG. 30 shows a cross sectional side view 510 of a mechanism allowing the forcing apart of pieces of an interlocking frame.

Figure 31A:
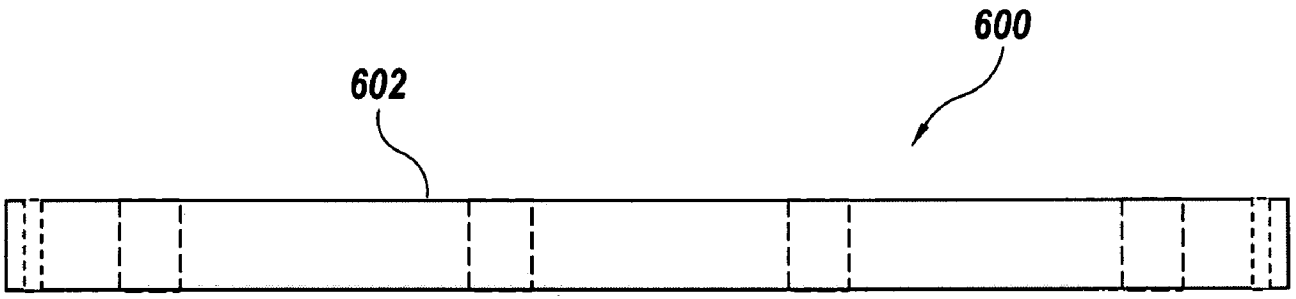
FIG. 31A is a top view of an inner frame side piece according to the present invention.
Figure 31B:
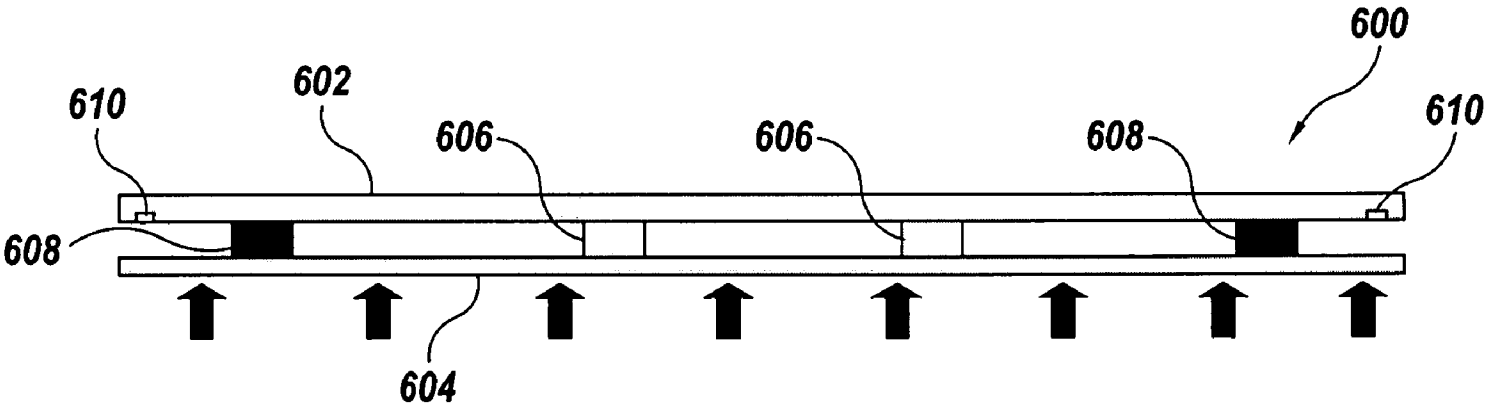
FIG. 31B is a side view of an inner frame side piece according to the present invention.
Figure 32A:
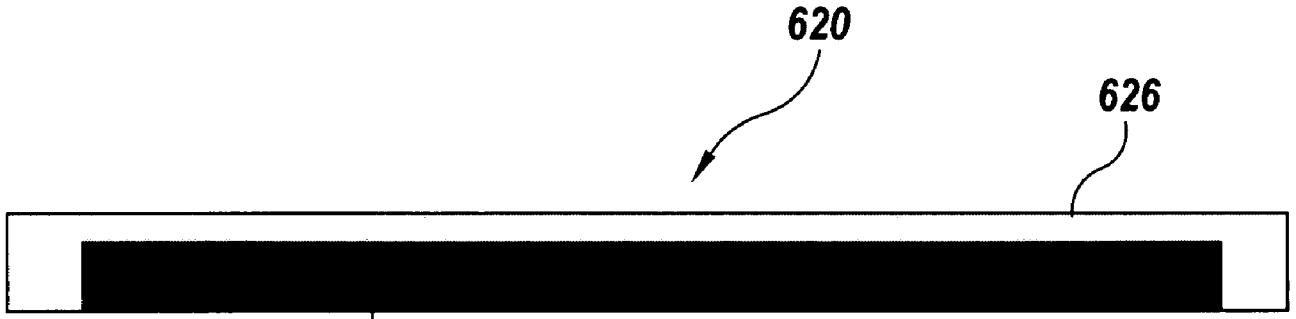
FIG. 32A is a top view of an inner frame cross support according to the present invention.
Figure 32B:
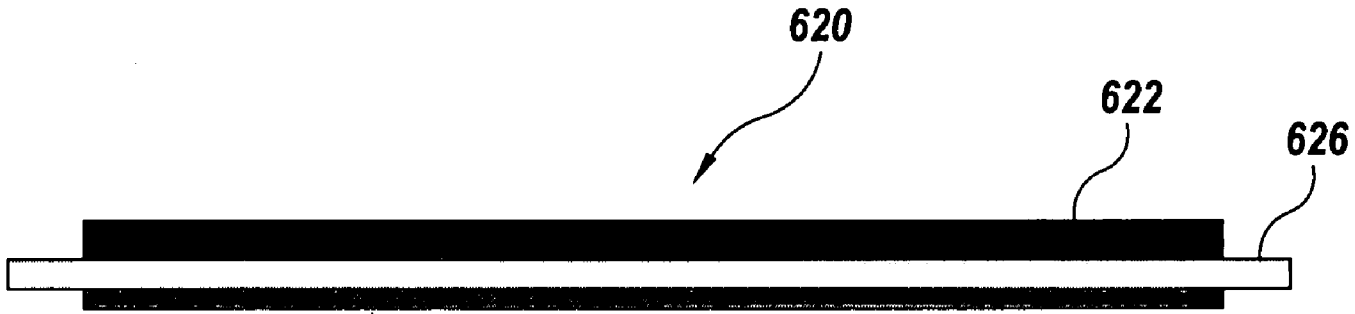
FIG. 32B is a side view of an inner frame cross support according to the present invention.
Figure 33A:
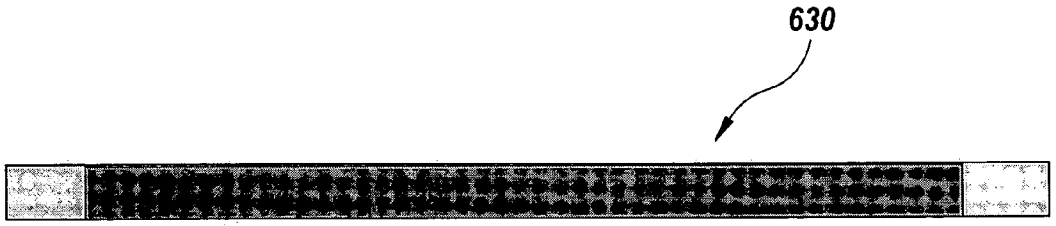
FIG. 33A is a top view of an inner frame end piece according to the present invention.
Figure 33B:
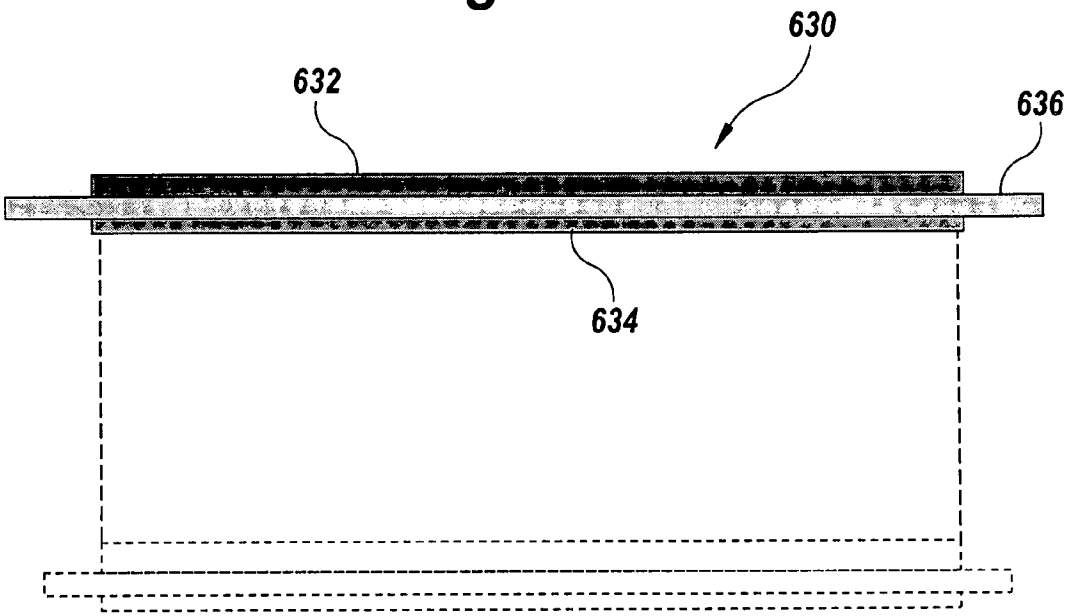
FIG. 33B is a side view of an inner frame end piece according to the present invention.
Figure 34A:
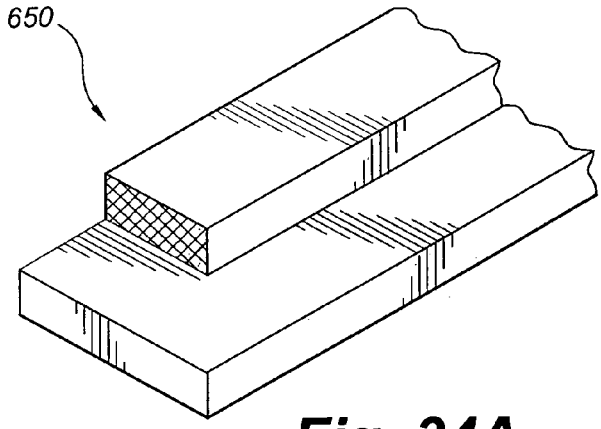
FIG. 34A is a top perspective view of an end of an inner frame according to the present invention.
Figure 34B:
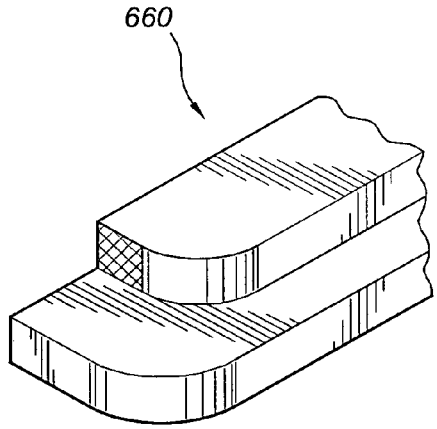
FIG. 34B is a top perspective view of an end of an inner frame according to the present invention.
Figure 34C:
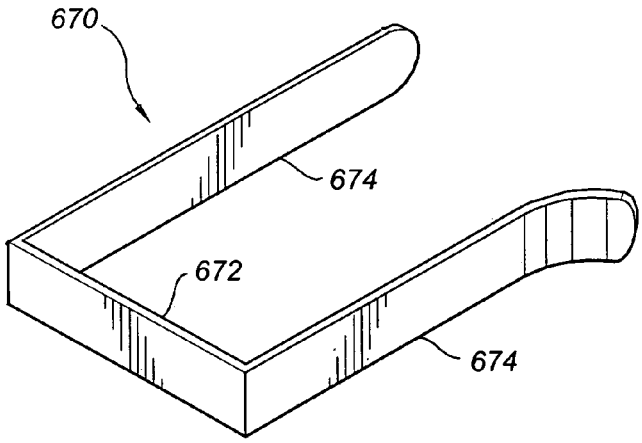
FIG. 34C is a top perspective view of an inner frame support clip according to the present invention.

An inner frame side piece 600 is shown in FIGS. 31A and 31B. The inner frame side piece 600 includes a top bar 602, a bottom bar 604, center supports 606, end supports 608, and locking notches 610 in the top bar 602. An inner frame cross support 620 is shown in FIGS. 32A and 32B. The inner frame cross support 620 includes a top plate 622, a bottom plate 624, and main plate 626. An inner frame end piece 630 is shown in FIGS. 33A and 33B. The inner frame end piece 630 includes a top plate 632, a bottom plate 634, and a main plate 636. Modifications to the inner frame cross section 650, 660 are shown in FIGS. 34A and 34B. An inner frame assembly support clip 670 is shown in FIG. 34C. The clip 670 includes an end portion 672 with longitudinally extending portions 674. The support clip 670 fits around the inner frame cross supports and the inner frame side piece end support. One may be included in each of the four corners and ensures that the side pieces and cross supports are held firmly together.

Figure 35:
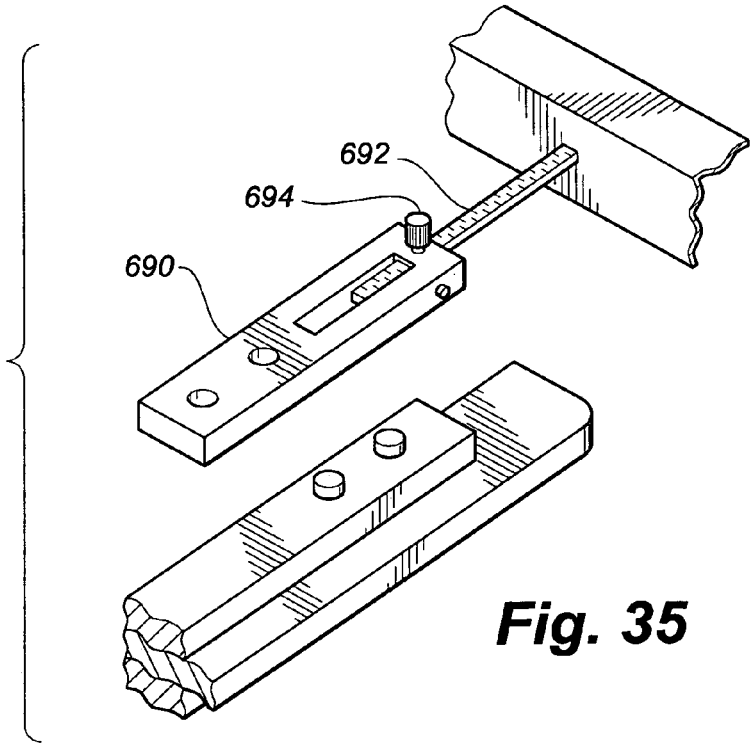
FIG. 35 is a top perspective view of inner frame parallel guide components according to the present invention.
Figure 36:
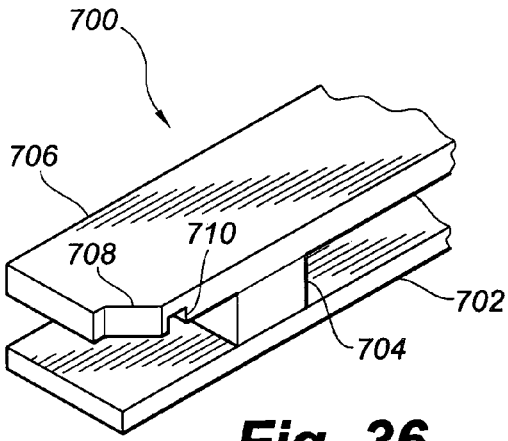
FIG. 36 is a top perspective view of an inner frame side piece with a profiled end according to the present invention.
Figure 37:
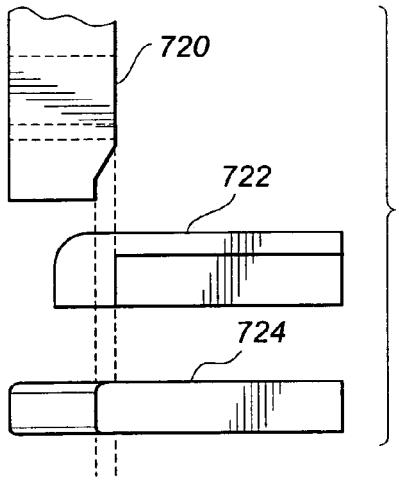
FIG. 37 illustrates a side piece with a profiled corner section that matches an end piece and a cross support according to the present invention.

An inner frame parallel guide concept is shown in FIG. 35. The inner frame parallel guide 690 has locking pin holes to provide positive placement, a width guide with optional dimension markers 692, and a locking screw 694 for setting the width guide 692 setting. The locking screw may alternatively be positioned on the side of the parallel guide 690. An inner frame side piece 700 with a profiled end is shown in FIG. 36. The profiled end 700 includes a bottom bar 702, an end support 704, a top bar 706, and a profiled corner 708 in the top bar to assist end piece fitting. The top bar 706 also includes a locking notch 710. The end piece may be fitted into the side recess to provide lateral tension perpendicular to the print direction. The forces required to pull a profiled end into a tension applying position depend on the frame size and the screen/mesh properties. For small frames, the forces may be applied manually. For larger frame sizes, mechanical and/or pneumatic assistance may be required. FIG. 37 shows a side piece 720 with a profiled corner section that matches an end piece 724 and a cross support 722.

Figures 38A, 38B:
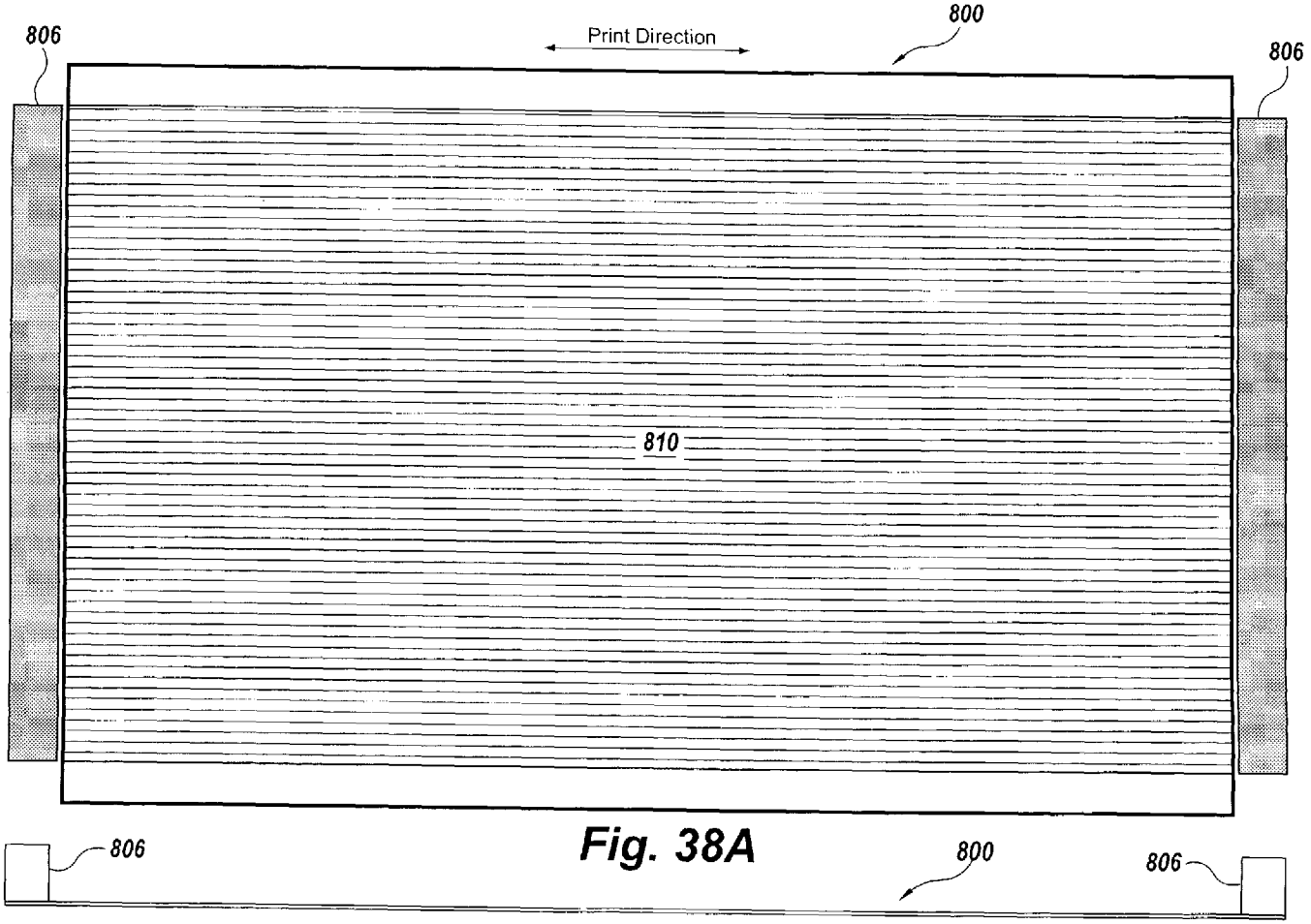
FIGS. 38A and 38B are top and side views of a screen/mesh following print direction stretching according to the present invention.
Figure 39A:
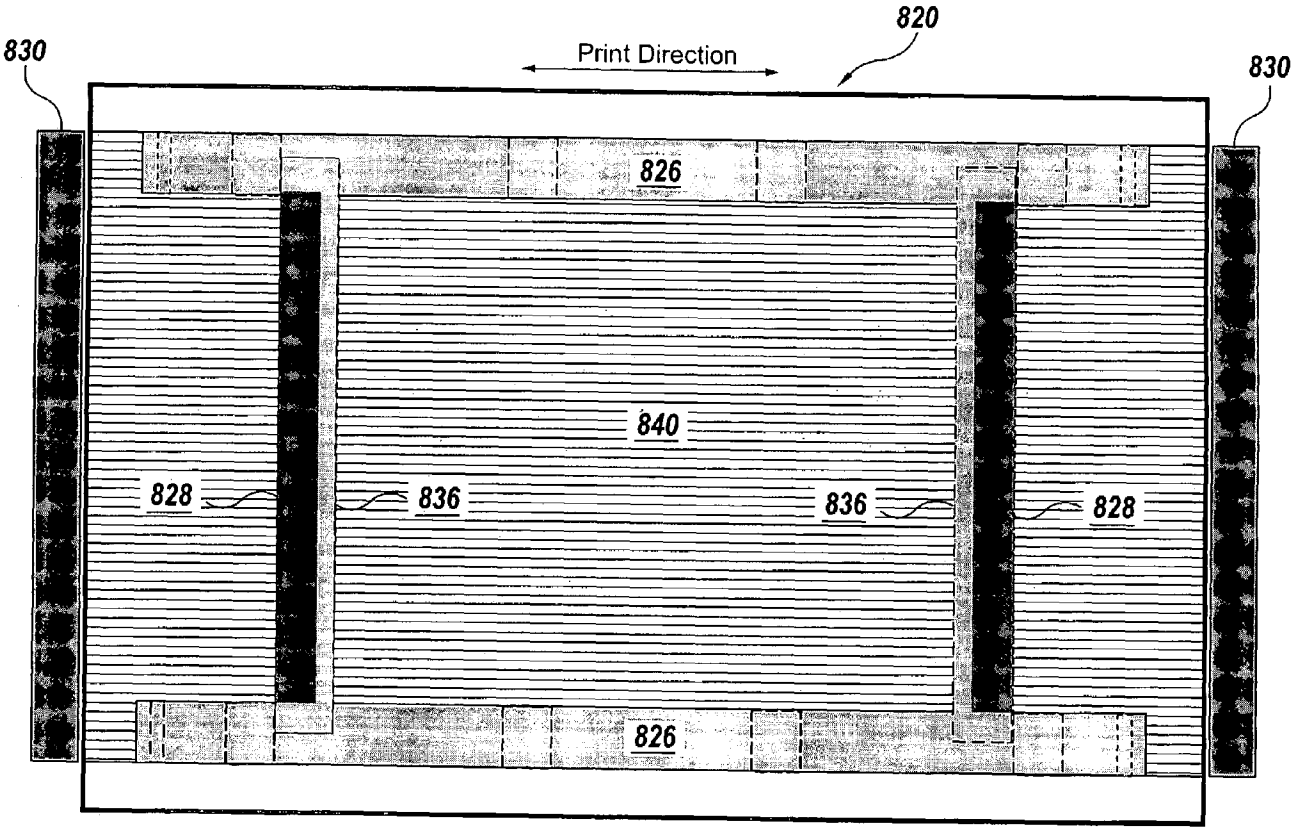
FIGS. 39A and 39B are top and side views of an inner frame placed on a print direction stretched screen/mesh according to the present invention.
Figure 39B:
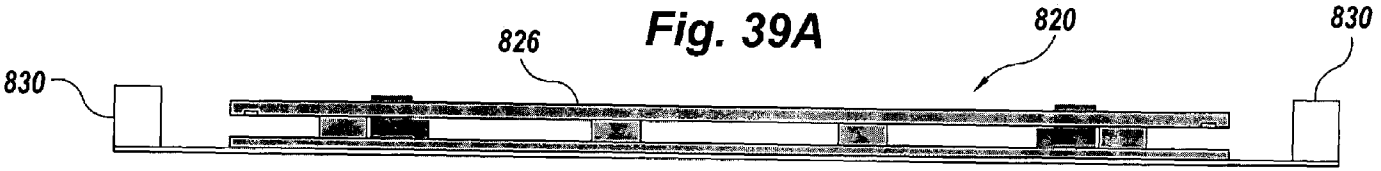
Figure 40A:
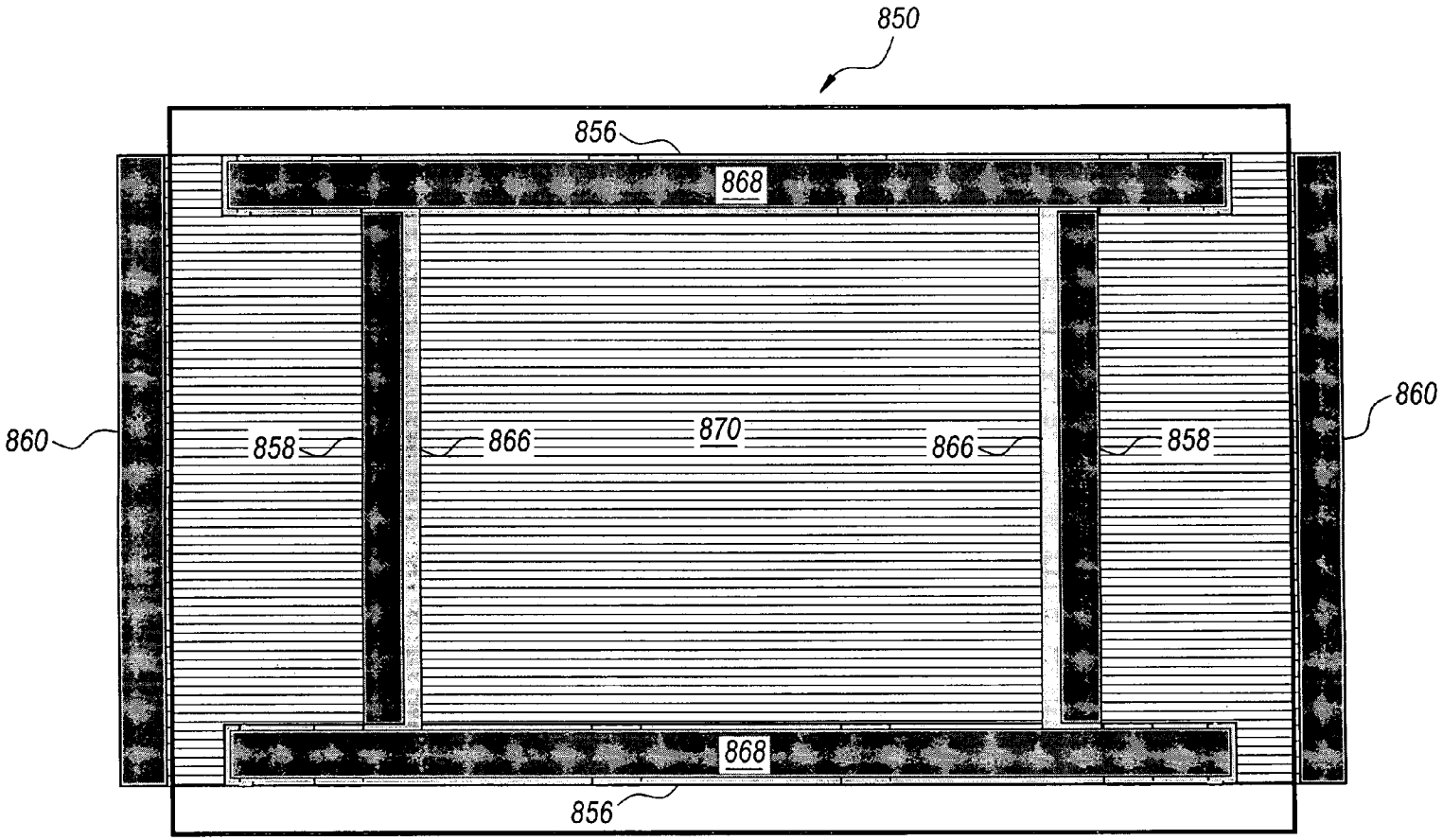
FIGS. 40A and 40B are top and side views of an inner frame fixed in position on a stretched screen/mesh according to the present invention.
Figure 40B:
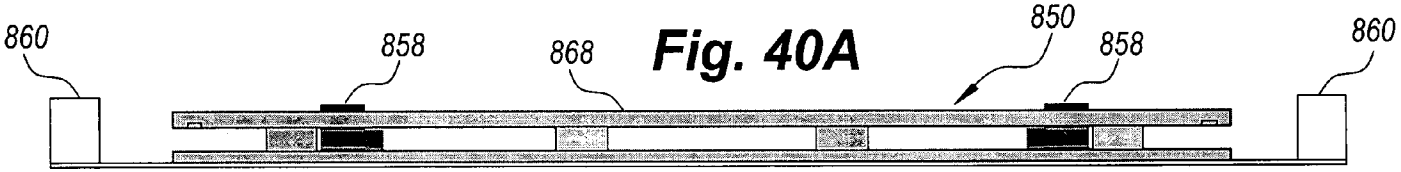
Figure 41A:
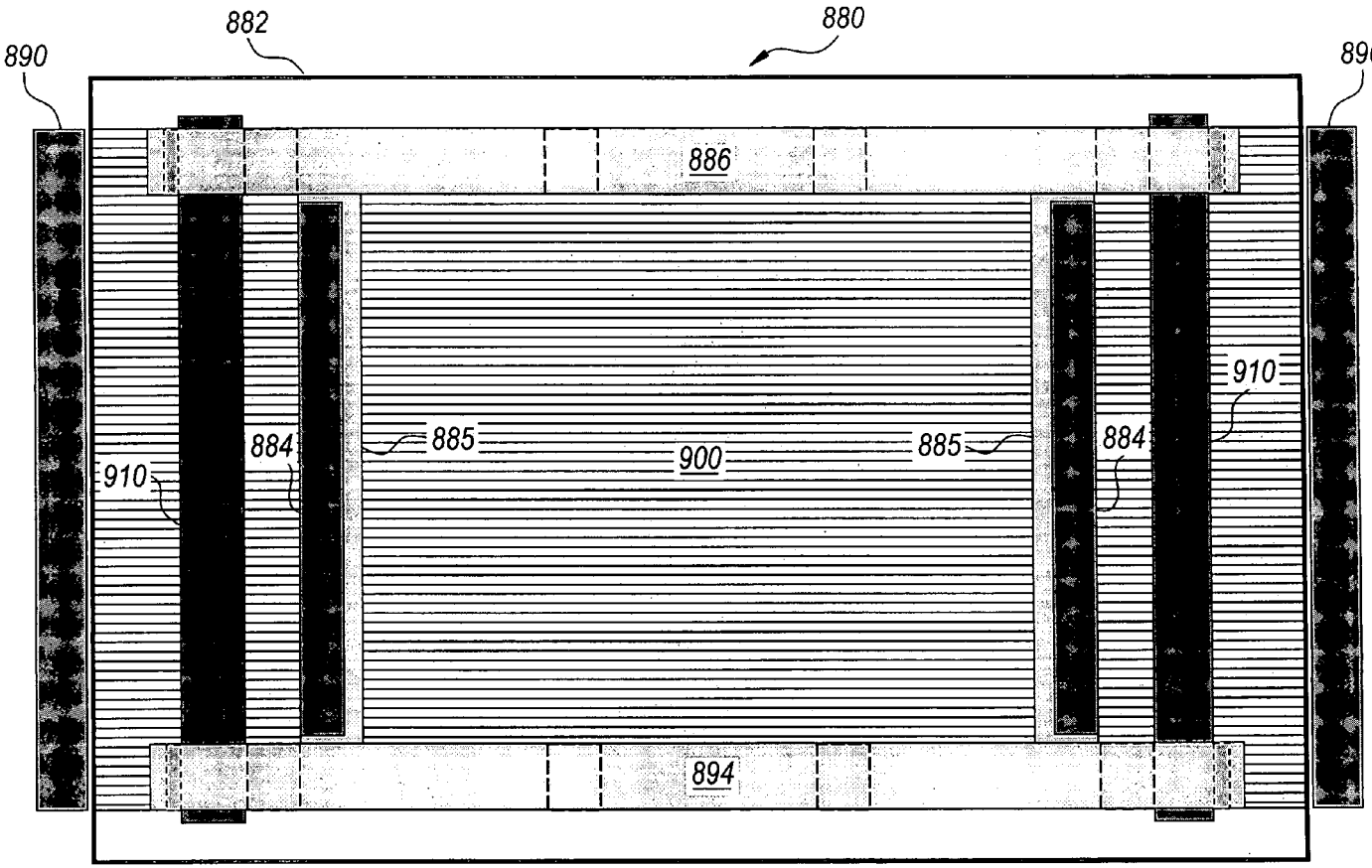
FIGS. 41A and 41B are top and side views of an inner frame fixed in position with end pieces fitted in location on a stretched screen/mesh according to the present invention.
Figure 41B:
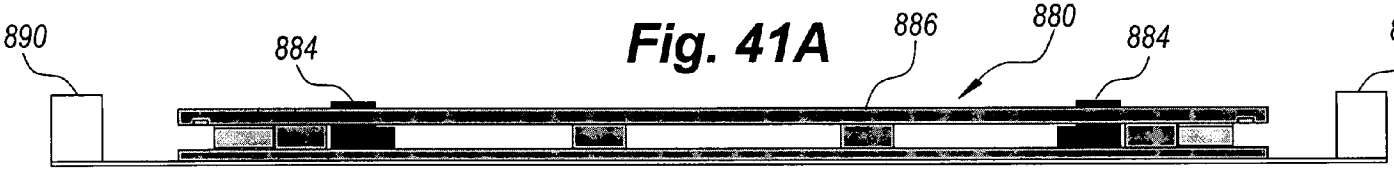
Figure 42:
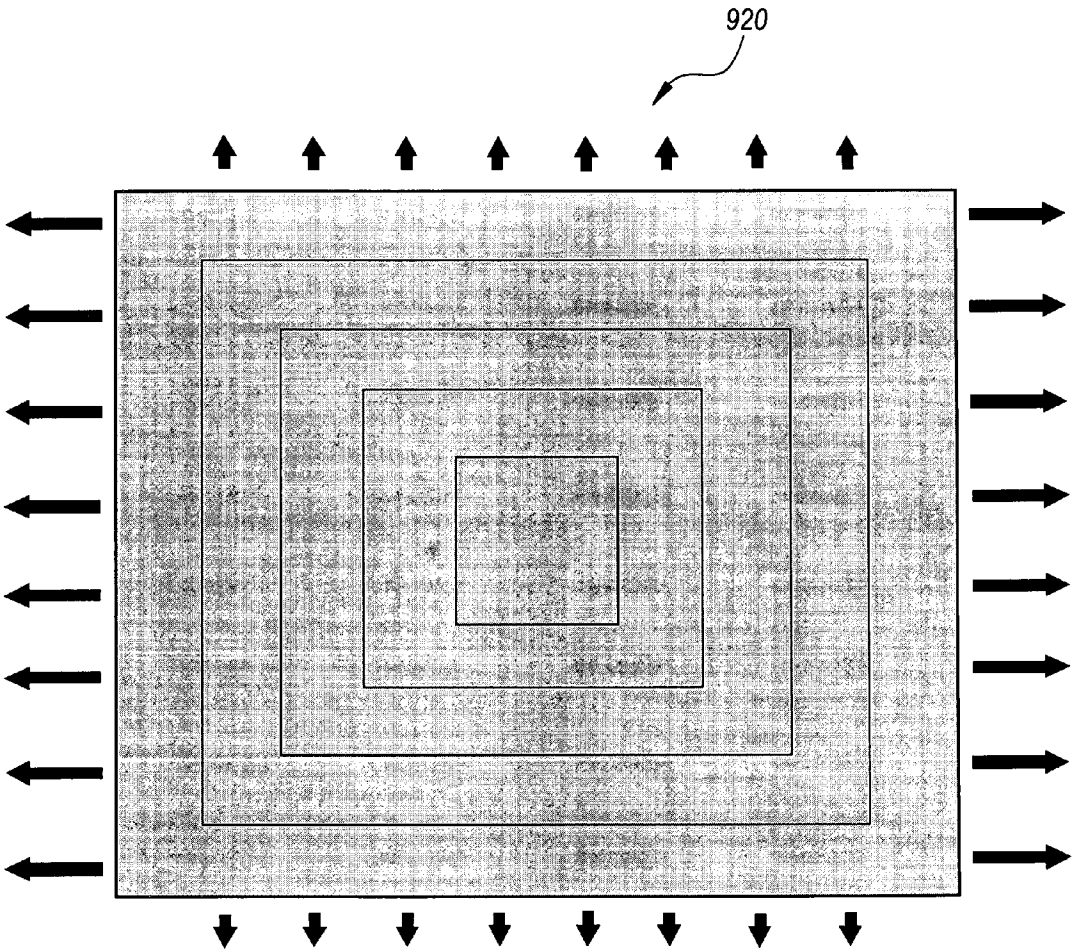
FIG. 42 illustrates lower level tension forces perpendicular to the print direction on a screen/mesh before inner frame mounting according to the present invention.
Figure 43:
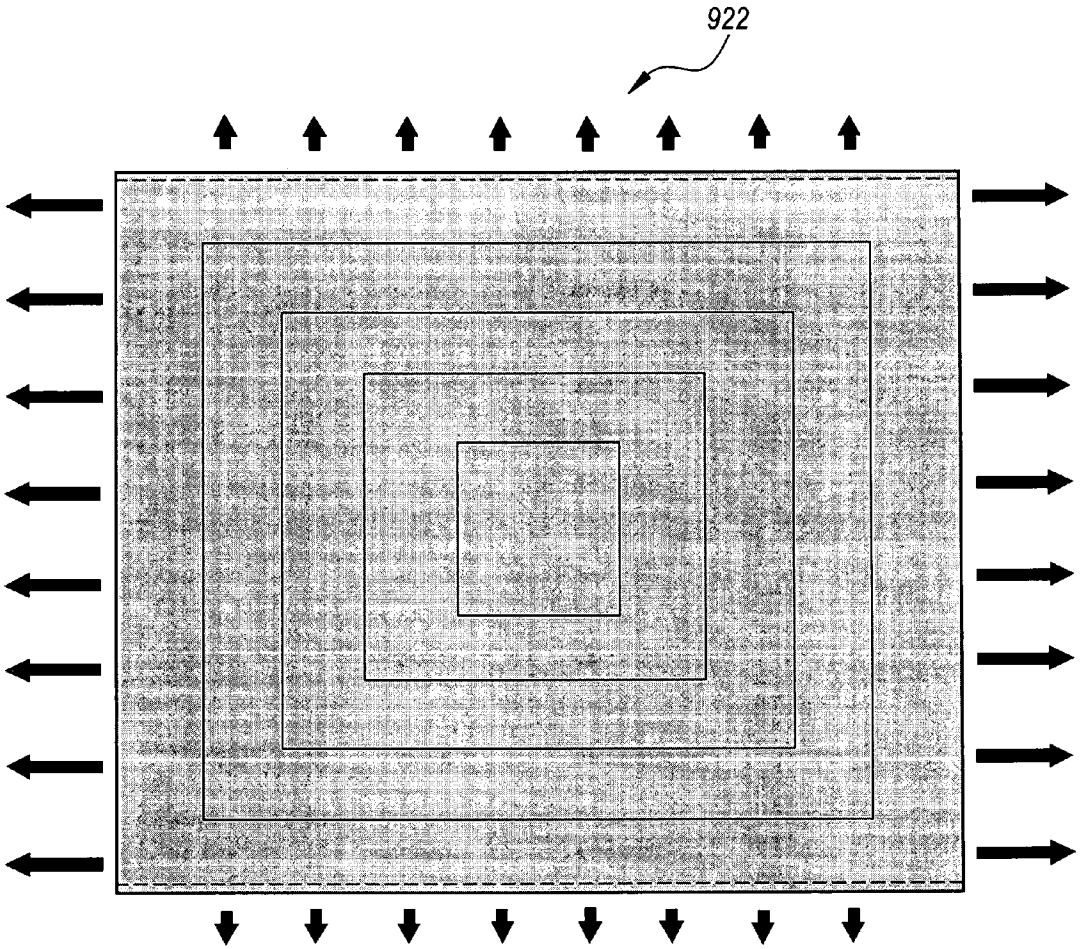
FIG. 43 illustrates a deflected screen/mesh following the fitting of inner frame end pieces according to the present invention.
Figures 44A, 44B:
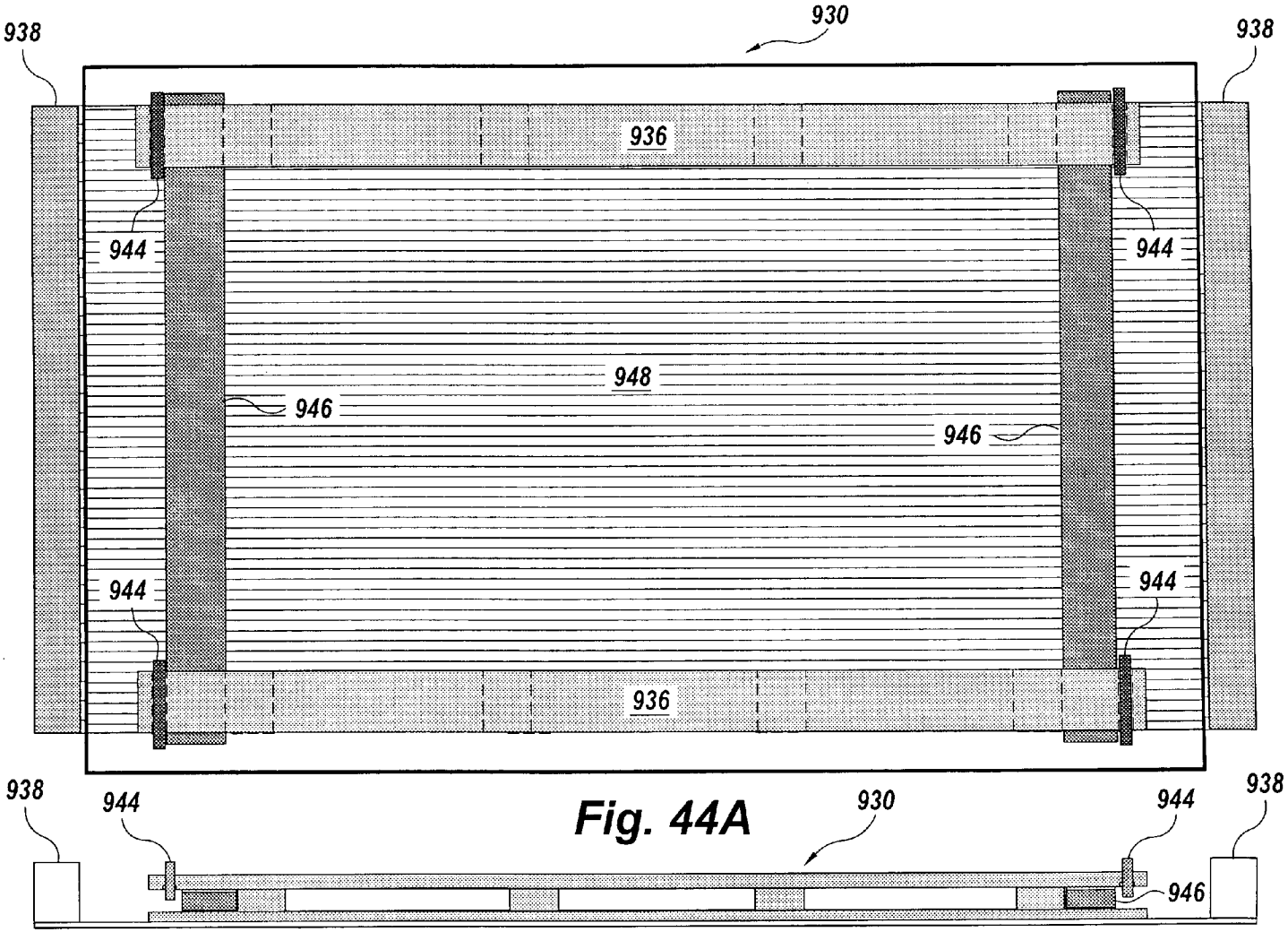
FIGS. 44A and 44B are top and side views of an inner frame with inner frame cross supports removed and the end pieces locked into position with locking clips on a screen/mesh according to the present invention.
Figures 45A, 45B:
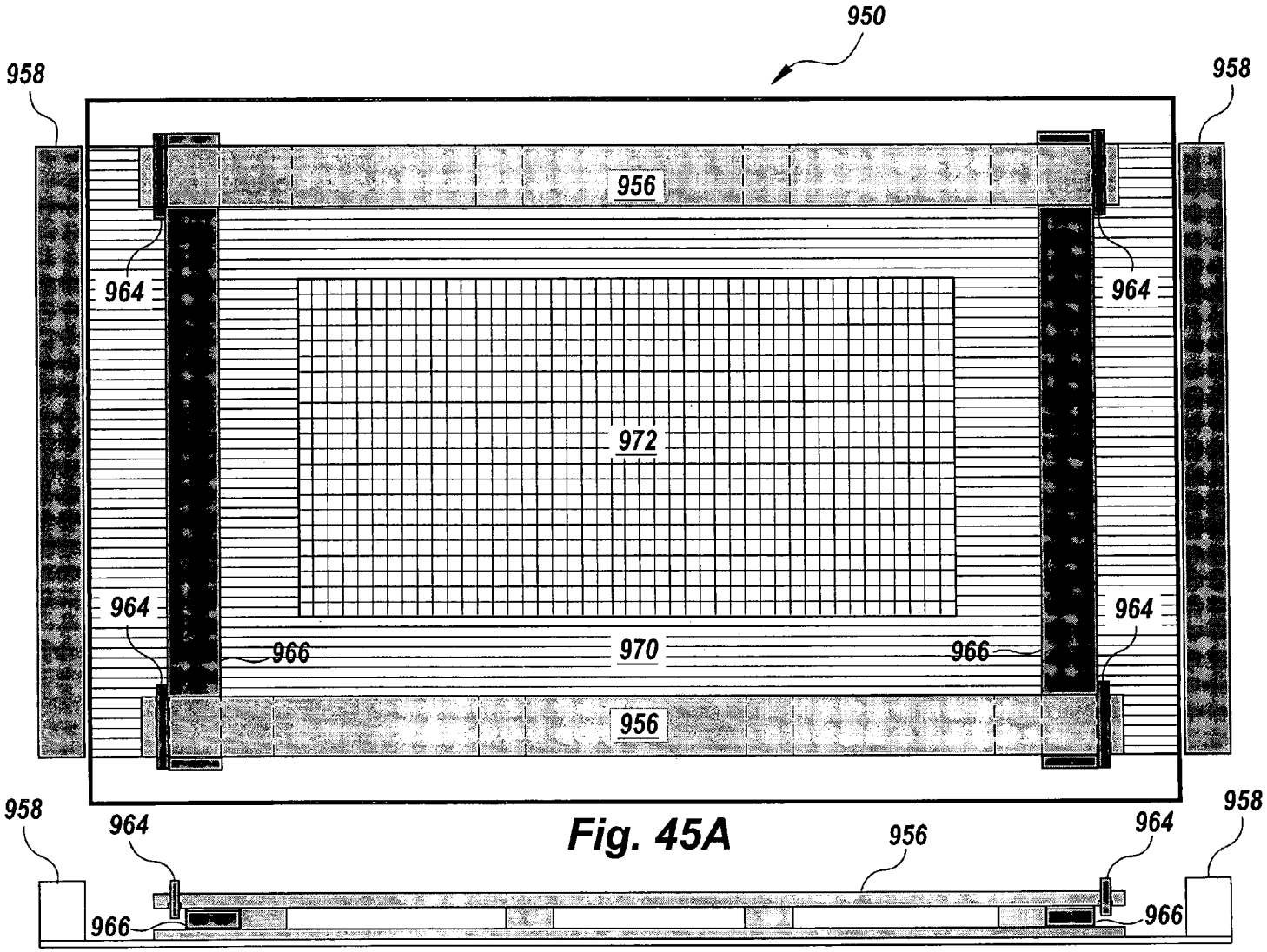
FIGS. 45A and 45B are top and side views of an inner frame on a screen/mesh illustrating the potential image area available according to the present invention.
Figure 46A:
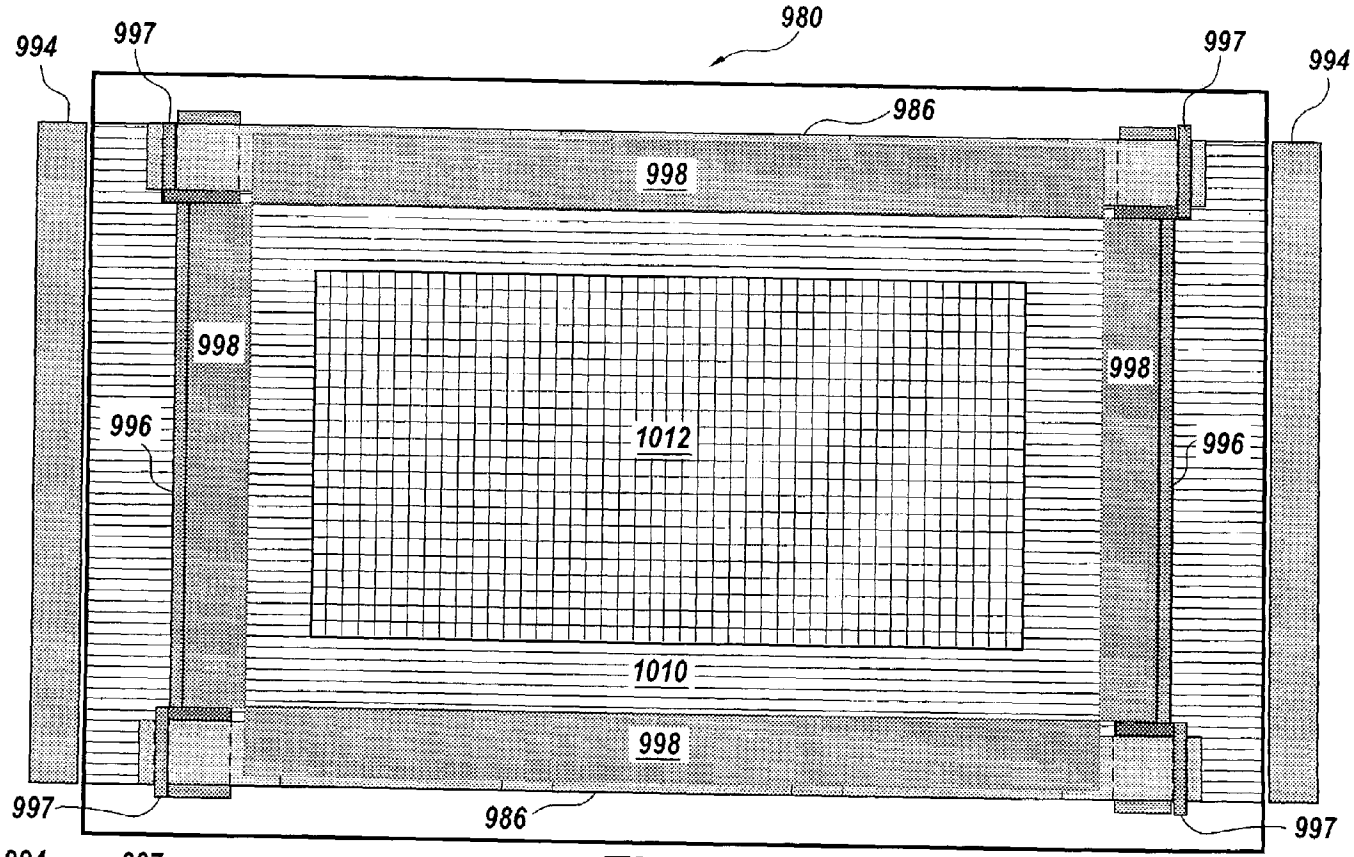
FIGS. 46A and 46B are top and side views of an inner frame on a screen/mesh, where ink barriers are applied to all four sides of the inner frame according to the present invention.
Figure 46B:
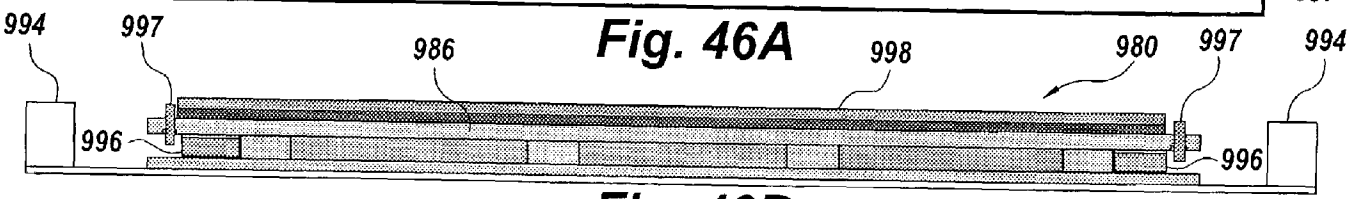

An image 800 of a screen/mesh 810 following print direction stretching is shown in FIGS. 38A and 38B. The screen/mesh 810 is fixed to an outer frame 806. An image 820 of an inner frame 826 placed on a print direction stretched screen/mesh 840 is shown in FIGS. 39A and 39B. The screen/mesh 840 is fixed to an outer frame 830. The inner frame 826 includes cross support elements 828 and 836. An image 850 of an inner frame 856 fixed in position on a stretched screen/mesh 870 is shown in FIGS. 40A and 40B. The screen/mesh 870 is fixed to an outer frame 860. The inner frame 856 includes cross support elements 858, 866, and side pieces 868. An image 880 of inner frame sides 886 fixed in position with end pieces 910 fitted in location on a stretched screen/mesh 900 is shown in FIGS. 41A and 41B. The screen/mesh 900 is fixed to an outer frame 890. The inner frame sides 886 include cross support elements 884 and 885 and end support elements 910. Lower level tension forces perpendicular to the print direction are applied to a screen/mesh 920 after an inner frame is mounted on the screen/mesh 920, as shown in FIG. 42. A deflected screen/mesh 922 following the fitting of inner frame end pieces is shown in FIG. 43. An image 930 of a screen/mesh 948 with inner frame cross supports removed and end pieces 946 locked into position with locking clips 944 is shown in FIGS. 44A and 44B. The screen/mesh 948 is fixed to an outer frame 938. An image 950 of a screen/mesh 970 with inner frame cross supports removed and end pieces 966 locked into position with locking clips 964 is shown in FIGS. 45A and 45B. The screen/mesh 970 is fixed to an outer frame 958. Once the inner frame sides 956 are attached, and the screen/mesh 970 has been stretched, the screen/mesh 970 is ready for stencil application and imaging in a potential image area 972. An image 980 of a screen/mesh 1010 with screen and ink/fluid barriers 998 in place is shown in FIGS. 46A and 46B. The screen/mesh 1010 has inner frame cross supports removed and end pieces 996 locked into position with locking clips 997. The screen/mesh 1010 is fixed to an outer frame 994. Once the inner frame 986 is attached, and the screen/mesh 1010 has been stretched, the screen/mesh 1010 is ready for stencil application and imaging in a potential image area 1012.

Figure 47A:
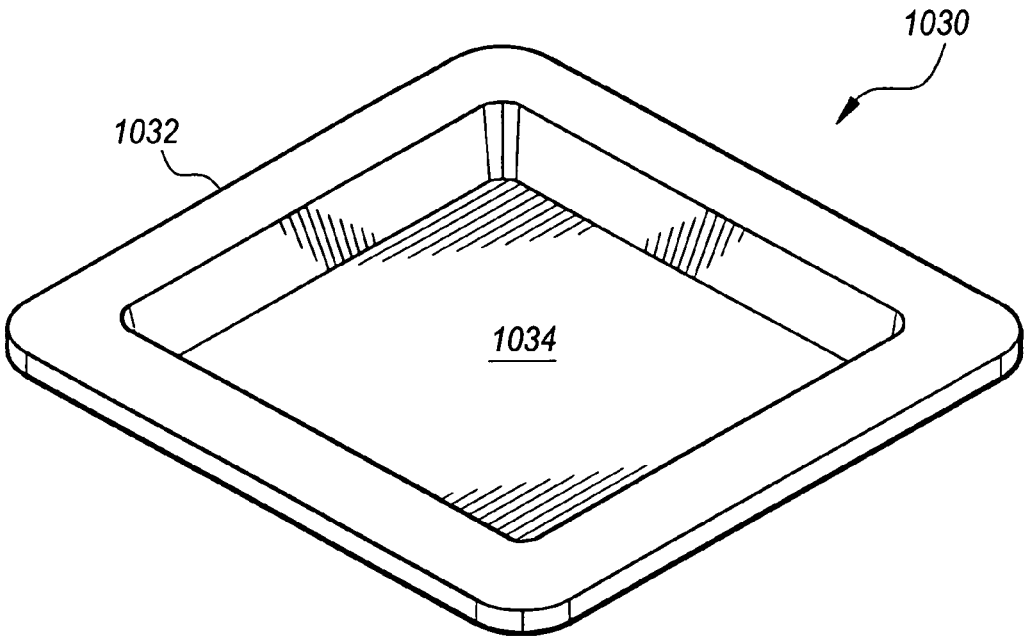
FIG. 47A is a top perspective view of a single-piece inner frame ink/fluid barrier structure according to the present invention.
Figure 47B:
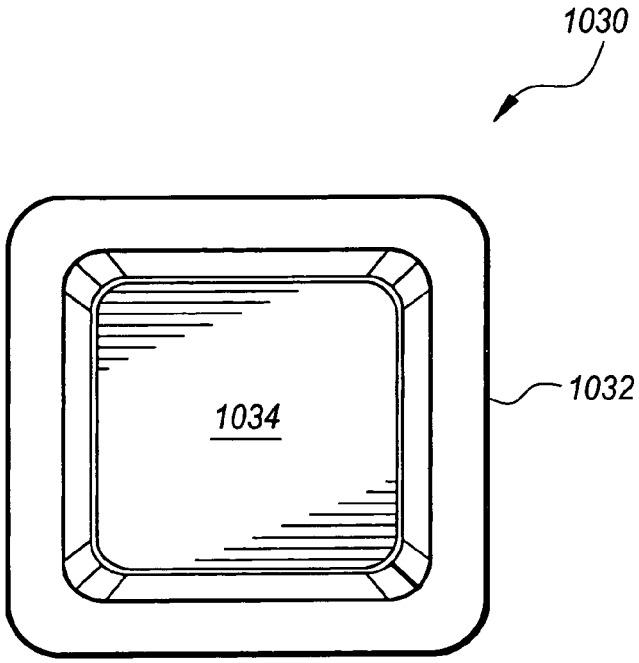
FIG. 47B is a top view of the single-piece inner frame ink/fluid barrier structure shown in FIG. 47A.
Figure 48:
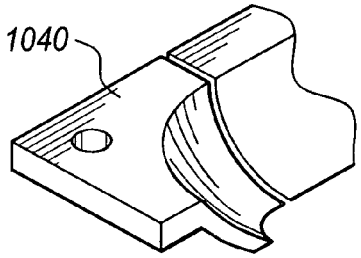
FIG. 48 is a top perspective view of an example of a corner structure of the inner frame ink/fluid barrier structure shown in FIGS. 47A and 47B.
Figure 49:
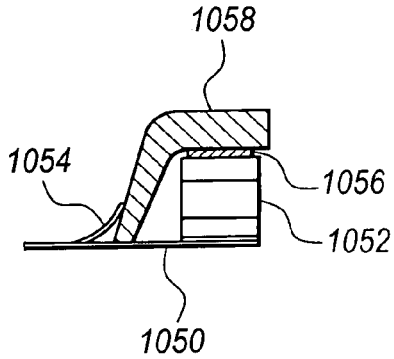
FIG. 49 is a cross sectional side view of a portion of an ink/fluid barrier on a screen/mesh according to the present invention.
Figure 50:
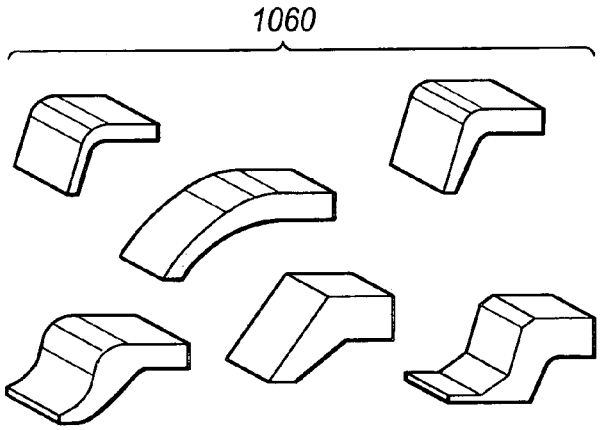
FIG. 50 shows ink/fluid barrier structures according to the present invention.
Figure 51A:
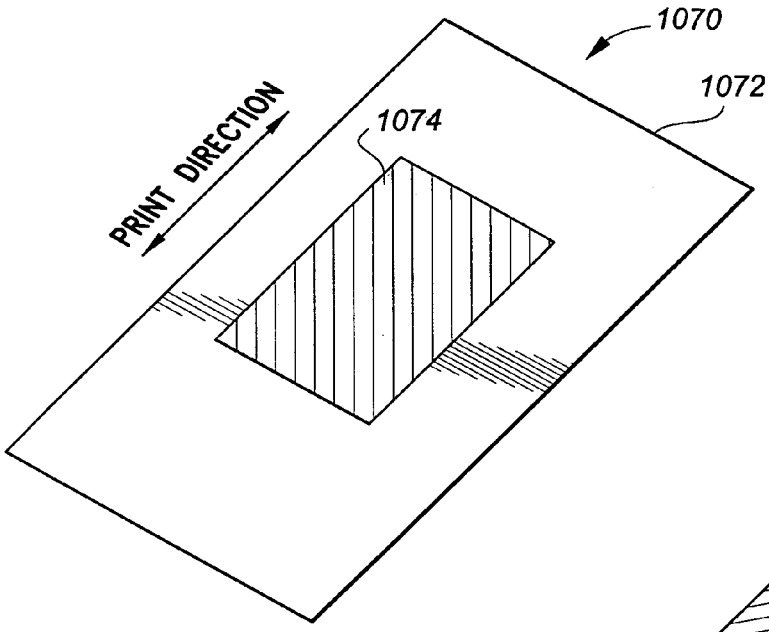
FIGS. 51A, 51B, 51C, and 51D illustrate various screen/mesh formats according to the present invention.
Figure 51B:
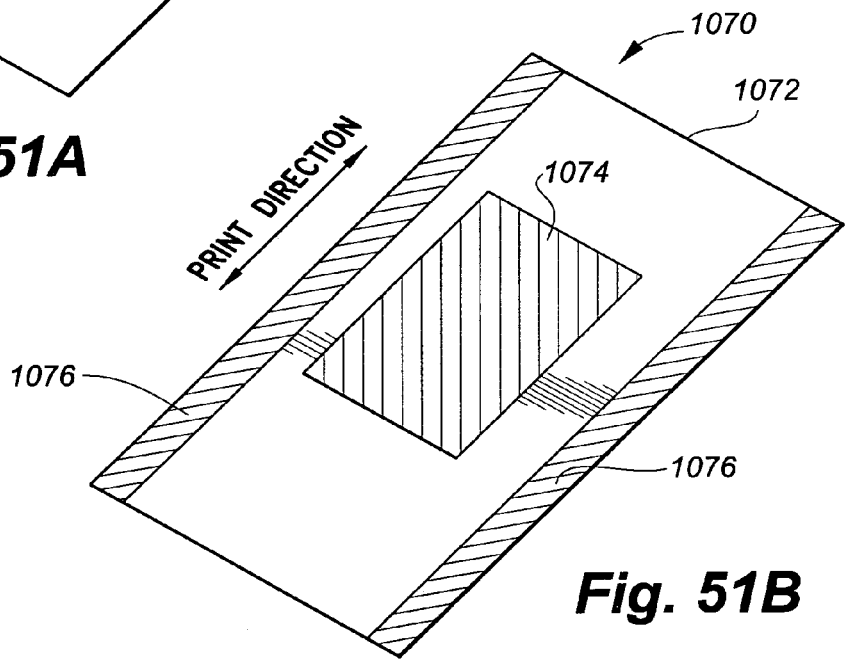
Figure 51C:
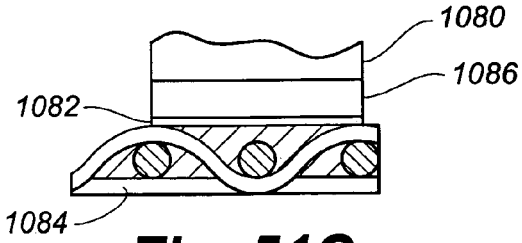
Figure 51D:
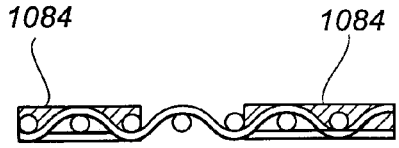
Figure 52:
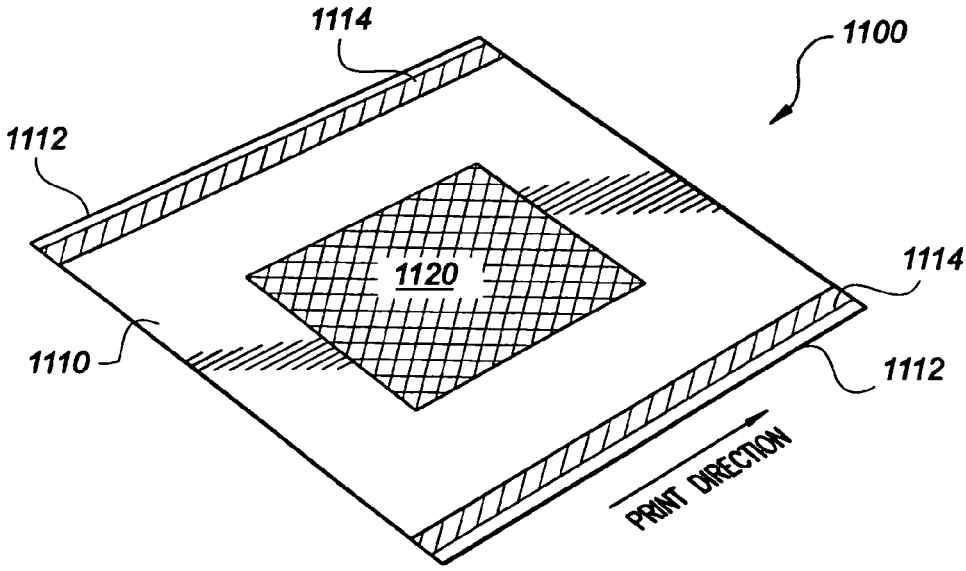
FIG. 52 is a screen/mesh with support strips according to the present invention.
Figure 53:
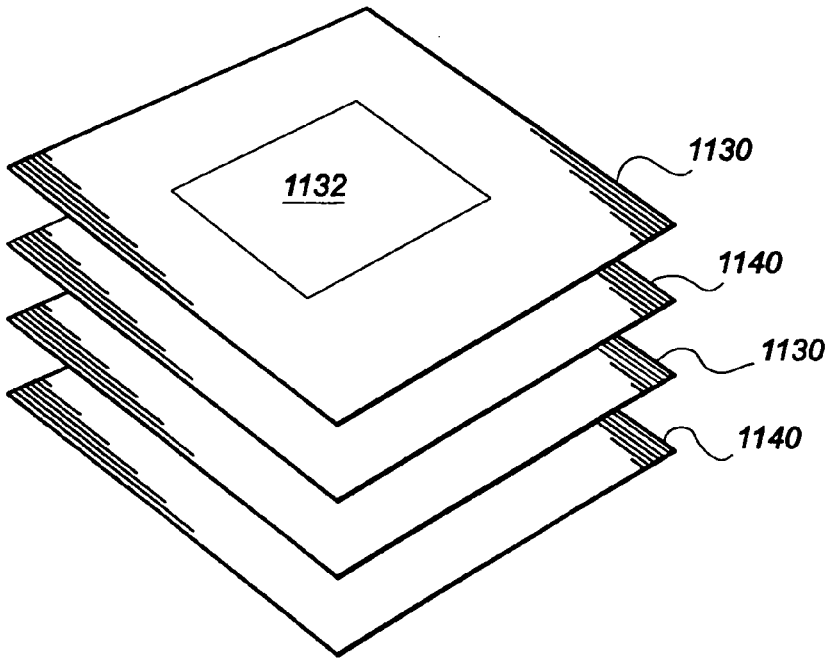
FIG. 53 illustrates plural screen/meshes with protective separator layers according to the present invention.

An image 1030 of a single-piece inner frame ink/fluid barrier structure 1032 resting on a screen/mesh 1034 is shown in FIGS. 47A and 47B. A corner structure 1040 of a multi-piece inner frame ink/fluid barrier structure is shown in FIG. 48. A portion of an ink/fluid barrier 1058 on an end or side piece 1052 is positioned on a screen/mesh 1050 and attached via 1054 and 1056 is shown in FIG. 49. Various ink/fluid barrier structures 1060 are shown in FIG. 50. Pre-coated screen/mesh properties are shown in FIGS. 51A–51D. FIG. 51A shows an image 1070 of a screen mesh 1072 with an image area 1074. Additional screen/mesh support strips 1076 for lateral tensioning on the screen mesh 1072 are shown in FIG. 51B. FIGS. 51C and 51D show elements 1080, 1082, and 1086 of a side piece on a support coating 1084 of a screen mesh. An image 1100 of a screen/mesh piece 1110 with an image area 1120 is shown in FIG. 52. The screen/mesh piece 1110 includes additional screen/mesh support strips 1114 for lateral tensioning near sides 1112. Pre-cut screen/mesh pieces 1130 with image areas 1132 separated with protected layers 1140 for shipping and storage are shown in FIG. 53.

The dual frame is prepared with adhesive tape (double sided). Minor lateral tension is applied to ensure the screen/mesh is flat and wrinkle free before clamping for stretching. The screen/mesh is clamped for stretching. The screen/mesh is stretched in the print direction. The second surface of the double sided tape is readied for adhesion. If available, the outer frame position is moved to ensure the stretched screen/mesh is central. The frame is raised to bring it into contact with the screen/mesh. Pressure is applied to ensure good bonding between the screen/mesh and the double sided adhesive tape. The tension is removed and excess screen/mesh is trimmed. The frames may be rotated 180 degrees for access to the upper non print surface of the screen/mesh.

The dual frame system is produced by assembling the inner frame. The two inner frame side pieces are fixed to the two inner frame cross supports and may be secured in position with four inner frame assembly support clips. Double sided tape is prepared and applied to the bottom bar of both inner frame sidepieces, and is not exposed on the free surface of the double sided tape. The inner frame parallel guide may be attached to each of the inner frame cross supports, as a pair on one of both sides of the inner frame sidepieces. The distance may be set from the outer frame inner edge for the inner frame parallel guides. The protective film may be removed from the double sided tape to expose the adhesive. The inner frame may be rotated so that the adhesive tape faces the exposed mesh, and the inner frame sidepieces are in the print direction. The inner frame may be lowered into contact with the screen/mesh, ensuring that it is centered and parallel with the outer frame sides (using the inner frame parallel guides if present). Pressure may be applied to ensure that there is a good bond between the screen/mesh and the tape. The inner frame sidepieces may be attached to a solid edge strip if the screen/mesh has a solid edge strip. This provides maximum contact area for adhesion and support between the inner frame and the screen/mesh. The inner frame parallel guides may be removed after stretching if necessary.

The inner frame assembly support clips are removed in preparation for the next stage. The first inner frame end piece with profiled corners is inserted inward to assist location, and pulled into contact with the end support on the inner frame sidepiece. The process is repeated for the second inner frame end piece. The four locking clips are inserted on the inner frame side pieces to secure the inner frame end supports in position. The inner frame cross supports are now loose, and are moved away from the end supports and rotated to allow removal. The inner frame is now installed and the screen/mesh tensioned. The inner edges of the inner frame sidepieces may be sealed with single sided adhesive tape to ensure that there is no fluid encroachment into the adhesive bond, particularly during the image washout part of the image preparation. The screen/mesh is then ready for use.

The four interlocking frame pieces of a four-piece frame system do not need prior assembly. The end pieces are configured to be in an upper non-tensioned position. The double sided adhesive tape is applied to the side pieces and exposed. The screen/mesh is already attached to the outer frame, and is checked to ensure that it is flat and wrinkle free. The side pieces are held, the frame is lowered onto the screen/mesh, parallel to the outer frame, and pressure is applied to seal the side inner frame pieces to the screen/mesh. Once bonded, pressure is applied to the end pieces, pushing them down until locked in position. This motion forces a fixed displacement of the side pieces outwards, applying lateral tension to the screen/mesh. This is repeated for the second end piece. The inner edges of the side pieces are sealed and ready for stencil application and/or imaging. Alternatively, the inner frame end pieces may be hinged and pulled into a straight position to apply the lateral tension.

A single piece dual frame system does not apply lateral tension to the screen/mesh, so the following procedure can be carried out before or after the stencil application and imaging stages of the process. This is possible because the single piece frame supports the screen/mesh and acts as the ink barrier, without applying any lateral tension, so it will not cause image distortion if applied after imaging. The screen/mesh is prepared, with or without the stencil and image applied. The double sided adhesive tape is applied to the inner frame side pieces and exposed. The screen/mesh is checked to ensure that it is flat and wrinkle free. The inner frame is applied to the non-print surface of the screen/mesh, parallel to the outer frame and central, and pressure is applied to ensure good bonding of the inner frame to the mesh. The inside edges of the side pieces are sealed and ready for stencil application and/or imaging, if not already completed.

The dual frame systems are applicable to both pre-coated screen/mesh pieces, with the stencil supplied already applied to the screen/mesh, and bare screen/mesh ready for stencil application. The pre-coated stencil simplifies the production process by eliminating this step and set of variables for the screen printer, but adds a registration and positional issue during stretching and mounting. For all of the dual frame systems, it may be applicable to apply the stencil before application of the inner frame. This simplifies access and makes the coating operation faster. The dual frame systems use conventional stencil application techniques for screen/mesh pieces that are not pre-coated. The stencil may be a photosensitive layer coated onto the bare mesh. Multiple layers of stencil may be applied and dried on a single mesh/screen ready for use.

The screen/mesh is now ready for imaging. A standard imaging process may be followed for conventional flat screens. Although not limited to this, one such procedure is listed below. The negative may be applied to the screen, locating it carefully. It may be exposed to a controlled amount and intensity of ultra violet light. The ultra violet light cures the exposed stencil, causing a physical change hardening and increasing resistance to removal. Areas not exposed to ultra violet light remain soft and water soluble. Any unwanted stencil materials may be washed out using water. The screen may then be dried. The process is completed in line with normal production procedures.

The screen/mesh is now stretched, imaged, mounted, and ready for final preparations. The ink/fluid barrier(s) are applied to the inner frame. Three categories of ink/fluid barriers include integral frame pieces that act as ink/fluid barriers, a single piece ink/fluid barrier construction with fixed screen image area dimensions, and a multi-piece ink/fluid barrier construction allowing a range of image areas and shapes to be considered. Each vertical barrier surface is sealed using single sided tape to ensure no ink/fluid leakage between the barrier components. There are four initial attachment techniques envisaged for the ink/fluid barriers to the inner frame. VELCRO, i.e., hook and loop fasteners, may be attached to the side and end pieces. Double sided (foam) adhesive tape may be attached to the top of the frame and matching surface on the ink barrier side and end pieces. Quick fit pin (or similar) registration and locking at the corners may be applied to the inner frame side piece. Liquid or spray adhesive may be used. With the ink barrier assembled and in position attached to the inner frame, its edges to the screen are sealed using single sided self adhesive tape, to ensure no ink/fluid leakage under the ink/fluid barrier(s). The screen is now ready to be used on press.

Snap off forces may be reduced and may need compensation. Natural snap off action due to the motion of a cylinder press mechanism does not pose major issues. Snap off ensures that this will be controlled by the print direction tension applied to the screen/mesh. If a problem occurs higher tension levels should be used. The support strip for the inner frame side pieces may also be of impact, with thicker support strips adding height for additional snap off. The choice of double sided adhesive tape to attach the inner frame to the screen/mesh may be selected to affect this, by use of a foam construction tape to increase the elasticity and snap back effect due to the tape. The squeegee action should be parallel with the frame side to ensure no lateral register problems. Squeegee setup may be simplified, with lower pressure levels required. More consistent and even squeegee deflection across the print width reduces density variation. Ink barriers hold the ink/fluid in place with a reduced open/spare screen/mesh surface due to the inner frame. The volume holding capacity of the screen/mesh may be reduced, resulting in the need for smaller but more frequent ink/fluid replenishment. Automatic ink/fluid delivery may be employed. Smaller ink/fluid volume ensures that the ink/fluid is regularly and consistently moved, improving flow properties and ink/fluid transfer uniformity.

Once printing is complete the screen/mesh is washed down as normal to remove all unwanted ink/fluid and debris. If needed to be used for the same image, the screen/mesh is then dried. The frame is stored in an appropriate rack system. Preference may be to store the frame and screen/mesh with the print direction of the frame vertically positioned. If the screen/mesh is to be reused for a new image, excess ink/fluid is removed from the screen/mesh and the screen is washed clean. The screen/mesh is removed from the press, and place in suitable location. The sealing tape is removed and disposed of from the ink/fluid barrier to the screen/mesh. The ink/fluid barriers are removed, and any ink/fluid residue is washed away so that the ink/fluid barriers are ready for reuse. The four locking clips are removed from the inner frame sidepieces. The two inner frame end pieces are removed. The two inner frame sidepieces are carefully pealed away from the double sided adhesive tape and the screen, starting in the corner, and using tape manufactures advised technique. Any excess double sided tape or adhesive tape is removed from the inner frame side pieces and the screen/mesh. The screen/mesh is exposed ready for stencil removal using conventional stencil removal techniques. The unwanted stencil is removed. The screen/mesh is ready once the stencil is fully removed. The new stencil layer(s) are mounted onto the screen/mesh using conventional stencil application techniques. The stencil is dried and ready for use. All of the inner frame components are checked to be sure they are clean and ready for use. The inner frame is applied following the procedure previously described. Note for the case of a capillary action stencil film, it may be attached after the inner frame is applied to the clean mesh.

If the screen/mesh is to be disposed of, excess ink/fluid is removed from the screen and wash screen clean. The screen/mesh is removed from the press, and placed in suitable location. The sealing tape is removed from the ink/fluid barrier and disposed from the screen/mesh. The ink/fluid barriers are removed, and any ink/fluid residue is cleaned away, so that the ink/fluid barriers are ready for reuse. The four locking clips are removed from the inner frame sidepieces. The two inner frame end pieces are removed. The two inner frame sidepieces are removed away from the double sided adhesive tape and the screen/mesh, starting in the corner, and using tape manufactures advised technique. Any excess double sided tape or adhesive tape is removed from the inner frame side pieces ready for reuse. The screen/mesh is pulled away from the double sided adhesive tape on the outer frame, starting in the corner, and using tape manufactures advised technique. Any excess adhesive tape or residue is removed from the outer frame and clean ready for reuse. The outer frame is removed to a storage area ready for reuse. The used screen and adhesive tapes are disposed of in a controlled, consistent, and environmentally friendly manner.

The dual frame system described above is highly suited to the supply of individual screen/mesh pieces, supplied flat with a protective separating layer of suitable materials in boxes. The dual frame system simplifies storage, distribution, handling, and identification of screen/mesh samples and properties. The dual frame system also suits the use of pre-coated stencil, removes several pre-print stages in production, and improves stencil properties through industrial production. The system also simplifies the selection and use of optimum screen/mesh/stencil combinations for individual print jobs, specifications, and print applications.

The dual frame system only needs the screen/mesh stretched in the print direction simplifying the process, and significantly reducing the variables involved. However, in combination with individual screen/meshes, especially when pre-coated with stencil, new stretching systems that allow repositioning of the outer frame relative to the stretched screen/mesh prior to being fixed to the screen/mesh may be required.

In the dual frame system, the screen/mesh is attached to the inner frame on the outer edges allowing the screen to deflect evenly and consistently across the image width, without significantly greater resistive forces at the edges. This allows minimum squeegee pressures to be applied evenly across the width of the print image, reducing the squeegee wear, increasing squeegee and screen/mesh life, while producing a more consistent print result.

The dual frame system allows the elimination, if required, of the reclaiming of the screen/mesh material, by allowing removal of the inner frame from the screen for simplified stencil access and removal, or complete removal of the screen from the outer frame for disposal. Through the use of double sided self adhesive tapes, and similar techniques, the frame components are immediately available for reuse in the stretching and mounting of a new screen/mesh onto the outer and inner frames. In addition, the use of screen/meshes with the stencil pre-applied produces a more efficient, consistent, cost effective, and repeatable process, with high volumes of screen/meshes to recycle making the industrial recycling of the waste screen/meshes following disposal economically more viable.

The present invention is intended to provide a screen printing method and apparatus that assures reliable printing qualities, while offering the potential of a simplified production system by achieving disposable screen printing with woven screen/mesh materials.

While the invention has been described with references to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A method for stretching and mounting a screen printing screen, comprising:

providing an outer frame with two ends generally perpendicular to a print direction;

providing an inner frame with two print direction sides generally parallel to the print direction;

providing a screen/mesh with two print direction sides and two ends, the print direction sides being generally parallel to the print direction and the ends being generally perpendicular to the print direction;

clamping an end of the screen/mesh;

applying significant tension forces to the screen/mesh in the print direction to produce a stretched screen/mesh;

moving the ends of the outer frame to contact the stretched screen/mesh;

attaching the stretched screen/mesh to the ends of the outer frame;

trimming excess screen/mesh along the print direction;

moving the inner frame to contact the screen/mesh;

attaching the screen/mesh to the print direction sides of the inner frame; and providing imaging/printing on the screen/mesh.

2. The method according to claim 1, further comprising applying tension forces to the screen/mesh in a direction perpendicular to the print direction that are lower than the applied significant forces in the print direction.

3. The method according to claim 1, further comprising applying small lateral forces to the screen/mesh perpendicular to the print direction prior to clamping or stretching the screen/mesh to ensure the screen/mesh is flat, with no significant non-uniformities/wrinkles.

4. The method according to claim 1, wherein the clamping step further comprises:

positioning the outer frame; and clamping the end of the screen/mesh to one end of the outer frame.

5. The method according to claim 1, wherein the providing a screen/mesh step further comprises:

applying a strip of material to each print direction side of the screen/mesh to provide a seal against fluid encroachment in a bond between the screen/mesh and the inner frame.

6. The method according to claim 1, wherein the attaching step further comprises attaching the screen/mesh to the inner frame by using spray adhesive, adhesive glue, or double sided self-adhesive tape.

7. The method according to claim 1, wherein the providing an inner frame step further comprises providing the inner frame in a fixed format.

8. The method according to claim 1, wherein the providing an inner frame step further comprise:

providing the inner frame in a multi-piece format with plural pieces and connection pieces; and applying lateral tension forces to the screen/mesh in a direction perpendicular to the print direction through lateral fixed displacements of movements of the plural pieces or the connection pieces of the multi-piece inner frame relative to each other.

9. The method according to claim 1, wherein the clamping an end of the screen/mesh step further comprises clamping one of the two ends of the screen/mesh before stretching and clamping the other of the two ends.

10. The method according to claim 1, wherein the providing an inner frame step further comprises attaching ink/fluid barriers to the inner frame.

11. The method according to claim 10, wherein the attaching ink/fluid barriers to the inner frame step further comprises attaching using hook and loop fasteners, spray adhesive, liquid adhesive, self adhesive double sided tape, mechanical locking elements, or single sided adhesive tape.

12. The method according to claim 1, wherein the providing a screen/mesh step further comprises providing the screen/mesh as one or more screens/meshes on a roll.

13. The method according to claim 12, wherein the providing a screen/mesh step further comprises:

applying a strip of material to each print direction side of the one or more screens/meshes to provide an attachment point, support, and a seal against fluid encroachment in a bond between the one or more screens/meshes and the inner frame.

14. The method according to claim 12, wherein the providing a screen/mesh step further comprises separating individual screen/mesh pieces from the one or more screens/meshes for shipping and storage, and providing the separated individual screen/mesh pieces with a protective material.

15. The method according to claim 14, wherein the providing a screen/mesh step further comprises:

applying a strip of material to each print direction side of the separated individual screen/mesh pieces to provide an attachment point, support, and a seal against fluid encroachment in a bond between the separated individual screen/mesh pieces and the inner frame.

16. The method according to claim 1, wherein the providing a screen/mesh step further comprises providing the screen/mesh as individual pre-cut pieces that are edge sealed to ensure dimensional stability and integrity.

17. The method according to claim 16, wherein the providing a screen/mesh step further comprises:

applying a strip of material to each print direction side of the individual pre-cut pieces to provide an attachment point, support, and a seal against fluid encroachment in a bond between the individual pre-cut pieces and the inner frame.

18. An apparatus for stretching and mounting a screen printing screen, the apparatus comprising:

an inner frame with two print direction sides for attaching to print direction sides of a screen/mesh, said sides of said inner frame being positionable generally parallel to a print direction; and an outer frame with two ends for attaching to ends of a screen mesh, said ends of said outer frame being positionable generally perpendicular to the print direction, said outer frame being placeable outside the inner frame, wherein the inner and outer frames do not connect, support, or constrain each other to provide tension, and enable application of significant tension forces to the screen/mesh in the print direction.

19. The apparatus according to claim 18, wherein the two print direction sides of the inner frame can apply tension forces to the screen/mesh in a direction perpendicular to the print direction that are lower than applied significant forces in the print direction.

20. The apparatus according to claim 18, wherein the apparatus can apply small lateral forces to the screen/mesh perpendicular to the print direction prior to clamping or stretching the screen/mesh to ensure the screen/mesh is flat, with no significant non-uniformities/wrinkles.

21. The apparatus according to claim 18, further comprising a positioning device configured to position the outer frame, and clamp elements configured to clamp the screen/mesh to the outer frame after the outer frame is positioned.

22. The apparatus according to claim 18, further comprising attachment means for attaching the screen/mesh to the inner frame by using spray adhesive, adhesive glue, or double sided self-adhesive tape.

23. The apparatus according to claim 18, wherein the inner frame is configured in a fixed format.

24. The apparatus according to claim 18, wherein the inner frame is configured in a multi-piece format with plural pieces and connection pieces, and is configured to apply lateral tension forces in a direction perpendicular to the print direction to the screen/mesh through lateral fixed displacements of movements of the plural pieces or the connection pieces of the multi-piece inner frame relative to each other.

25. The apparatus according to claim 18, further comprising clamping means for clamping one of the two ends of the screen/mesh before stretching and clamping the other of the two ends.

26. The apparatus according to claim 18, further comprising ink/fluid barriers attached to the inner frame, said ink/fluid barriers providing ink/fluid retention for controlled transfer of ink during a printing period to a screen/mesh with two print direction sides and two ends, the print direction sides being generally parallel to a print direction and the ends being generally perpendicular to the print direction.

27. The apparatus according to claim 26 wherein the ink/fluid barriers are attached to the inner frame using hook and loop fasteners, spray adhesive, liquid adhesive, self adhesive double sided tape, mechanical locking elements, or single sided adhesive tape.

28. The apparatus according to claim 18, in combination with a screen/mesh configured as one or more screens/meshes on a roll, the screen/mesh having two print direction sides and two ends, the print direction sides being generally parallel to the print direction and the ends being generally perpendicular to the print direction.

29. The apparatus according to claim 28, wherein the one or more screens/meshes are configured with a strip of material on each print direction side of the one or more screens/meshes to provide an attachment point, support, and a seal against fluid encroachment in a bond between the one or more screens/meshes and the inner frame.

30. The apparatus according to claim 18, in combination with a screen/mesh configured as a separate individual screen/mesh piece with a protective material for shipping and storage.

31. The apparatus according to claim 30, wherein the separate individual screen/mesh piece includes a strip of material on each print direction side to provide an attachment point, support, and a seal against fluid encroachment in a bond between the separated individual screen/mesh pieces and the inner frame.

32. The apparatus according to claim 18, in combination with a screen/mesh configured as individual pre-cut pieces that are edge sealed to ensure dimensional stability and integrity, the screen/mesh having two print direction sides and two ends, the print direction sides being generally parallel to the print direction and the ends being generally perpendicular to the print direction.

33. The apparatus according to claim 32, wherein the pre-cut pieces each include a strip of material on each print direction side to provide an attachment point, support, and a seal against fluid encroachment in a bond between the individual pre-cut pieces and the inner frame.

* * * * *